US007500360B2

(12) United States Patent
Udagawa et al.

(10) Patent No.: US 7,500,360 B2
(45) Date of Patent: Mar. 10, 2009

(54) HYDRAULIC DRIVING SYSTEM OF CONSTRUCTION MACHINERY

(75) Inventors: Tsutomu Udagawa, Ibaraki-ken (JP); Kazuo Takiguchi, Ibaraki-ken (JP); Masami Ochiai, Atsugi (JP); Takashi Yagyuu, Ushiku (JP); Yukihiko Sugiyama, Tsuchiura (JP); Mitsuo Aihara, Ibaraki-ken (JP)

(73) Assignee: Hitachi Constuction Machinery Co., Ltd., Tokyo (JP)

( * ) Notice: Subject to any disclaimer, the term of this patent is extended or adjusted under 35 U.S.C. 154(b) by 883 days.

(21) Appl. No.: 10/499,307

(22) PCT Filed: Aug. 29, 2003

(86) PCT No.: PCT/JP03/11039

§ 371 (c)(1),
(2), (4) Date: Jun. 18, 2004

(87) PCT Pub. No.: WO2004/022858

PCT Pub. Date: Mar. 18, 2004

(65) Prior Publication Data

US 2005/0175485 A1 Aug. 11, 2005

(30) Foreign Application Priority Data

Sep. 5, 2002 (JP) ..... 2002-259582
Aug. 21, 2003 (JP) ..... 2003-297583

(51) Int. Cl.
*E02F 9/00* (2006.01)
*E02F 9/20* (2006.01)
*F15B 11/00* (2006.01)

(52) U.S. Cl. ..... 60/421; 60/484; 60/486

(58) Field of Classification Search ..... 60/421, 60/484, 486
See application file for complete search history.

(56) References Cited

U.S. PATENT DOCUMENTS 4,476,679 A * 10/1984 Sato ..... 60/484
4,531,366 A * 7/1985 Moriya et al. ..... 60/421
5,471,837 A * 12/1995 Bianchetta ..... 60/486
6,244,048 B1 * 6/2001 Tanaka et al. ..... 60/421

FOREIGN PATENT DOCUMENTS

JP 9-328784 12/1997
JP 2002-106503 4/2002
JP 3296355 4/2002
JP 2002106503 A * 4/2002

* cited by examiner

*Primary Examiner*—Thomas E Lazo
(74) *Attorney, Agent, or Firm*—Mattingly, Stanger, Malur & Brundidge, P.C.

(57) ABSTRACT

A hydraulic drive system comprises directional flow control valves (10*a-f*) for selectively supplying a hydraulic fluid from a first hydraulic pump (1*a*, 1*b*), inflow control valves (201-203) disposed respectively in branch lines (150A-C) branched from a supply line (100) for supplying a hydraulic fluid delivered from a second hydraulic pump (3*a*, 3*b*) to rod pushing-side chambers (5*a*A, 5*b*A, 6A, 7A) of hydraulic cylinders, a bypass flow control valve (204) disposed in a line (104) connecting the supply line (100) and a reservoir (2), and a controller (31) for computing control variables corresponding to operation command signals from control levers (32, 33) and controlling the inflow control valves (201-203) and the bypass flow control valve (204) in accordance with the computed control variables. Thus, the number of flow control valves and the length of piping required for their connection can be reduced, and a total pressure loss can be further reduced.

26 Claims, 15 Drawing Sheets

FRONT DEVICE 14 SIDE
MACHINE BODY 13 SIDE
OUTPUT TO EACH CONTROL VALVE AND EACH OTHER FLOW CONTROL VALVE
CONTROL-LER
31'
X
10
10a
10b
10c
10g
10f
10e
10d
10h
1a
1b
2
3a
3b
4a
4b
32
33
34
5a
5aA
5aB
5b
5bA
5bB
115
116
117
6
6A
6B
7
7A
7B
8
8A
8B
118
108
106
107
105
150A
150B
150C
151A
151B
151C
F1
F2
F3
201
201A
201B
202
202A
202B
203
203A
203B
204
204A
204B
205
211
211A
211B
212
212A
212B
213
213A
213B
100
101
102
103
104
152A
152B
152C
D1
D2
E1
E2
190

HYDRAULIC DRIVING SYSTEM OF CONSTRUCTION MACHINERY

TECHNICAL FIELD

The present invention relates to a hydraulic drive system for a construction machine such as a hydraulic excavator, and more particularly to a hydraulic drive system for a construction machine, which is suitably used in the so-called super-large-sized hydraulic excavator.

BACKGROUND ART

As disclosed in FIG. 9 of JP,A 9-328784, for example, there is conventionally known a hydraulic drive system for a construction machine, which is applied to a construction machine such as a super-large-sized hydraulic excavator of a class having its own weight of 70 tons or more, in particular, the so-called backhoe type hydraulic excavator including a swing body swingably mounted on a lower travel structure and a multi-articulated front operating mechanism comprising a boom rotatably coupled to the swing body, an arm rotatably coupled to the boom, and a bucket rotatably coupled to the arm to be open rearward in a ground contact state.

Such a hydraulic drive system comprises two hydraulic pumps driven by a first prime mover; two hydraulic pumps driven by a second prime mover; a boom hydraulic cylinder, an arm hydraulic cylinder and a bucket hydraulic cylinder supplied with hydraulic fluids delivered from the four hydraulic pumps for driving the boom, the arm and the bucket, respectively; a first group of directional flow control valves including a boom directional flow control valve, an arm directional flow control valve and a bucket directional flow control valve for controlling respective flows of the hydraulic fluids supplied from two of the four hydraulic pumps to the boom hydraulic cylinder, the arm hydraulic cylinder and the bucket hydraulic cylinder; and a second group of directional flow control valves including a boom directional flow control valve, an arm directional flow control valve and a bucket directional flow control valve for controlling respective flows of the hydraulic fluids supplied from the other two of the four hydraulic pumps to the boom hydraulic cylinder, the arm hydraulic cylinder and the bucket hydraulic cylinder. Then, by joining the hydraulic fluids from both the first group of directional flow control valves and the second group of directional flow control valves together for each pair of the boom directional flow control valves, the arm directional flow control valves and the bucket directional flow control valve, and thereafter supplying the joined hydraulic fluids respectively to the boom hydraulic cylinder, the arm hydraulic cylinder and the bucket hydraulic cylinder (i.e., by supplying hydraulic fluids usually used in two systems covering from hydraulic excavator pumps to directional flow control valves in a joined manner), the hydraulic fluid can be supplied to each hydraulic cylinder at a large flow rate required for the operation of the super-large-sized machine.

To supply the hydraulic fluid under a very high pressure at a very large flow rate, main lines must be constructed of hoses, steel pipes or the likes having very large diameters. However, because hoses practically available from the market at present have a maximum diameter of about 2 inches, several (e.g., two or three) hoses must be laid side by side in practice to meet the requirement. Accordingly, an allowable capacity as the main lines is restricted as compared with the supply and drain flow rate required for a hydraulic actuator, and a relatively large pressure loss occurs in each of hoses constituting the main lines. Hence, a very large pressure loss is eventually generated in the whole of a hydraulic circuit of the super-large-sized machine having long lines formed of hoses, steel piles or the likes, flow control selector valves, etc. The pressure loss increases an energy loss and causes another problem that the operating speed of the hydraulic actuator reduces and the working efficiency deteriorates.

To cope with the problems mentioned above, as disclosed in FIGS. 1 and 2 of the above-cited JP,A 9-328784, for example, a hydraulic drive system for a construction machine is also already proposed in which the number of hoses and a total length of lines formed of steel pipes, etc. in a super-large-sized machine are cut to reduce a total pressure loss.

That prior-art drive system comprises two hydraulic pumps driven by a first prime mover; two hydraulic pumps driven by a second prime mover; a boom hydraulic cylinder, an arm hydraulic cylinder and a bucket hydraulic cylinder supplied with hydraulic fluids delivered from the four hydraulic pumps for driving the boom, the arm and the bucket, respectively; a boom directional flow control valve, an arm directional flow control valve and a bucket directional flow control valve for controlling respective flows of the hydraulic fluids supplied from two of the four hydraulic pumps to the boom hydraulic cylinder, the arm hydraulic cylinder and the bucket hydraulic cylinder; a pair of boom bottom-side inflow control valve and boom rod-side inflow control valve, a pair of arm bottom-side inflow control valve and arm rod-side inflow control valve, and a pair of bucket bottom-side inflow control valve and bucket rod-side inflow control valve for controlling respective flows of the hydraulic fluids supplied from the other two of the four hydraulic pumps to rod pushing-side chambers and rod drawing-side chambers of the boom hydraulic cylinder, the arm hydraulic cylinder and the bucket hydraulic cylinder without passing the boom directional flow control valve, the arm directional flow control valve and the bucket directional flow control valve; and a pair of boom rod-side outflow control valve and boom bottom-side outflow control valve, a pair of arm rod-side outflow control valve and arm bottom-side outflow control valve, and a pair of bucket rod-side outflow control valve and bucket bottom-side outflow control valve for controlling respective flows of the hydraulic fluids drained to a reservoir from the rod drawing-side chambers and the rod pushing-side chambers of the boom hydraulic cylinder, the arm hydraulic cylinder and the bucket hydraulic cylinder without passing the boom directional flow control valve, the arm directional flow control valve and the bucket directional flow control valve.

Then, for example, when performing boom-raising, arm-crowing and bucket-crowing operations, the hydraulic fluids are supplied from the first-mentioned two hydraulic pumps to the respective rod pushing-side chambers of the boom hydraulic cylinder, the arm hydraulic cylinder and the bucket hydraulic cylinder through the boom directional flow control valve, the arm directional flow control valve and the bucket directional flow control valve, and the hydraulic fluids from the other two hydraulic pumps are joined with the flows of the hydraulic fluids, which are supplied after having passed the respective directional flow control valves, through a separately provided common high-pressure line and then through the boom bottom-side inflow control valve, the arm bottom-side inflow control valve and the bucket bottom-side inflow control valve, which are disposed in respective lines branched from it, without passing the boom directional flow control valve, the arm directional flow control valve and the bucket directional flow control valve. The joined hydraulic fluids are supplied to the respective rod pushing-side chambers of the boom hydraulic cylinder, the arm hydraulic cylinder and the bucket hydraulic cylinder.

Also, when performing boom-lowering, arm-dumping and bucket-dumping operations, the hydraulic fluids are supplied from the first-mentioned two hydraulic pumps to the respective rod drawing-side chambers of the boom hydraulic cylinder, the arm hydraulic cylinder and the bucket hydraulic cylinder through the boom directional flow control valve, the arm directional flow control valve and the bucket directional flow control valve, and the hydraulic fluids from the other two hydraulic pumps are joined from the common high-pressure line with the flows of the hydraulic fluids, which are supplied after having passed the respective directional flow control valves, through the boom rod-side inflow control valve, the arm rod-side inflow control valve, and the bucket rod-side inflow control valve without passing the boom directional flow control valve, the arm directional flow control valve, and the bucket directional flow control valve. The joined hydraulic fluids are supplied to the respective rod drawing-side chambers of the boom hydraulic cylinder, the arm hydraulic cylinder and the bucket hydraulic cylinder.

Thus, by providing not only ordinary hydraulic fluid supply routes extending from the first-mentioned hydraulic pumps through the directional flow control valves, but also hydraulic fluid supply routes extending from the other two hydraulic pumps through the common high-pressure line without passing the directional flow control valves, the hydraulic fluid can be supplied to each hydraulic cylinder at a large flow rate required for the operation of the super-large-sized machine. Further, the number of hoses and the total length of lines formed of steel pipes, etc. in the super-large-sized machine can be cut and the total pressure loss can be reduced.

DISCLOSURE OF THE INVENTION

However, the above-described prior art still has room for improvements given below.

In general, a hydraulic cylinder has a large volume difference (e.g., about 2:1) between a rod pushing-side chamber and a rod drawing-side chamber thereof. Accordingly, when constructing an actual super-large-sized hydraulic excavator, components to be essentially added for supply of the hydraulic fluid at the above-described large flow rate are only six in total, i.e., the boom bottom-side inflow control valve, the arm bottom-side inflow control valve and the bucket bottom-side inflow control valve for supplying the hydraulic fluid to the respective pushing-side chambers, and the boom bottom-side outflow control valve, the arm bottom-side outflow control valve and the bucket bottom-side outflow control valve for draining the return hydraulic fluid from the respective rod pushing-side chambers. The six flow control valves connected to the respective rod drawing-side chambers are not always required from the practical point of view. If those six flow control valves connected to the respective rod drawing-side chambers can be omitted, it should be possible to reduce the pressure loss caused by those six directional flow control valves themselves. Also, it should be possible to omit piping associated with those directional flow control valves and hence cut the pressure loss otherwise caused by such piping, and to realize a further reduction of the total pressure loss. In addition, a reduction in the number of hydraulic units, such as the directional flow control valves, could simplify layouts including routing of various pipes and arrangements of various units, particularly layouts of hydraulic piping between the hydraulic pumps as hydraulic sources and actuators receiving the hydraulic fluids from the hydraulic sources.

In other words, such a point is not taken into account in the above-described prior art and room for improvements still remains from that meaning.

An object of the present invention is to provide a hydraulic drive system for a construction machine, which can further reduce the number of directional flow control valves and the length of piping for connection, thereby realizing a further reduction of pressure loss as a whole, and which can simplify layouts of hydraulic piping between hydraulic sources and actuators receiving hydraulic fluids from the hydraulic sources with the reduced number of directional flow control valves.

To achieve the above object, the present invention provides a hydraulic drive system for a construction machine, which drives and controls a plurality of hydraulic cylinders in the construction machine, the hydraulic drive system comprising a first hydraulic pump and a second hydraulic pump driven by prime movers; directional flow control valves for selectively supplying a hydraulic fluid from the first hydraulic pump to rod pushing-side chambers and rod drawing-side chambers of the plurality of hydraulic cylinders; inflow control valves disposed respectively in branch lines branched from one common line for supplying a hydraulic fluid delivered from the second hydraulic pump to the rod pushing-side chambers of the hydraulic cylinders; a bypass flow control valve disposed in a line connecting the common line and a reservoir; input means for inputting operation command signals; and control means for computing control variables corresponding to the operation command signals from the input means and controlling the inflow control valves and the bypass flow control valve in accordance with the computed control variables.

In the present invention, when forming hydraulic fluid supply routes not passing the directional flow control valves to supply the hydraulic fluid at a large flow rate to be adapted for a super-large-sized machine, the hydraulic fluid from the second hydraulic pump is supplied from one common high-pressure line to the rod pushing-side chamber of each corresponding hydraulic cylinder via the respective branch lines. Supply flow rates at this time are controlled by the control means controlling the inflow control valves disposed in the respective branch lines and the bypass flow control valve disposed in the line connecting the common line and the reservoir in accordance with the control variables corresponding to the operation command signals from the input means.

With those features, when supplying the hydraulic fluids to the respective rod pushing-side chambers of the hydraulic cylinders to perform, e.g., the boom-raising, arm-crowding and bucket-crowding operations, in addition to the supply of the hydraulic fluid from the first hydraulic pump through the corresponding directional flow control valves (directional flow control valves), the hydraulic fluid from the second hydraulic pump is joined with the hydraulic fluid, which is supplied through the directional flow control valves, through the inflow control valves without passing the directional flow control valves. The joined hydraulic fluids are then supplied to the respective rod pushing-side chambers of the hydraulic cylinders. The return hydraulic fluids in this case are drained to the reservoir only via routes through the directional flow control valves. On the other hand, when supplying the hydraulic fluids to the respective rod drawing-side chambers of the hydraulic cylinders to perform, e.g., the boom-lowering, arm-dumping and bucket-dumping operations, the hydraulic fluid is supplied from the first hydraulic pump to the respective rod drawing-side chambers of the hydraulic cylinders through the directional flow control valves.

Thus, in consideration of the volume difference between the rod pushing-side chamber and the rod drawing-side chamber of each hydraulic cylinder, only the inflow control valves on the bottom side are additionally provided to achieve the supply of the hydraulic fluid at a large flow rate, while rod-side inflow control valves are omitted, whereby the pressure loss caused by the flow control valves can be reduced correspondingly. Also, since piping required for installation of the flow control valves is omitted and hence an accompanying pressure loss is eliminated, a total pressure loss can be further reduced. In addition, with a reduction in the number of the flow control valves, it is possible to simplify layouts including routing of various pipes and arrangements of various units, particularly layouts of hydraulic piping between the hydraulic pumps as hydraulic sources and the actuators.

Also, to achieve the above object, the present invention provides a hydraulic drive system for a construction machine, which drives and controls a plurality of hydraulic cylinders in the construction machine, the hydraulic drive system comprising a first hydraulic pump and a second hydraulic pump driven by prime movers; directional flow control valves for selectively supplying a hydraulic fluid from the first hydraulic pump to rod pushing-side chambers and rod drawing-side chambers of the plurality of hydraulic cylinders; outflow control valves disposed respectively in return fluid joining lines connected to the rod pushing-side chambers of the hydraulic cylinders; input means for inputting operation command signals; and control means for computing control variables corresponding to the operation command signals from the input means and controlling the outflow control valves in accordance with the computed control variables.

In the present invention, when forming hydraulic fluid drain routes not passing the directional flow control valves to drain the hydraulic fluid at a large flow rate to be adapted for a super-large-sized machine, the return fluid joining lines are connected to the respective rod pushing-side chambers of the hydraulic cylinders. Drain flow rates at this time are controlled by the control means controlling the outflow control valves disposed in the respective return fluid joining lines and the bypass flow control valve disposed in the line connecting the common line and the reservoir in accordance with the control variables corresponding to the operation command signals from the input means.

With those features, when supplying the hydraulic fluids to the respective rod drawing-side chambers of the hydraulic cylinders to perform, e.g., the boom-lowering, arm-dumping and bucket-dumping operations, the hydraulic fluid is supplied from the first hydraulic pump to the respective rod drawing-side chambers of the hydraulic cylinders through the corresponding directional flow control valves (directional flow control valves). The return hydraulic fluids are drained to the reservoir as not only flows drained to the reservoir from the respective rod pushing-side chambers of the hydraulic cylinders through the directional flow control valves, but also flows branched from the above flows and drained to the reservoir through the outflow control valves and the return fluid joining lines without passing the directional flow control valves. On the other hand, when supplying the hydraulic fluids to the respective rod pushing-side chambers of the hydraulic cylinders to perform, e.g., the boom-raising, arm-crowding and bucket-crowding operations, the return hydraulic fluids from the respective rod drawing-side chambers are drained to the reservoir only via routes through the directional flow control valves.

Thus, in consideration of the volume difference between the rod pushing-side chamber and the rod drawing-side chamber of each hydraulic cylinder, only the outflow control valves on the bottom side are additionally provided to achieve the draining of the hydraulic fluid at a large flow rate, while rod-side outflow control valves are omitted, whereby the pressure loss caused by the flow control valves can be reduced correspondingly. Also, since piping required for installation of the flow control valves is omitted and hence an accompanying pressure loss is eliminated, a total pressure loss can be further reduced. In addition, with a reduction in the number of the flow control valves, it is possible to simplify layouts including routing of various pipes and arrangements of various units, particularly layouts of hydraulic piping between the hydraulic pumps as hydraulic sources and the actuators.

Further, to achieve the above object, the present invention provides a hydraulic drive system for a construction machine, which drives and controls a plurality of hydraulic cylinders in the construction machine, the hydraulic drive system comprising a first hydraulic pump and a second hydraulic pump driven by prime movers; directional flow control valves for selectively supplying a hydraulic fluid from the first hydraulic pump to rod pushing-side chambers and rod drawing-side chambers of the plurality of hydraulic cylinders; inflow control valves disposed respectively in branch lines branched from one common line for supplying a hydraulic fluid delivered from the second hydraulic pump to the rod pushing-side chambers of the hydraulic cylinders; outflow control valves disposed respectively in return fluid joining lines connected respectively to the branch lines; a bypass flow control valve disposed in a line connecting the common line and a reservoir; input means for inputting operation command signals; and control means for computing control variables corresponding to the operation command signals from the input means and controlling the inflow control valves, the outflow control valves and the bypass flow control valve in accordance with the computed control variables.

Still further, to achieve the above object, the present invention provides a hydraulic drive system for a construction machine comprising a travel body, a swing body swingably mounted onto the travel body, and a multi-articulated front operating mechanism made up of a boom rotatably coupled to the swing body, an arm rotatably coupled to the boom, and a bucket rotatably coupled to the arm, wherein the hydraulic drive system comprises a boom hydraulic cylinder, an arm hydraulic cylinder, and a bucket hydraulic cylinder for driving the boom, the arm, and the bucket, respectively; at least one hydraulic pump mounted on the swing body; a common high-pressure line having one side connected to the delivery side of the at least one hydraulic pump and the other side extended to the side of the front operating mechanism; a boom branch line branched from the common high-pressure line and connected on the side opposite to the branched side to a rod pushing-side chamber of the boom hydraulic cylinder; a boom inflow control valve disposed near a branch position at which the boom branch line is branched from the common high-pressure line, and controlling a flow of a hydraulic fluid supplied from the common high-pressure line to the rod pushing-side chamber of the boom hydraulic cylinder; an arm branch line branched from the common high-pressure line at a position downstream of the branch position of the boom branch line and connected on the side opposite to the branched side to a rod pushing-side chamber of the arm hydraulic cylinder; an arm inflow control valve disposed near a branch position at which the arm branch line is branched from the common high-pressure line, and controlling a flow of a hydraulic fluid supplied from the common high-pressure line to the rod pushing-side chamber of the arm hydraulic cylinder; a bucket branch line branched from the common high-pressure line at a position downstream of the branch position of the boom branch line and connected on the side opposite to the branched side to a rod pushing-side chamber of the bucket hydraulic cylinder; and a bucket inflow control valve disposed near the branch position at which the bucket branch line is branched from the common high-pressure line, and controlling a flow of a hydraulic fluid supplied from the common high-pressure line to the rod pushing-side chamber of the bucket hydraulic cylinder.

In the present invention, when forming hydraulic fluid supply routes not passing the directional flow control valves to supply the hydraulic fluid at a large flow rate to be adapted for a super-large-sized machine, the common high-pressure line connected to the delivery side of at least one hydraulic pump and extended to the side of the front operating mechanism is branched corresponding to an actual arrangement of respective actuators. First, a boom branch line connected to the bottom side of the boom hydraulic cylinder is branched from the common high-pressure line at a position near the boom hydraulic cylinder. Then, an arm branch line connected to the bottom side of the arm hydraulic cylinder is branched from the common high-pressure line at a position downstream of the branch position of the boom branch line. The remaining part of the common high-pressure line is constituted as a bucket branch line connected to the bottom side of the bucket hydraulic cylinder. Furthermore, a boom inflow control valve, an arm inflow control valve, and a bucket inflow control valve are disposed respectively in the boom branch line, the arm branch line, and the bucket branch line to control flows of the hydraulic fluid from the common high-pressure line to the respective hydraulic cylinders.

With those features, when supplying the hydraulic fluids to the respective rod pushing-side chambers of the hydraulic cylinders to perform the boom-raising, arm-crowding and bucket-crowding operations, in addition to the ordinary supply of the hydraulic fluid to the respective rod pushing-side chambers of the hydraulic cylinders through the corresponding directional flow control valves, the hydraulic fluid from at least one hydraulic pump is joined with the hydraulic fluid, which is supplied through the directional flow control valves, through the inflow control valves without passing the directional flow control valves. The joined hydraulic fluids are then supplied to the respective rod pushing-side chambers of the hydraulic cylinders. The return hydraulic fluids in this case are drained to the reservoir only via routes through the directional flow control valves. On the other hand, when supplying the hydraulic fluids to the respective rod drawing-side chambers of the hydraulic cylinders to perform, e.g., the boom-lowering, arm-dumping and bucket-dumping operations, the hydraulic fluid is supplied from the hydraulic pump to the respective rod drawing-side chambers of the hydraulic cylinders through the directional flow control valves.

Thus, in consideration of the volume difference between the rod pushing-side chamber and the rod drawing-side chamber of each hydraulic cylinder, only the inflow control valves on the bottom side are additionally provided to achieve the supply of the hydraulic fluid at a large flow rate, while rod-side inflow control valves are omitted, whereby the pressure loss caused by the flow control valves can be reduced correspondingly. Also, since piping required for installation of the flow control valves is omitted and hence an accompanying pressure loss is eliminated, a total pressure loss can be further reduced. In addition, with a reduction in the number of the flow control valves, it is possible to simplify layouts including routing of various pipes and arrangements of various units, particularly layouts of hydraulic piping between the hydraulic pumps as hydraulic sources and the actuators.

In the above hydraulic drive system for the construction machine, preferably, the inflow control valves are all disposed together in one control valve unit.

Also, in the above hydraulic drive system for the construction machine, preferably, the hydraulic drive system further comprises at least one of three sets comprising a boom return fluid joining line branched from the boom branch line at a position nearer-to the boom hydraulic cylinder than the boom inflow control valve and connected on the side opposite to the branched side to a hydraulic reservoir, and a boom outflow control valve disposed in the boom return fluid joining line near a branch position at which the boom return fluid joining line is branched from the boom branch line and controlling a flow of a hydraulic fluid drained from the boom hydraulic cylinder to the hydraulic reservoir; an arm return fluid joining line branched from the arm branch line at a position nearer to the arm hydraulic cylinder than the arm inflow control valve and connected on the side opposite to the branched side to the hydraulic reservoir, and an arm outflow control valve disposed in the arm return fluid joining line near a branch position at which the arm return fluid joining line is branched from the arm branch line and controlling a flow of a hydraulic fluid drained from the arm hydraulic cylinder to the hydraulic reservoir; and a bucket return fluid joining line branched from the bucket branch line at a position nearer to the bucket hydraulic cylinder than the bucket inflow control valve and connected on the side opposite to the branched side to the hydraulic reservoir, and a bucket outflow control valve disposed in the bucket return fluid joining line near a branch position at which the bucket return fluid joining line is branched from the bucket branch line and controlling a flow of a hydraulic fluid drained from the bucket hydraulic cylinder to the hydraulic reservoir.

With those features, when the hydraulic fluids are supplied to the respective rod drawing-side chambers of the hydraulic cylinders in the boom-lowering, arm-dumping and bucket-dumping operations, a part of the hydraulic fluids returned from the rod drawing-side chambers at large flow rates can be drained to the hydraulic reservoir without passing the directional flow control valves, and hence the smooth operation of the front operating mechanism can be ensured.

In the above hydraulic drive system for the construction machine, more preferably, the inflow control valves and the outflow control valves are all disposed together in one control valve unit.

Further, to achieve the above object, the present invention provides a hydraulic drive system comprising a first hydraulic pump and a second hydraulic pump driven by prime movers; a plurality of hydraulic cylinders driven by hydraulic fluids delivered from the first and second hydraulic pumps; a plurality of directional flow control valves for controlling respective flows of the hydraulic fluid supplied from the first hydraulic pump to the plurality of hydraulic cylinders; at least one inflow control valve for controlling a flow of the hydraulic fluid delivered from the second hydraulic pump and supplied to at least one rod pushing-side chamber among the plurality of hydraulic cylinders without passing the directional flow control valves; a bypass flow control valve for returning the hydraulic fluid delivered from the second hydraulic pump to a reservoir; and a recovery flow control valve for introducing the hydraulic fluid in at least one rod pushing-side chamber among the plurality of hydraulic cylinders to a rod drawing-side chamber thereof.

When supplying the hydraulic fluids to the respective rod pushing-side chambers of the hydraulic cylinders to perform, e.g., the boom-raising, arm-crowding (arm-pushing) and bucket-crowding operations, the hydraulic fluid is supplied from the first hydraulic pump to the respective rod pushing-side chambers of the hydraulic cylinders through the corresponding directional flow control valves (directional flow control valves), and the hydraulic fluid from the second hydraulic pump is additionally joined with the above hydraulic fluid, which is supplied through the directional flow control valves, through the inflow control valves without passing the directional flow control valves. The joined hydraulic fluids are then supplied to the respective rod pushing-side chambers of the hydraulic cylinders. The return hydraulic fluids in this case are drained to the reservoir only via routes through the directional flow control valves.

On the other hand, when supplying the hydraulic fluids to the respective rod drawing-side chambers of the hydraulic cylinders to perform, e.g., the boom-lowering, arm-dumping (arm-drawing) and bucket-dumping operations, the hydraulic fluid is supplied from the first hydraulic pump to the respective rod drawing-side chambers of the hydraulic cylinders through the directional flow control valves.

Thus, in consideration of the volume difference between the rod pushing-side chamber and the rod drawing-side chamber of each hydraulic cylinder, only the inflow control valves associated with the rod pushing-side chambers are additionally provided to achieve the supply of the hydraulic fluid at a large flow rate, while inflow control valves associated with the rod drawing-side chambers are omitted, whereby the pressure loss caused by the flow control valves can be reduced correspondingly. Also, since piping required for installation of the flow control valves is omitted and hence an accompanying pressure loss is eliminated, a total pressure loss can be further reduced. In addition, with a reduction in the number of the flow control valves, it is possible to simplify layouts including routing of various pipes and arrangements of various units, particularly layouts of hydraulic piping between the hydraulic pumps as hydraulic sources and the actuators.

Further, because of the recovery flow control valve being provided in association with at least one hydraulic cylinder, when the hydraulic fluids are supplied to the respective rod drawing-side chambers of the hydraulic cylinders to perform, e.g., the boom-lowering, arm-dumping and bucket-dumping operations, the hydraulic fluid returned from the rod pushing-side chamber of the corresponding hydraulic cylinder is partly drained to the reservoir via a route through the corresponding directional flow control. In parallel, the remaining return hydraulic fluid is introduced to the corresponding rod drawing-side chamber through the recovery flow control valve and is effectively utilized, as the so-called recovery flow, for the operation of contracting the hydraulic cylinder. Regarding at least one hydraulic cylinder, therefore, the return hydraulic fluid from the rod pushing-side chamber can be effectively utilized as the recovery flow, which enables omission of an outflow control valve having a large capacity associated with the rod pushing-side chamber and an associated outflow line adapted for a large flow rate. As a result, it is possible to further reduce the pressure loss for a reduction of the total pressure loss, and to further reduce the number of the flow control valves for more simplification of the layouts of hydraulic piping.

Still further, to achieve the above object, the present invention provides a hydraulic drive system for a construction machine comprising a travel body, a swing body swingably mounted onto the travel body, and a multi-articulated front operating mechanism coupled to the swing body in a vertically angularly movable manner and made up of a boom, an arm and a bucket, wherein the hydraulic drive system comprises a first hydraulic pump and a second hydraulic pump driven by prime movers; a plurality of hydraulic cylinders including a boom hydraulic cylinder, an arm hydraulic cylinder and a bucket hydraulic cylinder supplied with hydraulic fluids delivered from the first and second hydraulic pumps to drive the boom, the arm, and the bucket, respectively; a plurality of directional flow control valves for controlling respective flows of the hydraulic fluid supplied from the first hydraulic pump to the plurality of hydraulic cylinders; at least one inflow control valve for controlling a flow of the hydraulic fluid delivered from the second hydraulic pump and supplied to a rod pushing-side chamber of at least the boom hydraulic cylinder among the plurality of hydraulic cylinders without passing the directional flow control valves; a bypass flow control valve for returning the hydraulic fluid delivered from the second hydraulic pump to a reservoir; and at least one recovery flow control valve for introducing the hydraulic fluid in the rod pushing-side chamber of at least the boom hydraulic cylinder among the plurality of hydraulic cylinders to a rod drawing-side chamber thereof.

Still further, to achieve the above object, the present invention provides a hydraulic drive system for a construction machine comprising a travel body, a swing body swingably mounted onto the travel body, and a multi-articulated front operating mechanism made up of a boom rotatably coupled to the swing body, an arm rotatably coupled to the boom, and a bucket rotatably coupled to the arm to be open forward in a ground contact state, wherein the hydraulic drive system comprises at least one first hydraulic pump and at least one second hydraulic pump driven by a plurality of prime movers; a plurality of hydraulic cylinders including a boom hydraulic cylinder, an arm hydraulic cylinder and a bucket hydraulic cylinder supplied with hydraulic fluids delivered from the first and second hydraulic pump to drive the boom, the arm and the bucket, respectively, and an opening/closing hydraulic cylinder supplied with the hydraulic fluids to open and close the bucket; a plurality of directional flow control valves for controlling respective flows of the hydraulic fluid supplied from the first hydraulic pump to the plurality of hydraulic cylinders; at least two inflow control valve for controlling respective flows of the hydraulic fluid delivered from the second hydraulic pump and supplied to rod pushing-side chambers of at least the boom hydraulic cylinder and the bucket hydraulic cylinder among the plurality of hydraulic cylinders without passing the directional flow control valves; a bypass flow control valve for returning the hydraulic fluid delivered from the second hydraulic pump to a reservoir; and at least two recovery flow control valve for introducing the hydraulic fluids in the rod pushing-side chambers of at least the boom hydraulic cylinder and the arm hydraulic cylinder among the plurality of hydraulic cylinders to rod drawing-side chambers thereof.

Still further, to achieve the above object, the present invention provides a hydraulic drive system for a construction machine comprising a travel body, a swing body swingably mounted onto the travel body, and a multi-articulated front operating mechanism made up of a boom rotatably coupled to the swing body, an arm rotatably coupled to the boom, and a bucket rotatably coupled to the arm to be open rearward in a ground contact state, wherein the hydraulic drive system comprises at least one first hydraulic pump and at least one second hydraulic pump driven by a plurality of prime movers; a plurality of hydraulic cylinders including a boom hydraulic cylinder, an arm hydraulic cylinder and a bucket hydraulic cylinder supplied with hydraulic fluids delivered from the first hydraulic pump and the second hydraulic pump to drive the boom, the arm and the bucket, respectively; a plurality of directional flow control valves for controlling respective flows of the hydraulic fluid supplied from the first hydraulic pump to the plurality of hydraulic cylinders; a plurality of inflow control valve for controlling respective flows of the hydraulic fluid delivered from the second hydraulic pump and supplied to rod pushing-side chambers of the boom hydraulic cylinders, the arm hydraulic cylinder and the bucket hydraulic cylinder without passing the directional flow control valves; a bypass flow control valve for returning the hydraulic fluid delivered from the second hydraulic pump to a reservoir; and at least one recovery flow control valve for introducing the hydraulic fluid in the rod pushing-side chamber of at least the boom hydraulic cylinder among the plurality of hydraulic cylinders to a rod drawing-side chamber thereof.

Still further, to achieve the above object, the present invention provides a hydraulic drive system for a construction machine comprising a travel body, a swing body swingably mounted onto the travel body, and a multi-articulated front operating mechanism made up of a boom rotatably coupled to the swing body, an arm rotatably coupled to the boom, and a bucket rotatably coupled to the arm to be open forward in a ground contact state, wherein the hydraulic drive system comprises six first hydraulic pumps and two second hydraulic pumps driven by a plurality of prime movers; a boom hydraulic cylinder, an arm hydraulic cylinder and a bucket hydraulic cylinder supplied with hydraulic fluids delivered from the first hydraulic pump and the second hydraulic pump to drive the boom, the arm and the bucket, respectively, and an opening/closing hydraulic cylinder supplied with the hydraulic fluids to open and close the bucket; a plurality of boom directional flow control valves, a plurality of arm directional flow control valves, a plurality of bucket directional flow control valves, and a plurality of opening/closing directional flow control valves for controlling respective flows of the hydraulic fluids supplied from the six first hydraulic pumps to the boom hydraulic cylinder, the arm hydraulic cylinder, the bucket hydraulic cylinder, and the opening/closing hydraulic cylinder; a boom-raising inflow control valve, a bucket-crowding inflow control valve and a bucket-dumping inflow control valve for controlling respective flows of the hydraulic fluids delivered from the two second hydraulic pumps and supplied to a rod pushing-side chamber of the boom hydraulic cylinder, a rod pushing-side chamber of the bucket hydraulic cylinder, and a rod drawing-side chamber of the bucket hydraulic cylinder without passing the plurality of boom directional flow control valves and the plurality of bucket directional flow control valves; a bypass flow control valve for returning the hydraulic fluids delivered from the two second hydraulic pumps to a reservoir; a boom recovery flow control valve and an arm recovery flow control valve for introducing the hydraulic fluids in the respective rod pushing-side chambers of the boom hydraulic cylinder and the arm hydraulic cylinder to rod drawing-side chambers thereof; and an opening/closing recovery flow control valve for introducing the hydraulic fluid in a rod drawing-side chamber of the opening/closing hydraulic cylinder to a rod pushing-side chamber thereof.

In the above hydraulic drive system for the construction machine, preferably, the inflow control valves are all disposed together in one control valve unit.

In the above hydraulic drive system for the construction machine, more preferably, the one control valve unit is disposed on the boom.

Also, in the above hydraulic drive system for the construction machine, preferably, check valves are disposed respectively in branch lines for supplying the hydraulic fluid to the rod pushing-side chambers of the hydraulic cylinders.

Further, in the above hydraulic drive system for the construction machine, preferably, at least one of the inflow control valves, the outflow control valves, and the bypass flow control valves is constituted as a seat valve.

In the above hydraulic drive system for the construction machine, more preferably, the seat valve is arranged such that an axis thereof lies substantially in the horizontal direction.

With that feature, in operation, the front operating mechanism rotates in the direction perpendicular to the axis of the seat valve. Therefore, the rotating operation of the front operating mechanism is avoided from adversely affecting the opening/closing operation of the seat valve, and smooth and reliable valve opening/closing operation can be ensured.

BEST MODE FOR CARRYING OUT THE INVENTION

Embodiments of the present invention will be described below with reference to the drawings.

A first embodiment of the present invention will be described with reference to FIGS. 1 to 3. This embodiment represents the case in which the present invention is applied to the so-called super-large-sized backhoe type hydraulic excavator of a class having its own weight of 70 tons, for example.

Figure 1:
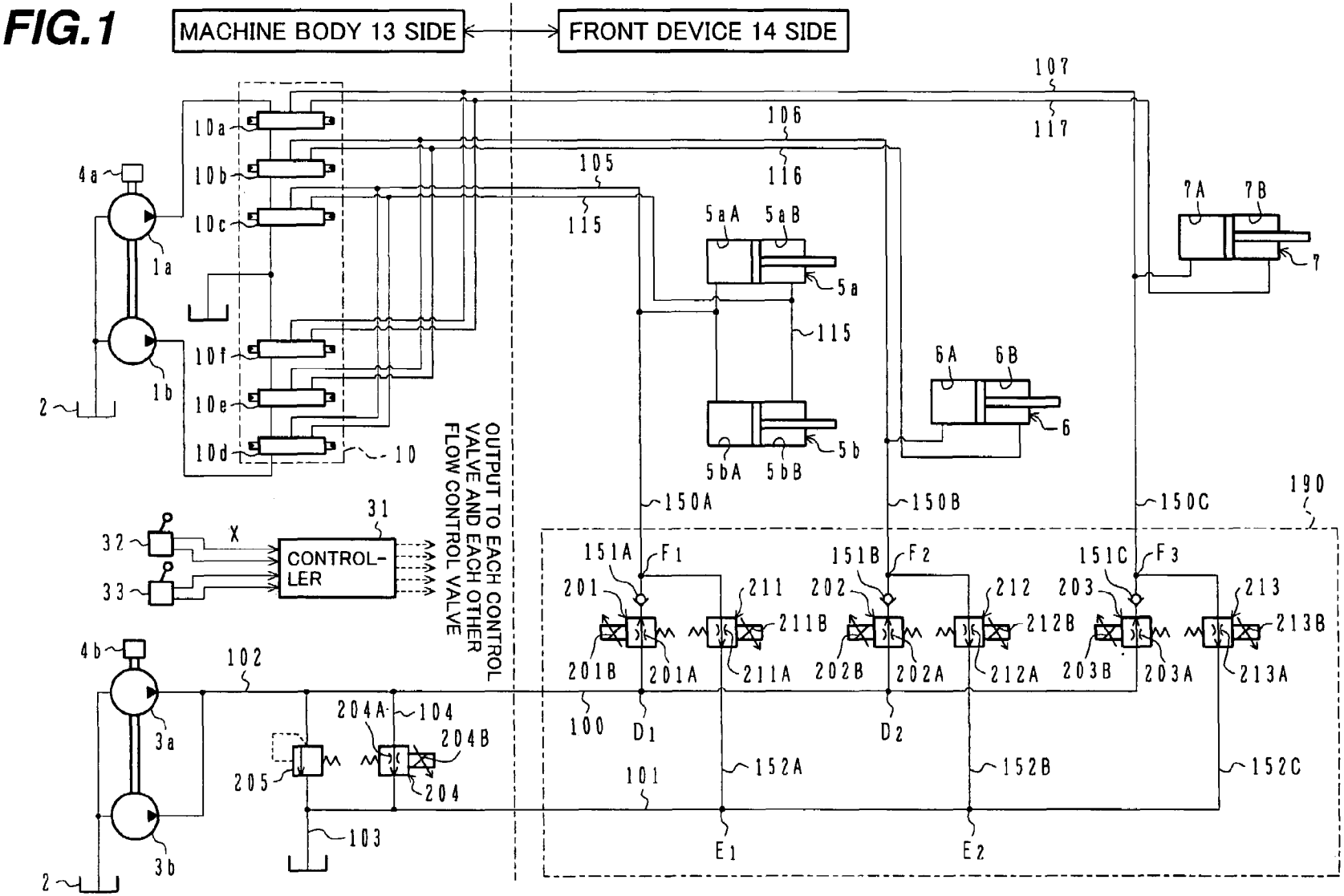
FIG. 1 is a hydraulic circuit diagram showing the overall construction of a hydraulic drive system according to a first embodiment of the present invention along with a control system for it.

FIG. 1 is a hydraulic circuit diagram showing the overall construction of a hydraulic drive system according to this embodiment along with a control system for it. Referring to FIG. 1, the hydraulic drive system of this embodiment comprises hydraulic pumps 1*a*, 1*b* driven by an engine (prime mover) 4*a*, hydraulic pumps 3*a*, 3*b* driven by an engine 4*b* (allocation of the hydraulic pumps 1*a*, 1*b*, 3*a* and 3*b* with respect to the engines 4*a*, 4*b* is not limited to the above-described one, and may be set as appropriate in consideration of horsepower distribution, etc.), boom hydraulic cylinders 5*a*, 5*b*, an arm hydraulic cylinder 6 and a bucket hydraulic cylinder 7 which are supplied with hydraulic fluids delivered from the hydraulic pumps 1*a*, 1*b*, 3*a* and 3*b*, and a hydraulic reservoir 2.

The hydraulic pump 1*a* is connected to the boom hydraulic cylinders 5*a*, 5*b*, the arm hydraulic cylinder 6 and the bucket hydraulic cylinder 7 through a first boom directional flow control valve (control valve) 10*c*, a first arm directional flow control valve 10*b*, and a first bucket directional flow control valve 10*a*, respectively. The hydraulic pump 1*b* is connected to the boom hydraulic cylinders 5*a*, 5*b*, the arm hydraulic cylinder 6 and the bucket hydraulic cylinder 7 through a second boom directional flow control valve 10*d*, a second arm directional flow control valve 10*e*, and a second bucket directional flow control valve 10*f*, respectively. These directional flow control valves 10*a* to 10*f* constitute a directional flow control valve group 10.

Rod pushing-side chambers (bottom-side hydraulic chambers) 5*a*A, 5*b*A of the boom hydraulic cylinders 5*a*, 5*b* are connected to the first and second boom directional flow control valves 10*c*, 10*d* via a main line 105, and rod drawing-side chambers (rod-side hydraulic chambers) 5*a*B, 5*b*B of the boom hydraulic cylinders 5*a*, 5*b* are connected to the first and second boom directional flow control valves 10*c*, 10*d* via a main line 115. Also, a rod pushing-side chamber 6A of the arm hydraulic cylinder 6 is connected to the first and second arm directional flow control valves 10*b*, 10*e* via a main line 106, and a rod drawing-side chamber 6B of the arm hydraulic cylinder 6 is connected to the first and second arm directional flow control valves 10*b*, 10*e* via a main line 116. Further, a rod pushing-side chamber 7A of the bucket hydraulic cylinder 7 is connected to the first and second bucket directional flow control valves 10*a*, 10*f* via a main line 107, and a rod drawing-side chamber 7B of the bucket hydraulic cylinder 7 is connected to the first and second bucket directional flow control valves 10*a*, 10*f* via a main line 117.

On the other hand, the hydraulic pumps 3*a*, 3*b* are connected to the main lines 105, 106 and 107 via a delivery line 102 to which the hydraulic fluids delivered from the hydraulic pumps 3*a*, 3*b* are introduced, then via a supply line 100 serving as a common high-pressure line which is connected at one side (left side as viewed in the drawing) thereof to the delivery line 102 and is extended to the side of a front operating mechanism 14 (described later), and then via branch lines 150A, 150B and 150C branched from the other side of the supply line 100.

Of the branch lines 150A, 150B and 150C, the branch line 150A serving as a boom branch line is branched from the supply line 100 at a most upstream position (among respective branched positions of the branch lines 150A, 150B and 150C). Also, the branch line 150B serving as an arm branch line is branched from the supply line 100 at a position downstream of the position at which the boom branch line 150A is branched. Hence, the remaining branch line 150C serving as a bucket branch line is also branched from the supply line 100 at a position downstream of the position at which the boom branch line 150A is branched.

In the branch lines 150A, 150B and 150C, there are disposed respectively a boom inflow control valve 201, an arm inflow control valve 202, and a bucket inflow control valve 203 which are each constituted as, e.g., a solenoid proportional valve with a pressure compensating function and include respectively variable throttles 201A, 202A and 203A for controlling the flows of the hydraulic fluids supplied from the hydraulic pumps 3*a*, 3*b* to the rod pushing-side chambers 5*a*A, 5*b*A of the boom hydraulic cylinders, the rod pushing-side chamber 6A of the arm hydraulic cylinder, and the rod pushing-side chamber 7A of the bucket hydraulic cylinder to desired throttled flow rates. In this respect, the boom inflow control valve 201 is disposed near a branch position D1 at which the branch line 150A is branched from the supply line 100, and the arm inflow control valve 202 and the bucket inflow control valve 203 are disposed near a branch position D2 at which the branch lines 150B, 150C are branched from the supply line 100.

Then, on the sides of the inflow control valve 201, 202 and 203 nearer to the hydraulic cylinders 5*a*, 5*b*, 6 and 7, check valves 151A, 151B and 151C are disposed respectively which allow the hydraulic fluids to flow from the hydraulic pumps 3*a*, 3*b* to the rod pushing-side chambers 5*a*A, 5*b*A of the boom hydraulic cylinders, the rod pushing-side chamber 6A of the arm hydraulic cylinder, and the rod pushing-side chamber 7A of the bucket hydraulic cylinder, but block off the hydraulic fluids flowing in the reversed direction.

Further, the hydraulic reservoir 2 is connected to respective branch positions in the branch lines 150A, 150B and 150C, which are located nearer to the boom hydraulic cylinders 5*a*, 5*b*, the arm hydraulic cylinder 6, and the bucket hydraulic cylinder 7 than the inflow control valve 201, 202 and 203 and the check valves 151A, 151B and 151C, via a reservoir line 103 for introducing the return hydraulic fluid to the hydraulic reservoir 2, then via a low-pressure drain line (return fluid joining line) 101 connected at one side (left side as viewed in the drawing) thereof to the reservoir line 103, and then via a branch line 152A (boom return fluid joining line), a branch line 152B (arm return fluid joining line), and a branch line 152C (bucket return fluid joining line) which are connected to respective branch positions on the other side of the drain line 101 (alternatively the hydraulic reservoir 2 may be directly connected to the main lines 106, 107).

In the branch lines 152A, 152B and 152C, there are disposed respectively a boom outflow control valve 211, an arm outflow control valve 212, and a bucket outflow control valve 213, which are each constituted as, e.g., a solenoid proportional valve and include respectively variable throttles 211A, 212A and 213A for controlling the flows of the hydraulic fluids drained to the hydraulic reservoir 2 from the rod pushing-side chambers 5*a*A, 5*b*A of the boom hydraulic cylinders, the rod pushing-side chamber 6A of the arm hydraulic cylinder, and the rod pushing-side chamber 7A of the bucket hydraulic cylinder to desired throttled flow rates.

In this respect, the boom outflow control valve 211 is disposed near a branch position E1 at which the branch line 152A is branched from the drain line 101 (also near a branch position F1 at which the branch line 152A is connected to the branch line 150A). The arm outflow control valve 212 is disposed near a branch position E2 at which the branch line 152B is branched from the drain line 101 (also near a branch position F2 at which the branch line 152B is connected to the branch line 150B). The bucket outflow control valve 213 is disposed near the branch position E2 at which the branch line 152C is branched from the drain line 101 (also near a branch position F3 at which the branch line 152C is connected to the branch line 150C).

The thus-arranged three inflow control valves 201, 202 and 203, three check valves 151A, 151B and 151C, and three outflow control valves 211, 212 and 213 are disposed together in one control valve unit 190 (see FIG. 2 described later) which is mounted to an upper surface (back surface) of a boom 75.

Further, a line 104 is branched from the supply line 100 (or the delivery line 102 as required). In this line 104, a bypass flow control valve 204 is disposed which is constituted as, e.g., a solenoid proportional valve with a pressure compensating function and supplies the hydraulic fluids delivered from the hydraulic pumps 3*a*, 3*b* to the supply line 100 through a variable throttle 204A at a desired flow rate while returning the remaining hydraulic fluid to the hydraulic reservoir 2 via the reservoir line 103. Additionally, between the delivery line 102 and the reservoir line 103, a relief valve 205 is disposed to specify a maximum pressure in the supply line 100 serving as a high-pressure line.

Figure 2:
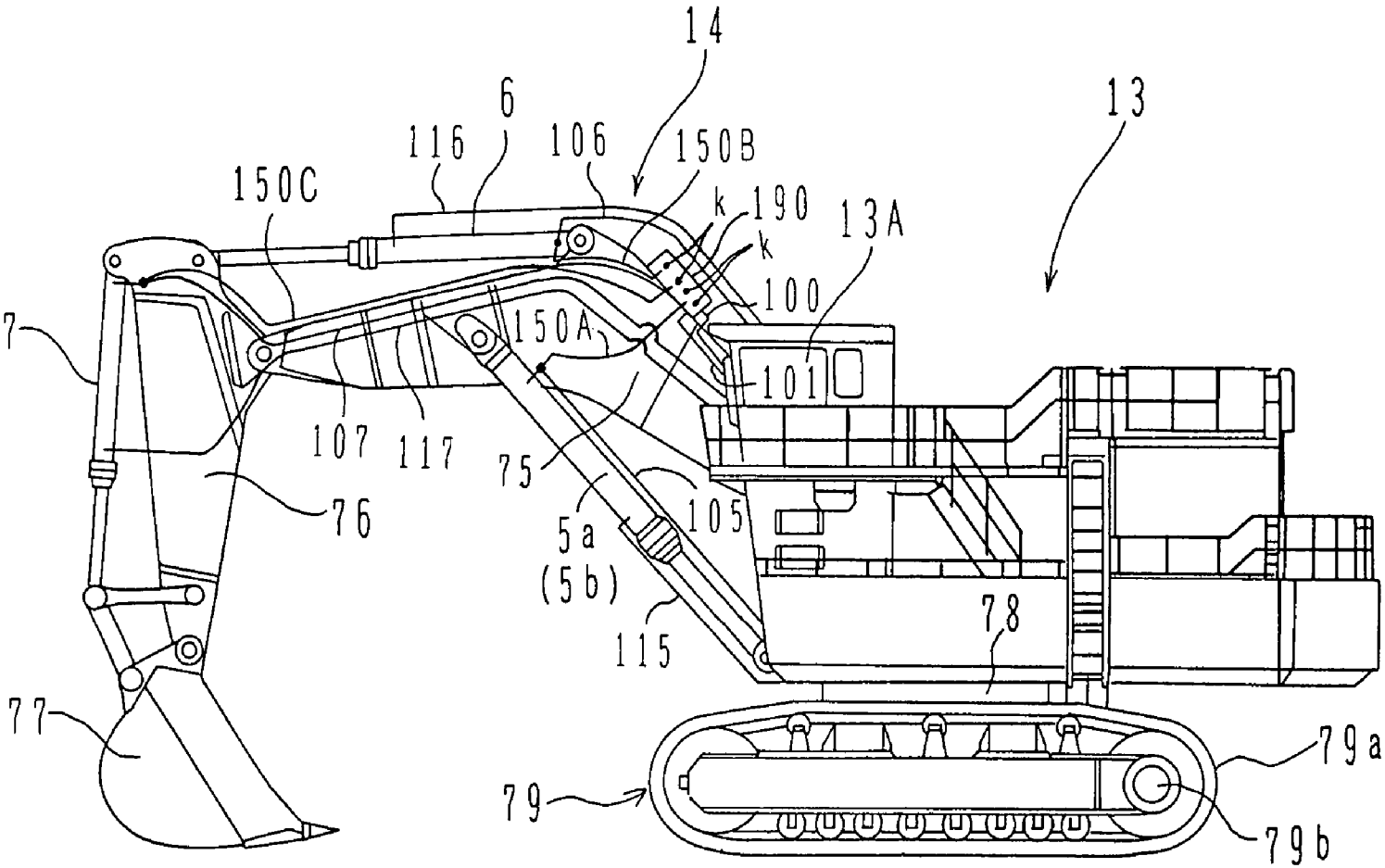
FIG. 2 is a side view showing the overall structure of a hydraulic excavator driven by the hydraulic drive system shown in FIG. 1.

As shown in FIG. 2 described later, the hydraulic pumps 1*a*, 1*b*, 3*a* and 3*b*, the directional flow control valve group 10, the delivery line 102, the reservoir line 103, the line 104, the bypass flow control valve 21, the relief valve 22, etc. are disposed in a machine body 13. The hydraulic cylinders 5*a*, 5*b*, 6 and 7, the supply line 100, the drain line 101, the branch lines 150A-C, 152A-C, the inflow control valves 201 to 203, the check valves 151A-C, and the outflow control valves 211 to 213 are disposed on the front operating mechanism 14 (see FIG. 2 as well).

In the construction shown in FIG. 1, the lines 100, 102, 150A-C, 105-107, 115-117, etc., serving as high-pressure lines, are each formed of, for example, a plurality of hoses (or steel pipes). The other lines 101, 103, 152A-C, etc., serving as low-pressure lines, can be each formed of a single large-diameter hose (or pipe) instead of a plurality of hoses (or steel pipes).

FIG. 2 is a side view showing the overall structure of a hydraulic excavator driven by the hydraulic drive system having the above-described construction. In FIG. 2, the illustrated hydraulic excavator is of the so-called backhoe excavator (backhoe type) comprising a travel device (travel body or lower travel structure) 79, a machine body (swing body or an upper swing structure) 13 swingably mounted onto the travel device 79 through a swing base bearing 78, and a multi-articulated front operating mechanism 14 (comprising a boom 75 rotatably coupled to the machine body 13, an arm 76 rotatably coupled to the boom 75, and a bucket 77 rotatably coupled to the arm 76 to be open rearward in a ground contact state), the front operating mechanism 14 being vertically rotatably coupled to the machine body 13.

The boom hydraulic cylinders 5, the arm hydraulic cylinder 6 and the bucket hydraulic cylinder 7 are mounted, as shown, to the boom 75, the arm 76 and the bucket 77, respectively, to perform operations of boom raising (boom lowering), arm crowding (arm dumping) and bucket crowding (bucket dumping) with extension (contraction) thereof.

The swing body 13 is driven by a swing hydraulic motor (not shown) mounted therein to swing relative to the lower track structure (travel device) 79 through the swing base bearing 78. The travel device 79 is provided with left and right travel hydraulic motors 79*b* for driving respectively left and right crawler belts 79*a*.

Returning to FIG. 1, a controller 31 is provided as a control unit for the hydraulic drive system. The controller 31 receives operation signals outputted from control levers (input means) 32, 33 provided in a cab 13A of the machine body 13, and outputs command signals to the directional flow control valves 10*a-f*, the inflow control valves 201 to 203, the outflow control valves 211 to 213, and the bypass flow control valve 204. The control levers 32, 33 are each movable in two orthogonal directions. For example, the control lever 32 outputs a swing operation signal and an arm operation signal when operated in the respective directions, and the control lever 33 outputs a boom operation signal and a bucket operation signal when operated in the respective directions.

Figure 3:
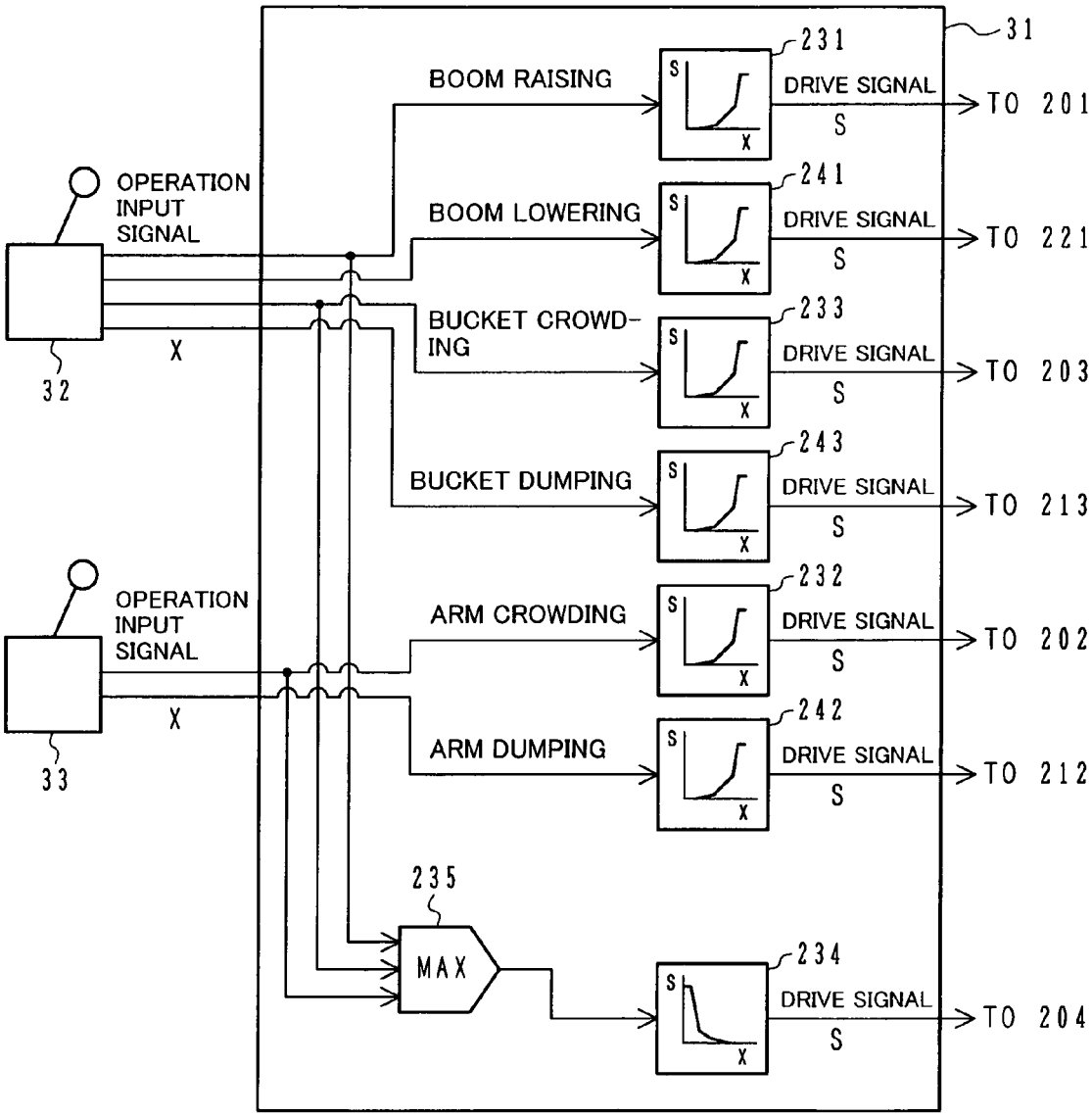
FIG. 3 is a functional block diagram showing, among detailed functions of a controller shown in FIG. 1, control functions for inflow control valves, outflow control valves, and a bypass flow control valve.

FIG. 3 is a functional block diagram showing, among detailed functions of the controller 31, control functions for the inflow control valves 201 to 203, the outflow control valves 211 to 213, and the bypass flow control valve 204, which constitute a principal part of this embodiment, other than general control functions of controlling the directional flow control valves 10*a* to 10*f* in response to the operation signals from the control levers 32, 33. As shown in FIG. 3, the controller 31 comprises a drive signal processing unit 231 for the boom inflow control valve 201, a drive signal processing unit 232 for the arm inflow control valve 202, a drive signal processing unit 233 for the bucket inflow control valve 203, a drive signal processing unit 241 for the boom outflow control valve 211, a drive signal processing unit 242 for the arm outflow control valve 212, a drive signal processing unit 243 for the bucket outflow control valve 213, a drive signal processing unit 234 for the bypass flow control valve 204, and a maximum value selector 235.

The drive signal processing units 231, 232, 233, 241, 242, 243 and 234 receive corresponding operation input signals X from the control levers 32, 33, and compute respective control signals S for the corresponding flow control valves 201, 202, 203, 211, 212, 213 and 204 (i.e., drive signals applied to solenoid sectors 201B, 202B, 203B, 211B, 212B, 213B and 204B), followed by outputting the computed control signals to the corresponding flow control valves. In this respect, each of the drive signal processing units 231, 232, 233, 241, 242, 243 and 234 previously stores, in the form of a table shown in FIG. 3, an operation pattern depending on the operation input signal X from the control lever (i.e., a relationship between the operation input signal X from the control lever and a current value of a solenoid drive signal S for defining an opening area of each valve). In the operation table, a characteristic of the operation input signal X versus the solenoid drive signal S is set depending on characteristics of each corresponding actuator so that an actuator operation characteristic optimum for an operator is obtained with respect to the operation input signal X.

More specifically, the boom-inflow drive signal processing unit 231 receives a boom-raising operation input signal X from the control lever 32, and computes a control signal S for the boom inflow control valve 201 (i.e., a drive signal applied to the solenoid sector 201B) based on the illustrated table, followed by outputting the computed control signal. The arm-inflow drive signal processing unit 232 receives an arm-crowding operation input signal X from the control lever 33, and computes a control signal S for the arm inflow control valve 202 (i.e., a drive signal applied to the solenoid sector 202B) based on the illustrated table, followed by outputting the computed control signal. The bucket-inflow drive signal processing unit 233 receives a bucket-crowding operation input signal X from the control lever 32, and computes a control signal S for the bucket inflow control valve 203 (i.e., a drive signal applied to the solenoid sector 203B) based on the illustrated table, followed by outputting the computed control signal.

At this time, a maximum one of the boom-raising operation input signal X, the arm-crowding operation input signal X, and the bucket-crowding operation input signal X from the control levers 32, 33 is selected by the maximum value selector 235 and then inputted to the bypass drive signal processing unit 234. The bypass drive signal processing unit 234 computes a control signal S for the bypass flow control valve 204 (i.e., a drive signal applied to the solenoid sector 204B) based on the illustrated table, and outputs the computed control signal.

Further, the boom-outflow drive signal processing unit 241 receives a boom-lowering operation input signal X from the control lever 32, and computes a control signal S for the boom outflow control valve 211 (i.e., a drive signal applied to the solenoid sector 211B) based on the illustrated table, followed by outputting the computed control signal. The arm-outflow drive signal processing unit 242 receives an arm-dumping operation input signal X from the control lever 33, and computes a control signal S for the arm outflow control valve 212 (i.e., a drive signal applied to the solenoid sector 212B) based on the illustrated table, followed by outputting the computed control signal. The bucket-outflow drive signal processing unit 243 receives a bucket-dumping operation input signal X from the control lever 32, and computes a control signal S for the bucket outflow control valve 213 (i.e., a drive signal applied to the solenoid sector 213B) based on the illustrated table, followed by outputting the computed control signal.

The operation of this embodiment thus constructed will be described below.

(1) Boom-Raising Operation

When the operator operates the control lever 32 in the direction corresponding to the boom raising with intent to raise the boom for, by way of example, excavation, the produced operation input signal X is applied as a boom raising command to the boom directional flow control valves 10*c*, 10*d*, thus causing their spools to shift in the corresponding directions. As a result, the hydraulic fluids from the hydraulic pumps 1*a*, 1*b* are supplied to the rod pushing-side chambers 5*a*A, 5*b*A of the boom hydraulic cylinders 5*a*, 5*b* via the main line 105.

On the other hand, the boom-inflow drive signal processing unit 231 computes the drive signal S for the boom inflow control valve 201 in accordance with the boom-raising operation input signal X from the control lever 32 and outputs the computed drive signal S to the solenoid sector 201B of the boom inflow control valve 201. Simultaneously, in accordance with the other operation signals (i.e., the boom-lowering operation input signal, the arm-crowding and -dumping operation input signals, and the bucket-crowding and -dumping operation input signals), the corresponding drive signal processing units 232, 242, 233 and 243 also compute the corresponding solenoid drive signals S. In this case, however, because the other operations are not commanded, each of those drive signal processing units computes a reference output (i.e., a current value, e.g., substantially zero, at which the valve will not open) and outputs it. Then, the maximum value selector 235 selects a maximum one of the boom-raising operation input signal X, the arm-crowding operation input signal X, and the bucket-crowding operation input signal X from the control levers 32, 33. However, because the other operations are not commanded, the bypass drive signal processing unit 234 eventually computes the drive signal S for the bypass flow control valve 204 in accordance with the boom-raising operation input signal X from the control lever 32 and outputs the computed drive signal S to the solenoid sector 204B of the bypass flow control valve 204. As a result, the bypass flow control valve 204 for returning the hydraulic fluids delivered from the hydraulic pumps 3*a*, 3*b* to the reservoir 2 is driven to the closed side and the boom inflow control valve 201 is driven to the open side, whereupon the hydraulic fluids delivered from the hydraulic pumps 3*a*, 3*b* are supplied to the rod pushing-side chambers 5*a*A, 5*b*A of the boom hydraulic cylinders 5*a*, 5*b* via the delivery line 102, the supply line 100, the branch line 150A, and the boom inflow control valve 201.

Accordingly, the hydraulic fluids delivered from the hydraulic pumps 3*a*, 3*b* and supplied through the boom inflow control valve 201 are joined with the hydraulic fluids delivered from the hydraulic pumps 1*a*, 1*b* and supplied through the boom directional flow control valves 10*c*, 10*d*, thus causing the hydraulic fluids from the hydraulic pumps 1*a*, 1*b*, 3*a* and 3*b* to flow into the rod pushing-side chambers 5*a*A, 5*b*A of the boom hydraulic cylinders 5*a*, 5*b* at a summed-up pump delivery rate.

On that occasion, the outflow rate of the return hydraulic fluids from the rod drawing-side chambers 5*a*B, 5*b*B of the boom hydraulic cylinders 5*a*, 5*b* is about ½ of the inflow rate to the rod pushing-side chambers 5*a*A, 5*b*A thereof because a volume ratio of the rod pushing-side chamber to the rod drawing-side chamber of each cylinder is, for example, about 2:1. In other words, the outflow rate of the return hydraulic fluids is substantially equal to the inflow rate from the boom directional flow control valves 10*c*, 10*d* and can be accommodated by those directional flow control valves 10*c*, 10*d*. Hence, the return hydraulic fluids are returned to the reservoir 2 from the rod drawing-side chambers 5*a*B, 5*b*B via the main line 115 and meter-out throttles (not shown) of the directional flow control valves 10*c*, 10*d*.

(2) Boom-Lowering Operation

When the operator operates the control lever 32 in the direction corresponding to the boom lowering with intent to lower the boom for, by way of example, returning to the excavating position after loading the excavated earth, the produced operation input signal X is applied as a boom lowering command to the boom directional flow control valves 10*c*, 10*d*, thus causing their spools to shift in the corresponding directions. As a result, the hydraulic fluids from the hydraulic pumps 1*a*, 1*b* are supplied to the rod drawing-side chambers 5*a*B, 5*b*B of the boom hydraulic cylinders 5*a*, 5*b* via the main line 115.

At that time, because of the above-mentioned volume ratio of the rod pushing-side chamber to the rod drawing-side chamber, the outflow rate of the return hydraulic fluids from the rod pushing-side chambers 5*a*A, 5*b*A is about twice the inflow rate to the rod drawing-side chambers 5*a*B, 5*b*B. In this embodiment, therefore, the return hydraulic fluids corresponding to a part (e.g., about ½) of that outflow rate are returned to the reservoir 2 from the rod pushing-side chambers 5*a*A, 5*b*A via the main line 105 and the meter-out throttles (not shown) of the directional flow control valves 10*c*, 10*d*. On the other hand, the boom-outflow drive signal processing unit 241 computes the drive signal S for the boom outflow control valve 211 in accordance with the boom-lowering operation input signal X from the control lever 32 and outputs the computed drive signal S to the solenoid sector 211B of the boom outflow control valve 211. Simultaneously, the bypass drive signal processing unit 234 computes the drive signal S for the bypass flow control valve 204 in accordance with the applied operation input signal X (X=0 in this case) and outputs the computed drive signal S to the solenoid sector 204B of the bypass flow control valve 204. As a result, the bypass flow control valve 204 for returning the hydraulic fluids delivered from the hydraulic pumps 3*a*, 3*b* to the reservoir 2 is driven to the open side, and the boom outflow control valve 211 is driven to the open side, whereupon the return hydraulic fluids from the rod pushing-side chambers 5*a*A, 5*b*A of the boom hydraulic cylinders 5*a*, 5*b* are drained to the reservoir 2 via the branch line 150A, the branch line 152A, the boom outflow control valve 211, the drain line 101, and the reservoir line 103.

(3) Arm-Crowding Operation

When the operator operates the control lever 33 in the direction corresponding to the arm crowding with intent to crowd the arm for, by way of example, excavation, the produced operation input signal X is applied as an arm crowding command to the arm directional flow control valves 10*b*, 10*e*, thus causing their spools to shift in the corresponding directions. As a result, the hydraulic fluids from the hydraulic pumps 1*a*, 1*b* are supplied to the rod pushing-side chamber 6A of the arm hydraulic cylinder 6 via the main line 106.

On the other hand, the arm-inflow drive signal processing unit 232 computes the drive signal S for the arm inflow control valve 202 in accordance with the arm-crowding operation input signal X from the control lever 33 and outputs the computed drive signal S to the solenoid sector 202B of the arm inflow control valve 202. In the sole operation of arm crowding, the bypass drive signal processing unit 234 computes the drive signal S for the bypass flow control valve 204 in accordance with the arm-crowding operation input signal X from the control lever 33 and outputs the computed drive signal S to the solenoid sector 204B of the bypass flow control valve 204. As a result, the bypass flow control valve 204 for returning the hydraulic fluids delivered from the hydraulic pumps 3*a*, 3*b* to the reservoir 2 is driven to the closed side and the arm inflow control valve 202 is driven to the open side, whereupon the hydraulic fluids delivered from the hydraulic pumps 3*a*, 3*b* are supplied to the rod pushing-side chamber 6A of the arm hydraulic cylinder 6 via the delivery line 102, the supply line 100, the branch line 150B, and the arm inflow control valve 202.

Accordingly, the hydraulic fluids delivered from the hydraulic pumps 3*a*, 3*b* and supplied through the arm inflow control valve 202 are joined with the hydraulic fluids delivered from the hydraulic pumps 1*a*, 1*b* and supplied through the arm directional flow control valves 10*b*, 10*e*, thus causing the hydraulic fluids from the hydraulic pumps 1*a*, 1*b*, 3*a* and 3*b* to flow into the rod pushing-side chamber 6A of the arm hydraulic cylinder 6 at a summed-up pump delivery rate.

On that occasion, the outflow rate of the return hydraulic fluid from the rod drawing-side chamber 6B of the arm hydraulic cylinder 6 is, for example, about ½ of the inflow rate to the rod pushing-side chamber 6A. In other words, the outflow rate of the return hydraulic fluid is substantially equal to the inflow rate from the arm directional flow control valves 10*b*, 10*e* and can be accommodated by those directional flow control valves 10*b*, 10*e*. Hence, the return hydraulic fluids are returned to the reservoir 2 from the rod drawing-side chamber 6B via the main line 116 and meter-out throttles (not shown) of the directional flow control valves 10*b*, 10*e*.

(4) Arm-Dumping Operation

When the operator operates the control lever 33 in the direction corresponding to the arm dumping with intent to dump the arm for, by way of example, loading the excavated earth, the produced operation input signal X is applied as an arm dumping command to the arm directional flow control valves 10*b*, 10*e*, thus causing their spools to shift in the corresponding directions. As a result, the hydraulic fluids from the hydraulic pumps 1*a*, 1*b* are supplied to the rod drawing-side chamber 6B of the arm hydraulic cylinder 6 via the main line 116.

At that time, because of the above-mentioned volume ratio of the rod pushing-side chamber to the rod drawing-side chamber, the outflow rate of the return hydraulic fluid from the rod pushing-side chamber 6A is about twice the inflow rate to the rod drawing-side chamber 6B. In this embodiment, therefore, the return hydraulic fluid corresponding to a part (e.g., about ½) of that outflow rate is returned to the reservoir 2 from the rod pushing-side chamber 6B via the main line 106 and the meter-out throttles (not shown) of the directional flow control valves 10*b*, 10*e*.

On the other hand, the arm-outflow drive signal processing unit 242 computes the drive signal S for the arm outflow control valve 212 in accordance with the arm-dumping operation input signal X from the control lever 33 and outputs the computed drive signal S to the solenoid sector 212B of the arm outflow control valve 212. Simultaneously, the bypass drive signal processing unit 234 computes the drive signal S for the bypass flow control valve 204 in accordance with the applied operation input signal X (X=0 in this case) and outputs the computed drive signal S to the solenoid sector 204B of the bypass flow control valve 204. As a result, the bypass flow control valve 204 for returning the hydraulic fluids delivered from the hydraulic pumps 3*a*, 3*b* to the reservoir 2 is driven to the open side, and the arm outflow control valve 212 is driven to the open side, whereupon the return hydraulic fluid from the rod pushing-side chamber 6A of the arm hydraulic cylinder 6 is drained to the reservoir via the branch line 150B, the branch line 152B, the arm outflow control valve 212, the drain line 101, and the reservoir line 103.

Consequently, the return hydraulic fluid from the rod pushing-side chamber 6A of the arm hydraulic cylinder 6 is drained to the reservoir in a way divided into the hydraulic fluid drained to the reservoir through the arm directional flow control valves 10*b*, 10*e* and the hydraulic fluid drained to the reservoir through the arm outflow control valve 212.

(5) Bucket-Crowding Operation

When the operator operates the control lever 32 in the direction corresponding to the bucket crowding with intent to crowd the bucket for, by way of example, excavation, the produced operation input signal X is applied as an bucket crowding command to the bucket directional flow control valves 10*a*, 10*f*, thus causing their spools to shift in the corresponding directions. As a result, the hydraulic fluids from the hydraulic pumps 1*a*, 1*b* are supplied to the rod pushing-side chamber 7A of the bucket hydraulic cylinder 7 via the main line 107.

On the other hand, the bucket-inflow drive signal processing unit 233 computes the drive signal S for the bucket inflow control valve 203 in accordance with the bucket-crowding operation input signal X from the control lever 32 and outputs the computed drive signal S to the solenoid sector 203B of the bucket inflow control valve 203. In the sole operation of bucket crowding, the bypass drive signal processing unit 234 computes the drive signal S for the bypass flow control valve 204 in accordance with the bucket-crowding operation input signal X from the control lever 33 and outputs the computed drive signal S to the solenoid sector 204B of the bypass flow control valve 204. As a result, the bypass flow control valve 204 for returning the hydraulic fluids delivered from the hydraulic pumps 3*a*, 3*b* to the reservoir 2 is driven to the closed side and the bucket inflow control valve 203 is driven to the open side, whereupon the hydraulic fluids delivered from the hydraulic pumps 3*a*, 3*b* are supplied to the rod pushing-side chamber 7A of the bucket hydraulic cylinder 7 via the delivery line 102, the supply line 100, the branch line 150C, and the bucket inflow control valve 203.

Accordingly, the hydraulic fluids delivered from the hydraulic pumps 3*a*, 3*b* and supplied through the bucket inflow control valve 203 are joined with the hydraulic fluids delivered from the hydraulic pumps 1*a*, 1*b* and supplied through the bucket directional flow control valves 10*a*, 10*f*, thus causing the hydraulic fluids from the hydraulic pumps 1*a*, 1*b*, 3*a* and 3*b* to flow into the rod pushing-side chamber 7A of the bucket hydraulic cylinder 7 at a summed-up pump delivery rate. As in the case of above (3), the return hydraulic fluid from the rod drawing-side chamber 7B of the bucket hydraulic cylinder 7 on that occasion is returned to the reservoir 2 from the rod drawing-side chamber 7B via the main line 117 and meter-out throttles (not shown) of the directional flow control valves 10*a*, 10*f*.

(6) Bucket-Dumping Operation

When the operator operates the control lever 32 in the direction corresponding to the bucket dumping with intent to dump the bucket for, by way of example, releasing the excavated earth above a bed of a dump track, the produced operation input signal X is applied as a bucket dumping command to the bucket directional flow control valves 10*a*, 10*f*, thus causing their spools to shift in the corresponding directions. As a result, the hydraulic fluids from the hydraulic pumps 1*a*, 1*b* are supplied to the rod drawing-side chamber 7B of the bucket hydraulic cylinder 7 via the main line 117.

At that time, as in the case of above (4), a part of the return hydraulic fluid from the rod pushing-side chamber 7A is returned to the reservoir 2 from the rod pushing-side chamber 7 via the main line 107 and the meter-out throttles (not shown) of the directional flow control valves 10*a*, 10*f*. On the other hand, the bucket-outflow drive signal processing unit 243 computes the drive signal S for the bucket outflow control valve 213 in accordance with the bucket-dumping operation input signal X from the control lever 32 and outputs the computed drive signal S to the solenoid sector 213B of the bucket outflow control valve 213. Simultaneously, the bypass drive signal processing unit 234 computes the drive signal S for the bypass flow control valve 204 in accordance with the applied operation input signal X (X=0 in this case) and outputs the computed drive signal S to the solenoid sector 204B of the bypass flow control valve 204. As a result, the bypass flow control valve 204 for returning the hydraulic fluids delivered from the hydraulic pumps 3*a*, 3*b* to the reservoir 2 is driven to the open side, and the bucket outflow control valve 213 is driven to the open side, whereupon the return hydraulic fluid from the rod pushing-side chamber 7A of the bucket hydraulic cylinder 7 is drained to the reservoir via the branch line 150C, the branch line 152C, the bucket outflow control valve 213, the drain line 101, and the reservoir line 103.

Consequently, the return hydraulic fluid from the rod pushing-side chamber 7A of the bucket hydraulic cylinder 7 is drained to the reservoir in a way divided into the hydraulic fluid drained to the reservoir through the bucket directional flow control valves 10*a*, 10*f* and the hydraulic fluid drained to the reservoir through the bucket outflow control valve 213.

It is needless to say that, while the above description is made of, by way of example, in connection with the sole operation of boom raising, boom lowering, arm crowding, arm dumping, bucket crowding, or bucket dumping, composite control is performed in a combination of the above-described control processes when two or more of the boom, the arm and the bucket are operated in a combined manner.

With this embodiment, as described above, when forming hydraulic fluid supply routes not passing the directional flow control valves 10*a-f* to supply the hydraulic fluid at a large flow rate in a backhoe type hydraulic excavator of an super-large class, the branch line 150A leading to the rod pushing-side chambers 5*a*A, 5*b*A of the boom hydraulic cylinders is first branched from the supply line 100, serving as the common high-pressure line which is connected the delivery sides of the hydraulic pumps 3*a*, 3*b* and extended to the side of the front operating mechanism 14, at a position near the boom hydraulic cylinders 5*a*, 5*b*. Then, the branch line 150B leading to the rod pushing-side chamber 6A of the arm hydraulic cylinder is branched from the supply line 100 at a position downstream of the position at which the branch line 150A is branched, and the remaining part of the supply line 10 is constituted as the branch line 150C leading to the rod pushing-side chamber 7A of the bucket hydraulic cylinder. Further, the boom inflow control valve 201, the arm inflow control valve 202, and the bucket inflow control valve 203 are disposed respectively in the branch lines 150A, 150B and 150C to control the flows of the hydraulic fluids from the supply line 100 to the hydraulic cylinders 5 to 7.

When supplying the hydraulic fluids to the respective rod pushing-side chambers 5*a*A, 5*b*A, 6A and 7A of the hydraulic cylinders 5 to 7 to perform the boom-raising, arm-crowding and bucket-crowding operations, in addition to the ordinary supply of the hydraulic fluids to the respective rod pushing-side chambers 5*a*A, 5*b*A, 6A and 7A of the hydraulic cylinders 5 to 7 through the directional flow control valves 10*a-f*, the hydraulic fluids from the hydraulic pumps 3*a*, 3*b* are joined with the hydraulic fluids, which are supplied through the directional flow control valves 10*a-f*, through the inflow control valves 201 to 203 without passing the directional flow control valves 10*a-f*. The joined hydraulic fluids are then supplied to the respective rod pushing-side chambers 5*a*A, 5*b*A, 6A and 7A of the hydraulic cylinders 5 to 7. The return hydraulic fluids in this case are drained to the reservoir only via routes through the directional flow control valves 10*a-f*. On the other hand, when supplying the hydraulic fluids to the respective rod drawing-side chambers of the hydraulic cylinders 5 to 7 to perform, e.g., the boom-lowering, arm-dumping and bucket-dumping operations, the hydraulic fluids are supplied from the hydraulic pumps 1*a*, 1*b* to the respective rod drawing-side chambers 5*a*B, 5*b*B, 6B and 7B of the hydraulic cylinders 5 to 7 through the directional flow control valves 10*a-f*.

Thus, in consideration of the volume differences between the rod pushing-side chambers 5*a*A, 5*b*A, 6A and 7A and the rod drawing-side chambers 5*a*B, 5*b*B, 6B and 7B of the hydraulic cylinders 5 to 7, only the inflow control valves 201, 202 and 203 in the bottom-side branch lines 150A-C are additionally provided to achieve the supply of the hydraulic fluid at a large flow rate, while rod-side inflow control valves are omitted, whereby the pressure loss caused by the flow control valves can be reduced correspondingly. Also, since piping required for installation of the flow control valves is omitted and hence an accompanying pressure loss is eliminated, the pressure loss of the overall hydraulic drive system can be further reduced. In addition, with a reduction in the number of the flow control valves, it is possible to simplify layouts including routing of various pipes and arrangements of various units, particularly layouts of hydraulic piping between the hydraulic pumps 3*a*, 3*b* as hydraulic sources and the hydraulic cylinders 5*a*, 5*b*, 6 and 7.

In addition to the super-large-sized hydraulic excavator described above, hydraulic excavators are classified into, for example, a small-sized excavator having its own weight of not more than about 15 tons, a medium-sized excavator having its own weight of not more than about 20 tons, and a large-sized excavator having its own weight of about 25 to 40 tons. The small- and medium-sized excavators are employed in relatively wide range of applications including ordinary construction work sites, etc. in Japan, while large-sized and super-large-sized hydraulic excavators are adapted for large-scale excavation work and are practically employed in digging of minerals in foreign mines in many cases. When those large-sized and super-large-sized hydraulic excavators are delivered to foreign customers from manufacturers in Japan, they are transported by ship. It is therefore usual that the hydraulic excavators are not transported in the form of complete machines, but they are shipped in the form divided per related module (unit) and are assembled into the complete machines after landing in sites. In general, a hydraulic drive system for a hydraulic excavator is constructed by connecting hydraulic pumps, a reservoir, directional flow control valves, etc. with metal-made hydraulic pipes and hoses made of flexible materials. Because of having flexibility, the hoses can be easily connected and fixed at their opposite ends to corresponding mouthpieces of the components as connection targets through field fitting of the actual parts in assembly work after landing. On the other hand, the hydraulic pipes are welded to the components as connection targets to form integral structures. In trying to weld the hydraulic pipes during the assembly after landing, however, required work becomes very complicated and difficult to perform. For that reason, it is preferable to transport the hydraulic excavator in the form divided into blocks obtained after finishing welding as far as possible within an allowable range prior to the shipment, and to minimize the welding work required in sites. When dividing the hydraulic excavator into blocks to that end, the size of one block must be minimized because there are prescribed transport restrictions in shipping or truck transportation along public roads from a manufacturer's factory to a port.

With this embodiment, since the rod-side inflow control valves are omitted as described above, the size of each flow control valve unit can be reduced when the inflow control valves are prepared in the form of blocks to reduce the amount of welding work to a minimum, which is required after shipment to foreign customers and landing. Accordingly, it is possible to easily clear the prescribed transport restrictions in shipping or truck transportation along public roads from the manufacturer's factory to the port, and hence to improve transportability.

Further, in this embodiment, the branch lines 152A, 152B and 152C are disposed which are branched from the branch lines 150A, 150B and 150C connected to the rod pushing-side chambers 5*a*A, 5*b*A of the boom hydraulic cylinders, the rod pushing-side chamber 6A of the arm hydraulic cylinder, and the rod pushing-side chamber 7A of the bucket hydraulic cylinder, respectively, and which are led to the drain line 101. The outflow control valves 211, 212 and 213 are disposed respectively in the branch lines 152A, 152B and 152C. With such an arrangement, when the boom-lowering, arm-dumping and bucket-dumping operations are performed with the supply of the hydraulic fluids to the rod drawing-side chambers 5*a*B, 5*b*B, 6B and 7B of the hydraulic cylinders 5*a*, 5*b*, 6 and 7, parts of the hydraulic fluids to be returned at large flow rates from the rod pushing-side chambers 5*a*A, 5*b*A, 6A and 7A thereof are drained to the hydraulic reservoir 2 through the outflow control valves 211, 212 and 213 without passing the directional flow control valves 10*a*, 10*b*, 10*e* and 10*f*. Consequently, the smooth operation of the front operating mechanism 14 can be ensured.

A second embodiment of the present invention will be described with reference to FIGS. 4 to 6. This embodiment represents the case in which the present invention is applied to the so-called loader type super-large-sized hydraulic excavator unlike the above first embodiment.

Figure 4:
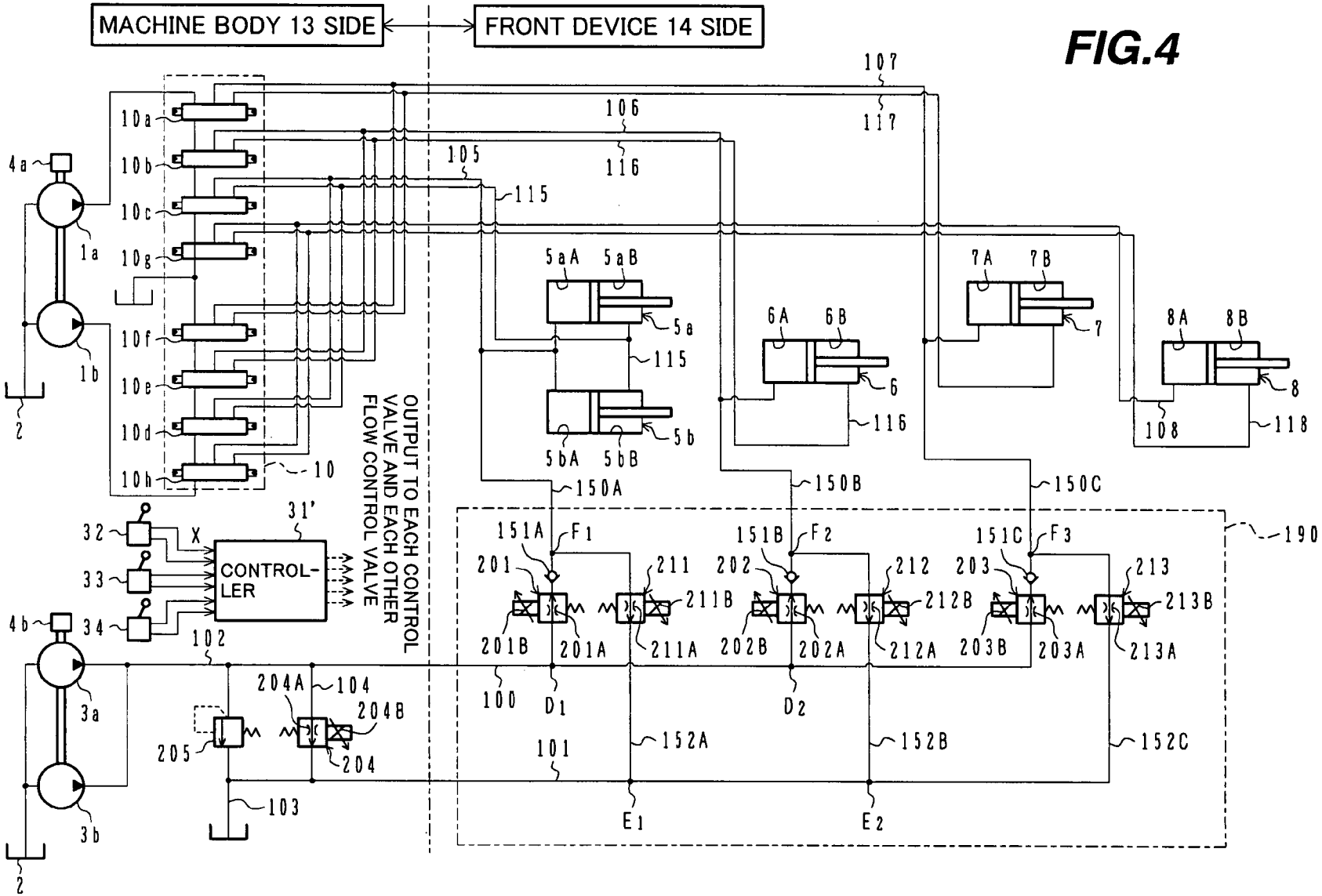
FIG. 4 is a hydraulic circuit diagram showing the overall construction of a hydraulic drive system according to a second embodiment of the present invention along with a control system for it.

FIG. 4 is a hydraulic circuit diagram showing the overall construction of a hydraulic drive system according to this embodiment along with a control system for it. Identical components to those in FIG. 1 are denoted by the same symbols, and a description of those components is not repeated here as appropriate. As shown in F*ig*. 4, the hydraulic drive system of this embodiment further comprises, as another hydraulic cylinder, a bucket opening/closing hydraulic cylinder 8 supplied with the hydraulic fluids from the hydraulic pumps 1*a*, 1*b*. Correspondingly, the hydraulic pump la is connected to the bucket opening/closing hydraulic cylinder 8 through a first bucket opening/closing directional flow control valve 10*g*, and the hydraulic pump 1*b* is connected to the bucket opening/closing hydraulic cylinder 8 through a second bucket opening/closing directional flow control valve 10*h*. These directional flow control valves 10*g*, 10*h* constitute the directional flow control valve group 10 together with the above-mentioned directional flow control valves 10*a* to 10*f*. Further, a rod pushing-side chamber 8A of the bucket opening/closing hydraulic cylinder 8 is connected to the first and second bucket opening/closing directional flow control valves 10*g*, 10*h* via a main line 108, and a rod drawing-side chamber 8B of the bucket opening/closing hydraulic cylinder 8 is connected to the first and second bucket opening/closing directional flow control valves 10*g*, 10*h* via a main line 118.

Figure 5:
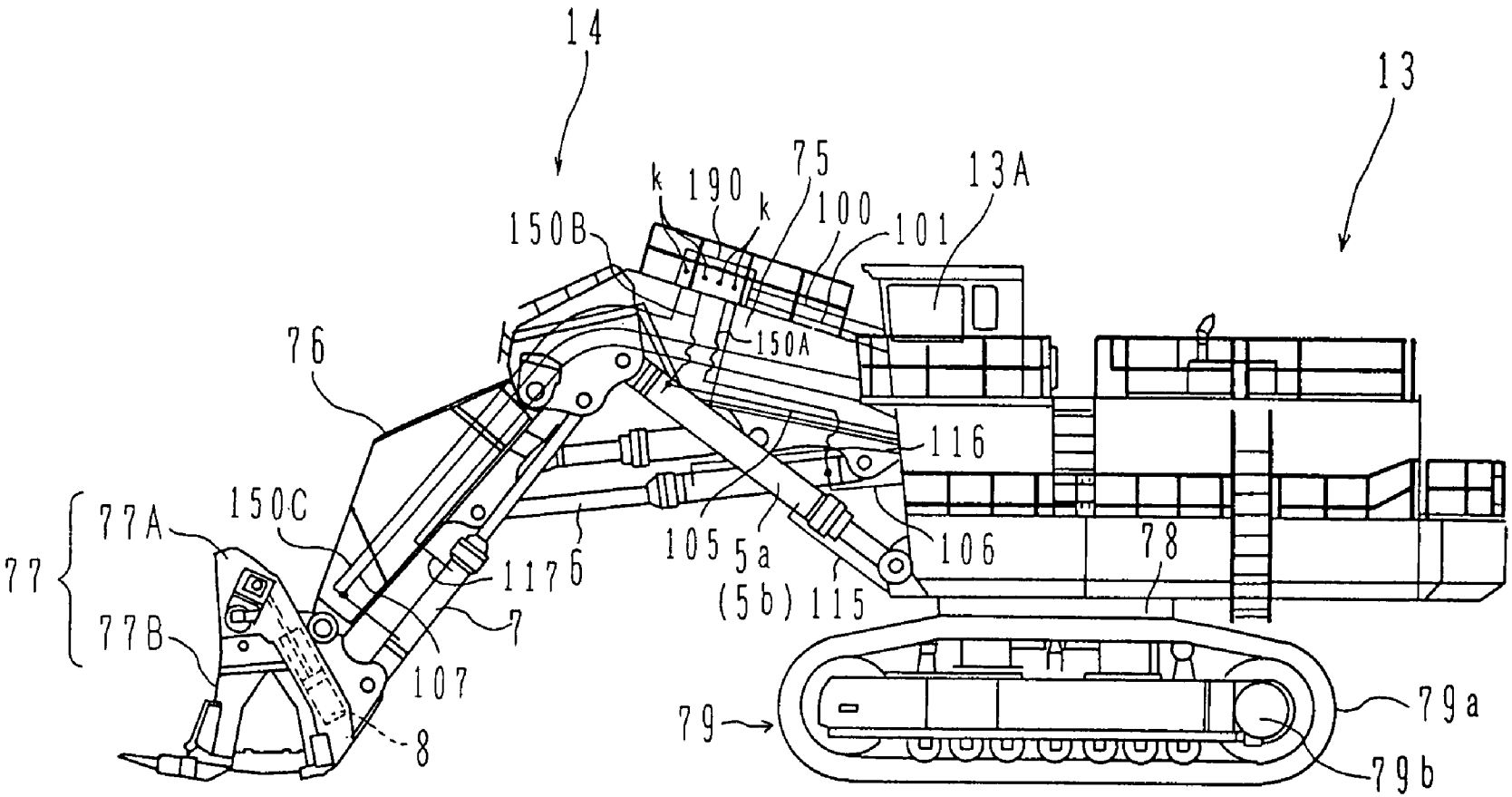
FIG. 5 is a side view showing the overall structure of a hydraulic excavator driven by the hydraulic drive system shown in FIG. 4.

FIG. 5 is a side view showing the overall structure of a hydraulic excavator driven by the hydraulic drive system having the construction described above. Identical components to those in FIG. 2 are denoted by the same symbols, and a description of those components is omitted here as appropriate. As shown in FIG. 5, the hydraulic excavator of this embodiment is of the so-called loader type in which a bucket 77 provided in the multi-articulated front operating mechanism 14 is mounted to be open forward in a ground contact state, and the bucket opening/closing hydraulic cylinder 8 is mounted to the bucket 77 as shown. Then, operations of boom raising (or boom lowering), arm pushing (or arm drawing), bucket crowding (or bucket dumping), and bucket closing (bucket opening=opening of a bucket opening portion 77B relative to a bucket base portion 77A) are performed with extension (or contraction) of the boom hydraulic cylinders 5*a*, 5*b*, the arm hydraulic cylinder 6, the bucket hydraulic cylinder 7, and the bucket opening/closing hydraulic cylinder 8, respectively.

Of the branch lines 150A to 150C, as in the above first embodiment, the branch line 150A serving as a boom branch line is branched from the supply line 100 at a most upstream position, and the other branch line 150B serving as an arm branch line and branch line 150C serving as a bucket branch line are branched from the supply line 100 at a position downstream of the position at which the boom branch line 150A is branched.

Also, as in the first embodiment, the boom inflow control valve 201, the arm inflow control valve 202, and the bucket inflow control valve 203 are disposed near the above-mentioned branch positions D1, D2. Further, the boom outflow control valve 211, the arm outflow control valve 212, and the bucket outflow control valve 213 are disposed respectively near the above-mentioned branch positions E1, F1, branch positions E2, F2, and branch positions E2, F3. The inflow control valves 201, 202 and 203, the check valves 151A, 151B and 151C, and the outflow control valves 211, 212 and 213 are disposed together in one control valve unit 190 which is mounted to an upper surface (back surface) of the boom 75. Then, the supply line 100, the drain line 101, the branch lines 150A-C, 152A-C, the inflow control valves 201 to 203, the check valves 151A-C, and the outflow control valves 211 to 213 are disposed on the front operating mechanism 14.

Returning to FIG. 4, a controller 31' provided as a control unit for the above-described hydraulic drive system receives operation signals outputted from the control levers 32, 33 and an additionally provided control lever 34, and outputs command signals to the directional flow control valves 10*a-h*, the inflow control valves 201, 202 and 203, the outflow control valves 211, 212 and 213, and the bypass flow control valve 204. The control lever 34 is of the type outputting operation signals for opening and closing the bucket when operated. The control lever 34 may be replaced with a pedal operable by the operator's foot.

Figure 6:
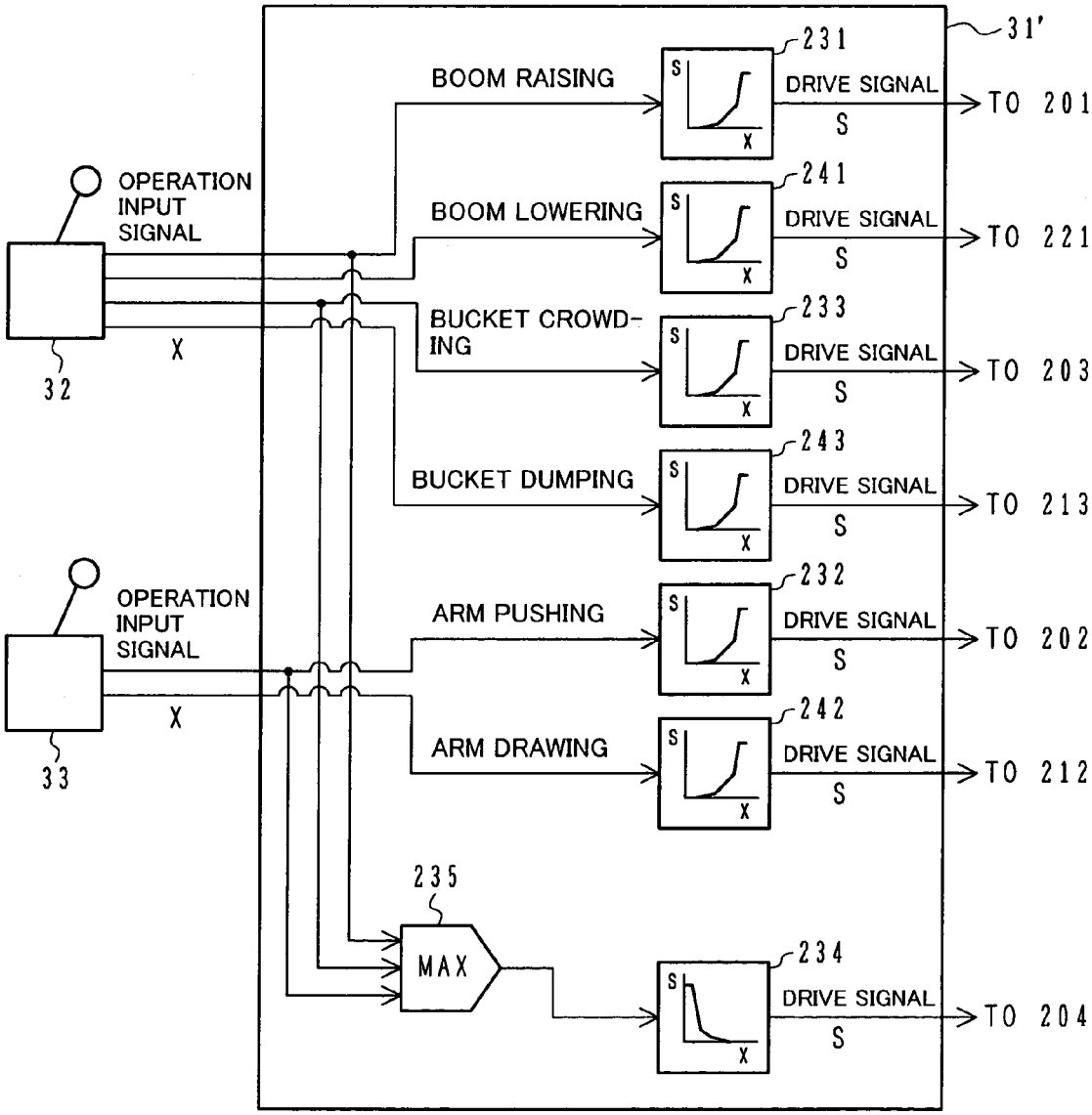
FIG. 6 is a functional block diagram showing, among detailed functions of a controller shown in FIG. 4, control functions for inflow control valves, outflow control valves, and a bypass flow control valve.

FIG. 6 is a functional block diagram showing, among detailed functions of the controller 31', control functions for the inflow control valves 201, 202 and 203, the outflow control valves 211, 212 and 213, and the bypass flow control valve 204, which constitute a principal part of this embodiment, other than general control functions of controlling the directional flow control valves 10*a* to 10*h* in response to the operation signals from the control levers 32, 33 and 34. As shown in FIG. 6, the controller 31' comprises, similarly to the controller 31 in the above first embodiment, a drive signal processing unit 231 for the boom inflow control valve 201, a drive signal processing unit 232 for the arm inflow control valve 202, a drive signal processing unit 233 for the bucket inflow control valve 203, a drive signal processing unit 241 for the boom outflow control valve 211, a drive signal processing unit 242 for the arm outflow control valve 212, a drive signal processing unit 243 for the bucket outflow control valve 213, a drive signal processing unit 234 for the bypass flow control valve 204, and a maximum value selector 235.

In this embodiment, the arm-inflow drive signal processing unit 232 receives an arm-pushing operation input signal X from the control lever 33, and computes a control signal S for the arm inflow control valve 202 (i.e., a drive signal applied to the solenoid sector 202B) based on the illustrated table, followed by outputting the computed control signal. Then, the maximum value selector 235 selects a maximum one of the boom-raising operation input signal X, the arm-pushing operation input signal X, and the bucket-crowding operation input signal X from the control levers 32, 33. The selected maximum operation signal is inputted to the bypass drive signal processing unit 234. The bypass drive signal processing unit 234 computes the control signal S for the bypass flow control valve 204 and outputs the computed control signal. Further, the arm-outflow drive signal processing unit 242 receives an arm-drawing operation input signal X from the control lever 33, and computes a control signal S for the arm outflow control valve 212 (i.e., a drive signal applied to the solenoid sector 212B) based on the illustrated table, followed by outputting the computed control signal.

The operation of this embodiment thus constructed will be described below.

(1) Boom-Raising Operation (2) Boom-Lowering Operation

These operations (1) and (2) are the same as those in the above first embodiment, and hence a description thereof is omitted here.

(3) Arm-Pushing Operation

When the operator operates the control lever 33 in the direction corresponding to the arm pushing with intent to push the arm for, by way of example, excavation, the produced operation input signal X is applied as an arm pushing command to the arm directional flow control valves 10*b*, 10*e*, thus causing their spools to shift in the corresponding directions. As a result, the hydraulic fluids from the hydraulic pumps 1*a*, 1*b* are supplied to the rod pushing-side chamber 6A of the arm hydraulic cylinder 6 via the main line 106.

On the other hand, the arm-inflow drive signal processing unit 232 computes the drive signal S for the arm inflow control valve 202 in accordance with the arm-pushing operation input signal X from the control lever 33 and outputs the computed drive signal S to the solenoid sector 202B of the arm inflow control valve 202. In the sole operation of arm pushing, the bypass drive signal processing unit 234 computes the drive signal S for the bypass flow control valve 204 in accordance with the arm-pushing operation input signal X from the control lever 33 and outputs the computed drive signal S to the solenoid sector 204B of the bypass flow control valve 204. As a result, the bypass flow control valve 204 for returning the hydraulic fluids delivered from the hydraulic pumps 3*a*, 3*b* to the reservoir 2 is driven to the closed side and the arm inflow control valve 202 is driven to the open side, whereupon the hydraulic fluids delivered from the hydraulic pumps 3*a*, 3*b* are supplied to the rod pushing-side chamber 6A of the arm hydraulic cylinder 6 via the delivery line 102, the supply line 100, the branch line 150B, and the arm inflow control valve 202.

Accordingly, the hydraulic fluids delivered from the hydraulic pumps 3*a*, 3*b* and supplied through the arm inflow control valve 202 are joined with the hydraulic fluids delivered from the hydraulic pumps 1*a*, 1*b* and supplied through the arm directional flow control valves 10*b*, 10*e*, thus causing the hydraulic fluids from the hydraulic pumps 1*a*, 1*b*, 3*a* and 3*b* to flow into the rod pushing-side chamber 6A of the arm hydraulic cylinder 6 at a summed-up pump delivery rate.

On that occasion, the outflow rate of the return hydraulic fluid from the rod drawing-side chamber 6B of the arm hydraulic cylinder 6 is, for example, about ½ of the inflow rate to the rod pushing-side chamber 6A. In other words, the outflow rate of the return hydraulic fluid is substantially equal to the inflow rate from the arm directional flow control valves 10*b*, 10*e* and can be accommodated by those directional flow control valves 10*b*, 10*e*. Hence, the return hydraulic fluids are returned to the reservoir 2 from the rod drawing-side chamber 6B via the main line 116 and meter-out throttles (not shown) of the directional flow control valves 10*b*, 10*e*.

(4) Arm-Drawing Operation

When the operator operates the control lever 33 in the direction corresponding to the arm drawing with intent to draw the arm after releasing the excavated earth, for example, the produced operation input signal X is applied as an arm crowding command to the arm directional flow control valves 10*b*, 10*e*, thus causing their spools to shift in the corresponding directions. As a result, the hydraulic fluids from the hydraulic pumps 10*a*, 10*b* are supplied to the rod drawing-side chamber 6B of the arm hydraulic cylinder 6 via the main line 116.

At that time, because of the above-mentioned volume ratio of the rod pushing-side chamber to the rod drawing-side chamber, the outflow rate of the return hydraulic fluid from the rod pushing-side chamber 6A is about twice the inflow rate to the rod drawing-side chamber 6B. In this embodiment, therefore, the return hydraulic fluid corresponding to a part (e.g., about ½) of that outflow rate is returned to the reservoir 2 from the rod pushing-side chamber 6B via the main line 106 and the meter-out throttles (not shown) of the directional flow control valves 10*b*, 10*e*.

On the other hand, the arm-outflow drive signal processing unit 242 computes the drive signal S for the arm outflow control valve 212 in accordance with the arm-drawing operation input signal X from the control lever 33 and outputs the computed drive signal S to the solenoid sector 212B of the arm outflow control valve 212. Simultaneously, the bypass drive signal processing unit 234 computes the drive signal S for the bypass flow control valve 204 in accordance with the applied operation input signal X (X=0 in this case) and outputs the computed drive signal S to the solenoid sector 204B of the bypass flow control valve 204. As a result, the bypass flow control valve 204 for returning the hydraulic fluids delivered from the hydraulic pumps 3*a*, 3*b* to the reservoir 2 is driven to the open side, and the arm outflow control valve 212 is driven to the open side, whereupon the return hydraulic fluid from the rod pushing-side chamber 6A of the arm hydraulic cylinder 6 is drained to the reservoir via the branch line 150B, the branch line 152B, the arm outflow control valve 212, the drain line 101, and the reservoir line 103.

Consequently, the return hydraulic fluid from the rod pushing-side chamber 6A of the arm hydraulic cylinder 6 is drained to the reservoir in a way divided into the hydraulic fluid drained to the reservoir through the arm directional flow control valves 10*b*, 10*e* and the hydraulic fluid drained to the reservoir through the arm outflow control valve 212.

(5) Bucket-Crowding Operation (6) Bucket-Dumping Operation

These operations (5) and (6) are the same as those in the above first embodiment, and hence a description thereof is omitted here.

The loader type hydraulic excavator to which this embodiment is applied operates in a typical case as follows. From a condition where the front operating mechanism 14 is positioned close to the machine body 13 in a folded state, the boom-raising, arm-pushing and bucket-crowding operations are performed to scoop earth and sand in front of the front operating mechanism into the bucket 77. Then, the bucket 77 is elevated to a high level immediately after the scooping, and the bucket opening portion 77B is opened relative to the bucket base portion 77A so that the earth and sand in the bucket 77 is released onto, e.g., a large-sized dump truck. Thereafter, the front operating mechanism 14 is returned to the initial folded state positioned close to the machine body 13 through substantially simultaneous operations of not only bucket closing and bucket dumping, but also boom lowering and arm drawing.

It is needless to say that, while the above operations (1) to (6) are described, by way of example, in connection with the sole operation of boom raising, boom lowering, arm pushing, arm drawing, bucket crowding, or bucket dumping, composite control is performed in a combination of the above-described control processes for the operations (1) to (6) when two or more of the boom, the arm and the bucket are operated in a combined manner, including the above-mentioned typical case.

With this embodiment, as with the first embodiment, the pressure loss caused by the flow control valves can be reduced. Also, since piping required for installation of the flow control valves is omitted and hence an accompanying pressure loss is eliminated, the pressure loss of the overall hydraulic drive system can be further reduced. In addition, with a reduction in the number of the flow control valves, it is possible to simplify layouts including routing of various pipes and arrangements of various units, particularly layouts of hydraulic piping between the hydraulic pumps 3*a*, 3*b* as hydraulic sources and the hydraulic cylinders 5*a*, 5*b*, 6 and 7.

A third embodiment of the present invention will be described with reference to FIG. 7.

Figure 7:
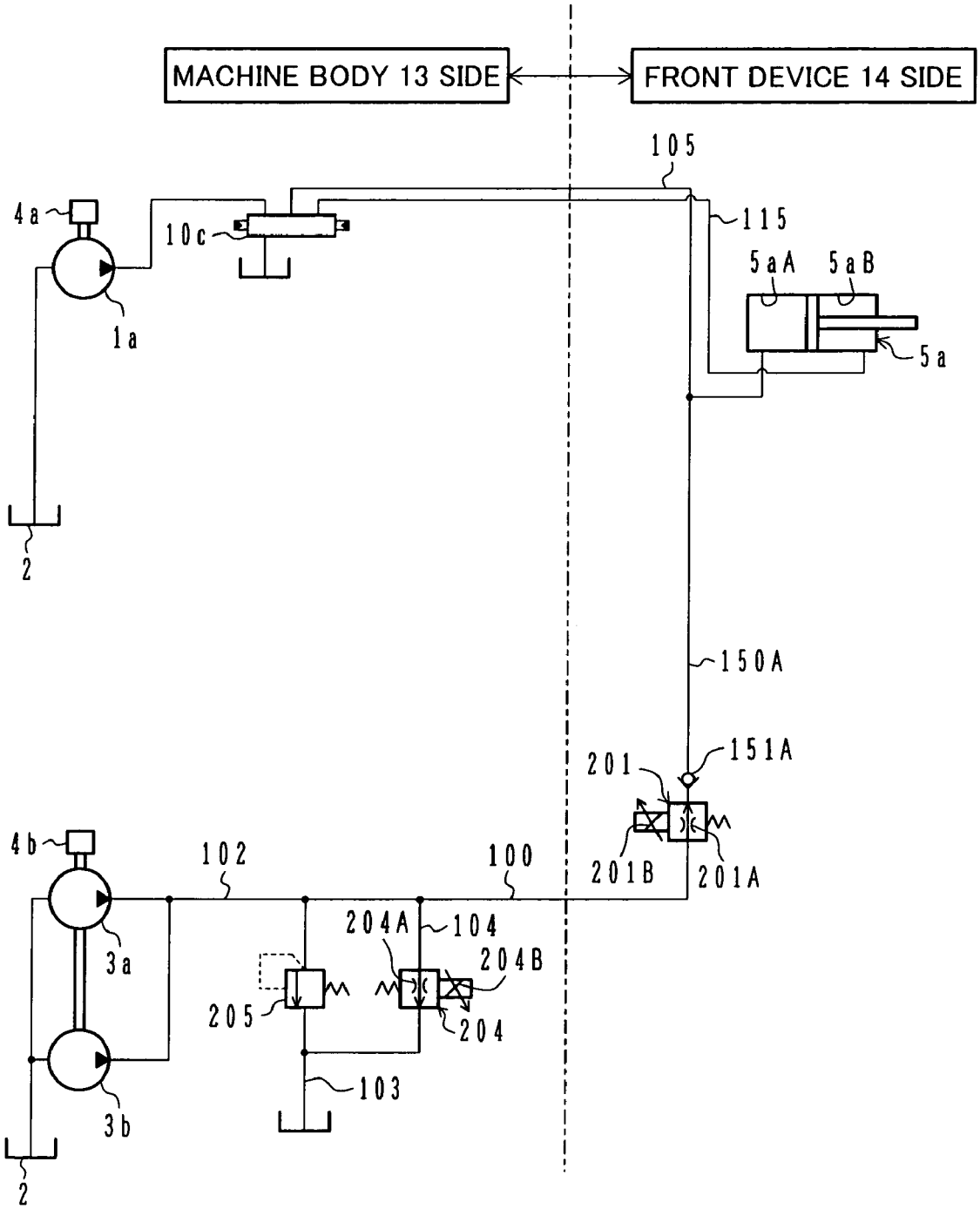
FIG. 7 is a hydraulic circuit diagram showing the construction of a hydraulic drive system according to a third embodiment of the present invention.

FIG. 7 is a hydraulic circuit diagram showing a principal part of the construction of a hydraulic drive system according to this embodiment. Identical components to those in the first and second embodiments are denoted by the same symbols, and a description of those components is omitted here as appropriate.

In the first and second embodiments, taking into account that the rod pushing-side chambers 5*a*A, 5*b*A of the boom hydraulic cylinders, the rod pushing-side chamber 6A of the arm hydraulic cylinder, and the rod pushing-side chamber 7A of the bucket hydraulic cylinder have relatively large volume ratios, the boom inflow control valve 201, the arm inflow control valve 202, and the bucket inflow control valve 203 are provided to control the supply of the hydraulic fluids from the hydraulic pumps 3*a*, 3*b* to the rod pushing-side chambers 5*a*A, 5*b*A, 6A and 7A, and the boom outflow control valve 211, the arm outflow control valve 212, and the bucket outflow control valve 213 are provided to control the draining of the hydraulic fluids from the rod pushing-side chambers 5*a*A, 5*b*A, 6A and 7A. However, the present invention is not limited to such an arrangement. When consideration is just required to focus on only the supply of the hydraulic fluids to the rod pushing-side chambers 5*a*A, 5*b*A of the boom hydraulic cylinders, the rod pushing-side chamber 6A of the arm hydraulic cylinder, and the rod pushing-side chamber 7A of the bucket hydraulic cylinder, the outflow control valves 211, 212 and 213, etc. (including the lines 101, 152A, 152B, 152C, etc.) can be omitted, and it is just required to provide only the boom inflow control valve 201, the arm inflow control valve 202, and the bucket inflow control valve 203 which are related to the supply of the hydraulic fluids.

This embodiment represents the case implementing the technical concept mentioned above. In this embodiment, the boom inflow control valve 201 is provided while attention is paid in particular to the supply of the hydraulic fluids to the rod pushing-side chambers 5*a*A, 5*b*A (the latter being not shown) of the boom hydraulic cylinders, for example, in the backhoe type hydraulic excavator described in the first embodiment and the loader type hydraulic excavator described in the second embodiment. The present invention is not limited to such an arrangement of the boom inflow control valve 201. In the case of the embodiment using the loader type hydraulic excavator, for example, the arm inflow control valve 202 may be provided instead of the boom inflow control valve 201.

With this embodiment, the number of at least the flow control valves and the associated piping can be reduced or omitted in comparison with the case of providing the inflow control valves associated with the rod drawing-side chambers as well. In this meaning, this embodiment can also provide the above-described advantages specific to the present invention, such as a reduction of the pressure loss and simplification of layouts.

A fourth embodiment of the present invention will be described with reference to FIG. 8.

Figure 8:
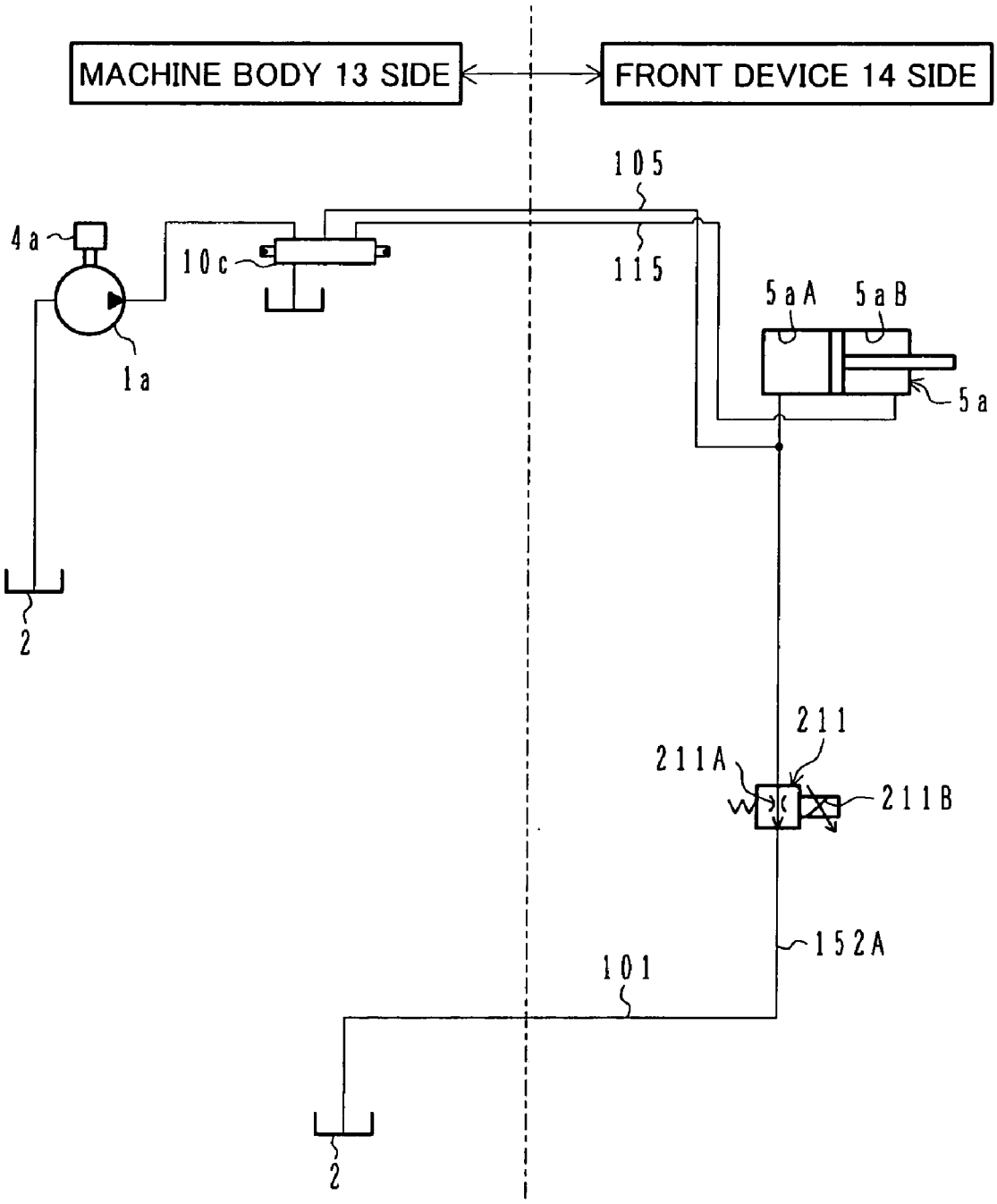
FIG. 8 is a hydraulic circuit diagram showing the construction of a hydraulic drive system according to a fourth embodiment of the present invention.

FIG. 8 is a hydraulic circuit diagram showing a principal part of the construction of a hydraulic drive system according to this embodiment. Identical components to those in the first to third embodiments are denoted by the same symbols, and a description of those components is omitted here as appropriate.

In contrast with the above third embodiment, when only the draining of the hydraulic fluids from the rod pushing-side chambers 5*a*A, 5*b*A, 6A and 7A is required to be taken into consideration, it is sufficient to provide only the outflow control valves 211, 212 and 213 with omission of the inflow control valves 201, 202 and 203, etc., the hydraulic pumps 3*a*, 3*b*, the prime mover 4*b*, the lines 102, 100 and 104, respective portions of the lines 150A, 150B and 150C in which the inflow control valves 201, 202 and 203 are disposed, the bypass flow control valve 204, the relief valve 205, etc., which are used in the first and second embodiments.

This embodiment represents the case implementing the technical concept mentioned above. In this embodiment, the boom outflow control valve 211 is provided while attention is paid in particular to the draining of the hydraulic fluids from the rod pushing-side chambers 5*a*A, 5*b*A (the latter being not shown) of the boom hydraulic cylinders, for example, in the backhoe type hydraulic excavator described in the first embodiment and the loader type hydraulic excavator described in the second embodiment. The present invention is not limited to such an arrangement of the boom outflow control valve 211. In the case of the embodiment using the loader type hydraulic excavator, for example, the arm outflow control valve 212 may be provided instead of the boom outflow control valve 211.

With this embodiment, the number of at least the flow control valves and the associated piping can be reduced or omitted in comparison with the case of providing the outflow control valves associated with the rod drawing-side chambers as well. In this meaning, this embodiment can also provide the above-described advantages specific to the present invention, such as a reduction of the pressure loss and simplification of layouts.

A fifth embodiment of the present invention will be described with reference to FIGS. 9 and 10. This embodiment represents the case in which a recovery flow control valve is provided in association with the boom hydraulic cylinder. Identical components to those in the first embodiments are denoted by the same symbols, and a description of those components is omitted here as appropriate.

Figure 9:
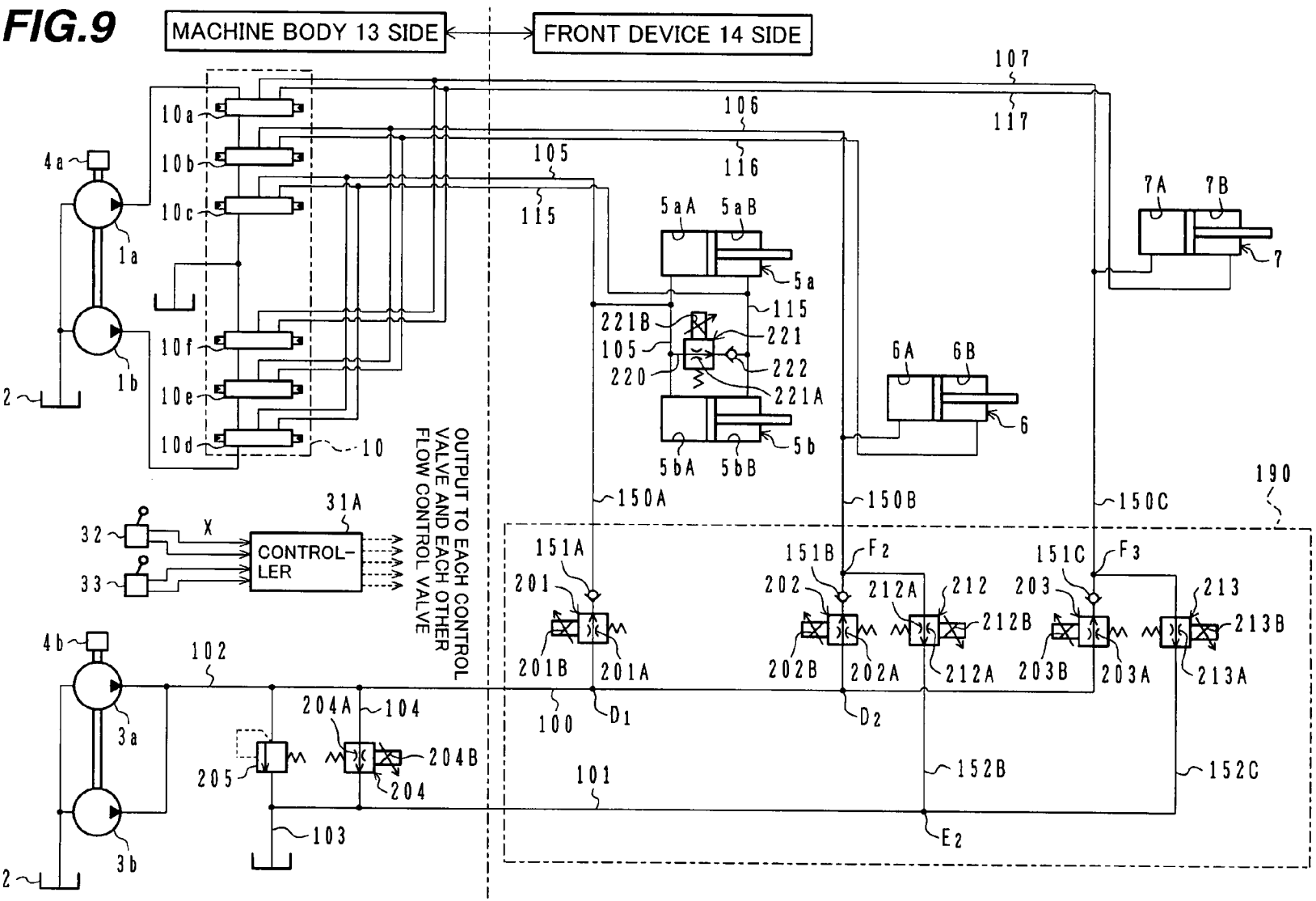
FIG. 9 is a hydraulic circuit diagram showing the overall construction of a hydraulic drive system according to a fifth embodiment of the present invention along with a control system for it.

FIG. 9 is a hydraulic circuit diagram showing the overall construction of a hydraulic drive system according to this embodiment along with a control system for it.

In FIG. 9, the hydraulic drive system of this embodiment is applied to the backhoe type hydraulic excavator, shown in FIG. 2, described above in the first embodiment. The hydraulic drive system of this embodiment differs from the hydraulic drive system, shown in FIG. 1, described above in the first embodiment as follows. The connecting line 105 connected to the rod pushing-side chambers 5*a*A, 5*b*A of the boom hydraulic cylinders 5*a*, 5*b* and the connecting line 115 connected to the rod drawing-side chambers 5*a*B, 5*b*B thereof are connected to each other via a recovery line 220. In the recovery line 220 (on the front device 14 side, though not shown), a boom recovery flow control valve 221 is disposed which is constituted as, e.g., a solenoid proportional valve and includes a variable throttle 221A for controlling the flows of the hydraulic fluids from the rod pushing-side chambers 5*a*A, 5*b*A of the boom hydraulic cylinders 5*a*, 5*b* to the rod drawing-side chambers 5*a*B, 5*b*B thereof to a desired throttled flow rate. Further, on the side of the boom recovery flow control valve 221 nearer to the rod drawing-side chambers 5*a*B, 5*b*B, a check valve 222 is disposed which allows the hydraulic fluids to flow from the rod pushing-side chambers 5*a*A, 5*b*A to the rod drawing-side chambers 5*a*B, 5*b*B, but blocks off the hydraulic fluids from flowing in the reversed direction. With such an arrangement, the hydraulic fluids in the rod pushing-side chambers 5*a*A, 5*b*A of the boom hydraulic cylinders 5*a*, 5*b* are introduced to the rod drawing-side chambers 5*a*B, 5*b*B.

Corresponding to the above-described arrangement, the branch line 152A, which is branched from the branch line 150A associated with the boom hydraulic cylinders 5*a*, 5*b* and is connected to the drain line 101, and the boom outflow control valve 211 are omitted.

A controller 31A similar to the controller 31 in the first embodiment is provided as a control unit for the hydraulic drive system having the above-described construction. The controller 31A receives operation signals outputted from the control levers 32, 33 provided in the cab 13A of the machine body 13, and outputs command signals to not only the directional flow control valves 10*a-f*, the inflow control valves 201 to 203, the outflow control valves 212, 213, and the bypass flow control valve 204, but also the boom recovery flow control valve 221 in this embodiment.

Figure 10:
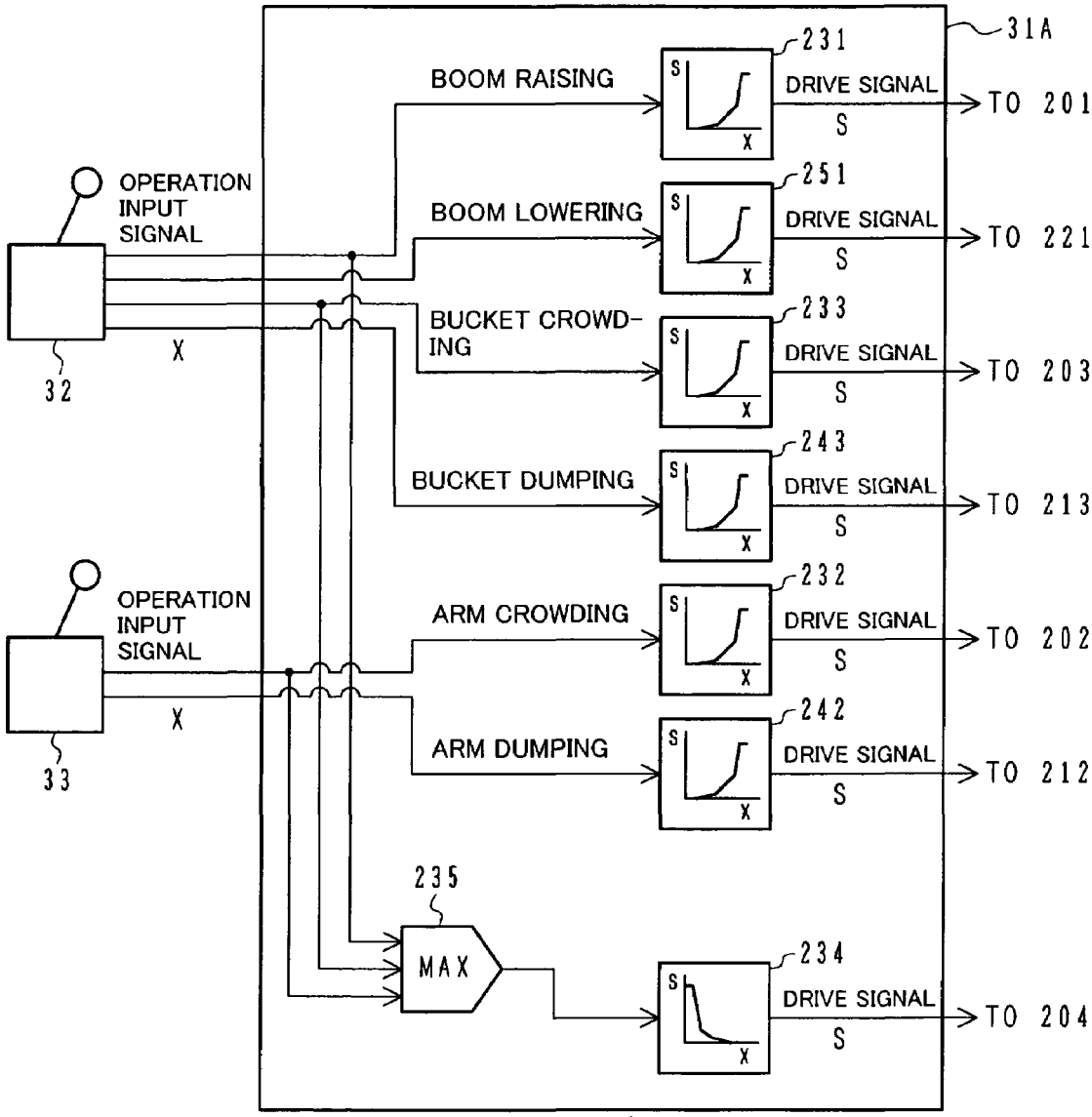
FIG. 10 is a functional block diagram showing, among detailed functions of a controller shown in FIG. 9, control functions for inflow control valves, outflow control valves, a bypass flow control valve, and a boom recovery flow control valve.

FIG. 10 is a functional block diagram showing, among detailed functions of the controller 31A, control functions for the inflow control valves 201 to 203, the outflow control valves 212, 213, the bypass flow control valve 204, and the boom recovery flow control valve 221, which constitute a principal part of this embodiment, other than general control functions of controlling the directional flow control valves 10*a* to 10*f* in response to the operation signals from the control levers 32, 33. In FIG. 10, the controller 31A in this embodiment differs from the controller 31 in the first embodiment, described above in connection with FIG. 3, in that the boom-lowering operation signal X from the control lever 32 is inputted to a boom-recovery drive signal processing unit 251. The boom-recovery drive signal processing unit 251 receives the boom-lowering operation input signal X from the control lever 32, and computes a control signal S for the boom recovery flow control valve 221 (i.e., a drive signal applied to a solenoid sector 221B thereof) based on the illustrated table, followed by outputting the computed control signal.

The operation of this embodiment thus constructed will be described below, taking as an example the operation of boom lowering, which is the most prominent feature of this embodiment, along with the operation of boom raising for the comparison purpose.

(1) Boom-Raising Operation

When the operator operates the control lever 32 in the direction corresponding to the boom raising with intent to raise the boom for, by way of example, excavation, the produced operation input signal X is applied as a boom raising command to the boom directional flow control valves 10*c*, 10*d*, thus causing their spools to shift in the corresponding directions. As a result, the hydraulic fluids from the hydraulic pumps 1*a*, 1*b* are supplied to the rod pushing-side chambers 5*a*A, 5*b*A of the boom hydraulic cylinders 5*a*, 5*b* via the-main line 105.

On the other hand, the boom-inflow drive signal processing unit 231 computes the drive signal S for the boom inflow control valve 201 in accordance with the boom-raising operation input signal X from the control lever 32 and outputs the computed drive signal S to the solenoid sector 201B of the boom inflow control valve 201. Simultaneously, in accordance with the other operation signals (i.e., the boom-lowering operation input signal, the arm-crowding and—dumping operation input signals, and the bucket-crowding and —dumping operation input signals), the corresponding drive signal processing units 232, 242, 233 and 243 also compute the corresponding solenoid drive signals S. In this case, however, because the other operations are not commanded, each of those drive signal processing units computes a reference output (i.e., a current value, e.g., substantially zero, at which the valve will not open) and outputs it. Then, the maximum value selector 235 selects a maximum one of the boom-raising operation input signal X, the arm-crowding operation input signal X, and the bucket-crowding operation input signal X from the control levers 32, 33. However, because the other operations are not commanded, the bypass drive signal processing unit 234 eventually computes the drive signal S for the bypass flow control valve 204 in accordance with the boom-raising operation input signal X from the control lever 32 and outputs the computed drive signal S to the solenoid sector 204B of the bypass flow control valve 204. As a result, the bypass flow control valve 204 for returning the hydraulic fluids delivered from the hydraulic pumps 3*a*, 3*b* to the reservoir 2 is driven to the closed side and the boom inflow control valve 201 is driven to the open side, whereupon the hydraulic fluids delivered from the hydraulic pumps 3*a*, 3*b* are supplied to the rod pushing-side chambers 5*a*A, 5*b*A of the boom hydraulic cylinders 5*a*, 5*b* via the delivery line 102, the supply line 100, the branch line 150A, and the boom inflow control valve 201.

Accordingly, the hydraulic fluids delivered from the hydraulic pumps 3*a*, 3*b* and supplied through the boom inflow control valve 201 are joined with the hydraulic fluids delivered from the hydraulic pumps 1*a*, 1*b* and supplied through the boom directional flow control valves 10*c*, 10*d*, thus causing the hydraulic fluids from the hydraulic pumps 1*a*, 1*b*, 3*a* and 3*b* to flow into the rod pushing-side chambers 5*a*A, 5*b*A of the boom hydraulic cylinders 5*a*, 5*b* at a summed-up pump delivery rate.

On that occasion, the outflow rate of the return hydraulic fluids from the rod drawing-side chambers 5*a*B, 5*b*B of the boom hydraulic cylinders 5*a*, 5*b* is about ½ of the inflow rate to the rod pushing-side chambers 5*a*A, 5*b*A thereof because a volume ratio of the rod pushing-side chamber to the rod drawing-side chamber of each cylinder is, for example, about 2:1. In other words, the outflow rate of the return hydraulic fluids is substantially equal to the inflow rate from the boom directional flow control valves 10*c*, 10*d* and can be accommodated by those directional flow control valves 10*c*, 10*d*. Hence, the return hydraulic fluids are returned to the reservoir 2 from the rod drawing-side chambers 5*a*B, 5*b*B via the main line 115 and the meter-out throttles (not shown) of the directional flow control valves 10*c*, 10*d*.

(2) Boom-Lowering Operation

When the operator operates the control lever 32 in the direction corresponding to the boom lowering with intent to lower the boom, by way of example, after loading the excavated earth, the produced operation input signal X is applied as a boom lowering command to the boom directional flow control valves 10*c*, 10*d*, thus causing their spools to shift in the corresponding directions. As a result, the hydraulic fluids from the hydraulic pumps 1*a*, 1*b* are supplied to the rod drawing-side chambers 5*a*B, 5*b*B of the boom hydraulic cylinders 5*a*, 5*b* via the main line 115.

At that time, because of the above-mentioned volume ratio of the rod pushing-side chamber to the rod drawing-side chamber, the outflow rate of the return hydraulic fluids from the rod pushing-side chambers 5*a*A, 5*b*A is about twice the inflow rate to the rod drawing-side chambers 5*a*B, 5*b*B. In this embodiment, therefore, the return hydraulic fluids corresponding to a part (e.g., about ½) of that outflow rate are returned to the reservoir 2 from the rod pushing-side chambers 5*a*A, 5*b*A via the main line 105 and the meter-out throttles (not shown) of the directional flow control valves 10*c*, 10*d*. Simultaneously, the boom-recovery drive signal processing unit 251 computes the drive signal S for the boom recovery flow control valve 221 in accordance with the boom-lowering operation signal X from the control lever 32 and outputs the computed drive signal S to the solenoid sector 221B of the boom recovery flow control valve 221. As a result, the boom recovery flow control valve 221 is driven to the open side. On this occasion, because holding pressures are generated in the rod pushing-side chambers 5*a*A, 5*b*A of the boom hydraulic cylinders 5*a*, 5*b* due to the dead load of the boom 75, the remaining part of the hydraulic fluids from the rod pushing-side chambers 5*a*A, 5*b*A is introduced (recovered) to the rod drawing-side chambers 5*a*B, 5*b*B through the check valve 222 and the boom recovery flow control valve 221 upon opening of the boom recovery flow control valve 221.

With this embodiment thus constructed, as with the above first embodiment, when forming hydraulic fluid supply routes not passing the directional flow control valves 10*a-f* to supply the hydraulic fluid at a large flow rate in a backhoe type hydraulic excavator of an super-large class, the branch line 150A leading to the rod pushing-side chambers 5*a*A, 5*b*A of the boom hydraulic cylinders is first branched from the supply line 100 serving as the common high-pressure line which is connected the delivery sides of the hydraulic pumps 3*a*, 3*b* and extended to the side of the front operating mechanism 14. Then, the branch line 150B leading to the rod pushing-side chamber 6A of the arm hydraulic cylinder is branched from the supply line 100 at a position downstream of the position at which the branch line 150A is branched, and the remaining part of the supply line 10 is constituted as the branch line 150C leading to the rod pushing-side chamber 7A of the bucket hydraulic cylinder. Further, the boom inflow control valve 201, the arm inflow control valve 202, and the bucket inflow control valve 203 are disposed respectively in the branch lines 150A, 150B and 150C to control the flows of the hydraulic fluids from the supply line 100 to the hydraulic cylinders 5 to 7.

When supplying the hydraulic fluids to the respective rod pushing-side chambers 5*a*A, 5*b*A, 6A and 7A of the hydraulic cylinders 5 to 7 to perform the boom-raising, arm-crowding and bucket-crowding operations, in addition to the ordinary supply of the hydraulic fluids to the respective rod pushing-side chambers 5*a*A, 5*b*A, 6A and 7A of the hydraulic cylinders 5 to 7 through the directional flow control valves 10*a-f*, the hydraulic fluids from the hydraulic pumps 3*a*, 3*b* are joined with the hydraulic fluids, which are supplied through the directional flow control valves 10*a-f*, through the inflow control valves 201 to 203 without passing the directional flow control valves 10*a-f*. The joined hydraulic fluids are then supplied to the respective rod pushing-side chambers 5*a*A, 5*b*A, 6A and 7A of the hydraulic cylinders 5 to 7. The return hydraulic fluids in this case are drained to the reservoir only via routes through the directional flow control valves 10*a-f*.

On the other hand, when supplying the hydraulic fluids to the respective rod drawing-side chambers of the hydraulic cylinders 5 to 7 to perform, e.g., the boom-lowering, arm-dumping and bucket-dumping operations, the hydraulic fluids are supplied from the hydraulic pumps 1*a*, 1*b* to the respective rod drawing-side chambers 5*a*B, 5*b*B, 6B and 7B of the hydraulic cylinders 5 to 7 through the directional flow control valves 10*a-f*.

Thus, in consideration of the volume differences between the rod pushing-side chambers 5*a*A, 5*b*A, 6A and 7A and the rod drawing-side chambers 5*a*B, 5*b*B, 6B and 7B of the hydraulic cylinders 5 to 7, only the inflow control valves 201, 202 and 203 in the bottom-side branch lines 150A-C are additionally provided to achieve the supply of the hydraulic fluid at a large flow rate, while rod-side inflow control valves are omitted, whereby the pressure loss caused by the flow control valves can be reduced correspondingly. Also, since piping required for installation of the flow control valves is omitted and hence an accompanying pressure loss is eliminated, the pressure loss of the overall hydraulic drive system can be further reduced. In addition, with a reduction in the number of the flow control valves, it is possible to simplify layouts including routing of various pipes and arrangements of various units, particularly layouts of hydraulic piping between the hydraulic pumps 3*a*, 3*b* as hydraulic sources and the hydraulic cylinders 5*a*, 5*b*, 6 and 7.

Especially in this embodiment, as described in above (2), a total flow rate of the return hydraulic fluids from the rod pushing-side chambers 5*a*A, 5*b*A of the boom hydraulic cylinders 5*a*, 5*b* during the boom-lowering operation is accommodated as a flow rate ordinarily drained to the reservoir 2 through the meter-out throttles of the directional flow control valves 10*c*, 10*d* and a flow rate recovered to the rod drawing-side chambers 5*a*B, 5*b*B through the boom recovery flow control valve 221. With such an arrangement, regarding the boom hydraulic cylinders 5*a*, 5*b*, a part of the return hydraulic fluids (extra flows to be drained) from the rod drawing-side chambers 5*a*B, 5*b*B is effectively utilized as a recovery flow. It is therefore possible to omit an outflow control valve having a large capacity and an associated outflow line adapted for a large flow rate, which correspond to the arm outflow control valve 212, the branch line 152B, the bucket outflow control valve 213, and the branch line 151C. As a result, the pressure loss is reduced correspondingly and hence the pressure loss of the overall hydraulic drive system can be further reduced. In addition, further omission of the boom outflow control valve enables the layouts of the hydraulic piping to be further simplified.

While the above description is made of, by way of example, the case of recovering the return hydraulic fluids for the boom hydraulic cylinders 5*a*, 5*b* from the rod pushing-side chambers 5*a*A, 5*b*A to the rod drawing-side chambers 5*a*B, 5*b*B, the present invention is not limited to that arrangement. The return hydraulic fluid may be recovered from the rod drawing-side chamber to the rod pushing-side chamber in a similar manner for the arm hydraulic cylinder 6 and the bucket hydraulic cylinder 7 with omission of the arm outflow control valve 212, the branch line 152B, the bucket outflow control valve 213, and the branch line 152C. These modifications can also provide similar advantages to those described above.

A sixth embodiment of the present invention will be described with reference to FIGS. 11 and 12. This embodiment represents the case in which the return hydraulic fluids are recovered in a loader type super-large-sized hydraulic excavator like the above fifth embodiment.

Figure 11:
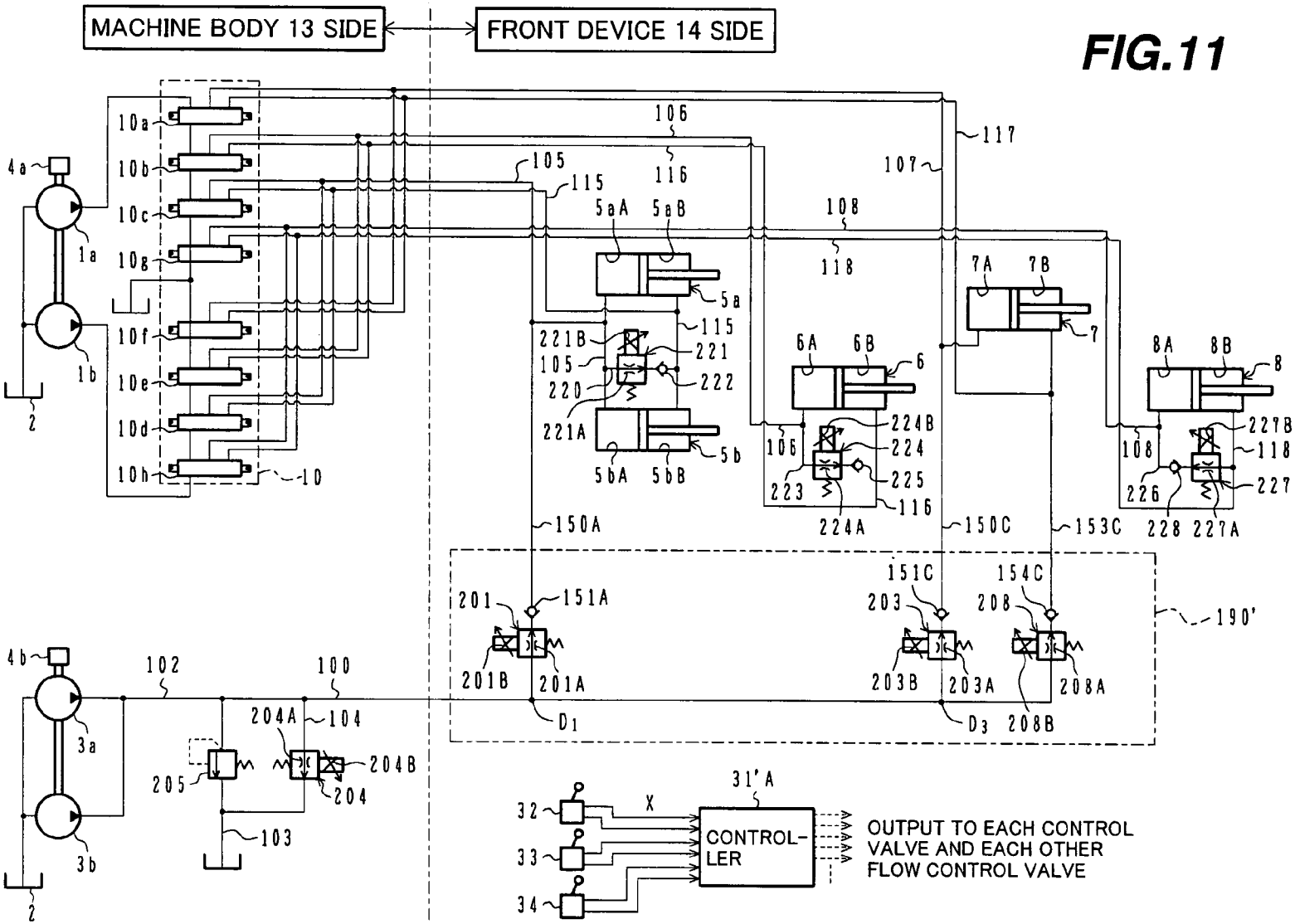
FIG. 11 is a hydraulic circuit diagram showing the overall construction of a hydraulic drive system according to a sixth embodiment of the present invention along with a control system for it.

FIG. 11 is a hydraulic circuit diagram showing the overall construction of a hydraulic drive system according to this embodiment along with a control system for it. Identical components to those in the second and fifth embodiments are denoted by the same symbols, and a description of those components is omitted here as appropriate.

In FIG. 11, the hydraulic drive system of this embodiment is applied to the loader type hydraulic excavator, shown in FIG. 5, described above in the second embodiment. The hydraulic drive system of this embodiment differs from the hydraulic drive system, shown in FIG. 9, described above in the fifth embodiment as follows. First, as an additional cylinder, a bucket opening/closing hydraulic cylinder 8 similar to that used in the second embodiment is further provided which is supplied with the hydraulic fluids from the hydraulic pumps 1*a*, 1*b*. Correspondingly, the hydraulic pump 1*a* is connected to the bucket opening/closing hydraulic cylinder 8 through a first bucket opening/closing directional flow control valve 10*g*, and the hydraulic pump 1*b* is connected to the bucket opening/closing hydraulic cylinder 8 through a second bucket opening/closing directional flow control valve 10*h*. These directional flow control valves 10*g*, 10*h* constitute the directional flow control valve group 10 together with the above-mentioned directional flow control valves 10*a* to 10*f*. Further, a rod pushing-side chamber 8A of the bucket opening/closing hydraulic cylinder 8 is connected to the first and second bucket opening/closing directional flow control valves 10*g*, 10*h* via a main line 108, and a rod drawing-side chamber 8B of the bucket opening/closing hydraulic cylinder 8 is connected to the first and second bucket opening/closing directional flow control valves 10*g*, 10*h* via a main line 118.

Further, among the branch lines 150A, 150B and 150C branched, in the above fifth embodiment, from the other side of the supply line 100 having one end (left side as viewed in the drawing) connected to the delivery line 102 of the hydraulic pumps 3*a*, 3*b*, the branch line 150B and the arm inflow control valve 202 both associated with the arm hydraulic cylinder 6 are omitted in this sixth embodiment. This omission is based on the meaning given below. In the case of the loader type hydraulic excavator, unlike the backhoe type, ports of the arm hydraulic cylinder 6 are positioned closer to the machine body 13 than those in the boom hydraulic cylinders 5*a*, 5*b* from its specific structure (see FIG. 5). As a result, the lines 106, 116 extending from the ordinary arm control valves 10*b*, 10*e* to the arm hydraulic cylinder 6 can be set relatively short and can be easily constructed. In some cases, therefore, the merit resulting from the provision of the arm inflow control valve for supplying the hydraulic fluid at a large flow rate without passing the ordinary control valves is not so significant.

As another major feature of this embodiment, in addition to the recovery line 220, the boom recovery flow control valve 221 and the check valve 222 which are disposed for the boom hydraulic cylinders 5*a*, 5*b* in the above fourth-embodiment, a similar arrangement is also provided for the arm hydraulic cylinder 6. More specifically, the connecting line 106 connected to the rod pushing-side chamber 6A of the arm hydraulic cylinder 6 and the connecting line 116 connected to the rod drawing-side chamber 6B thereof are connected to each other via a recovery line 223. In the recovery line 223, an arm recovery flow control valve 224 is disposed which is constituted as, e.g., a solenoid proportional valve and includes a variable throttle 224A for controlling the flow of the hydraulic fluid from the rod pushing-side chamber 6A of the arm hydraulic cylinder 6 to the rod drawing-side chamber 6B thereof to a desired throttled flow rate. Further, on the side of the arm recovery flow control valve 224 nearer to the rod drawing-side chamber 6B, a check valve 225 is disposed which allows the hydraulic fluid to flow from the rod pushing-side chamber 6A to the rod drawing-side chambers 6B, but blocks off the hydraulic fluid from flowing in the reversed direction. With such an arrangement, the hydraulic fluid in the rod pushing-side chamber 6A of the arm hydraulic cylinder 6 is introduced to the rod drawing-side chamber 6B. It is hence possible to omit the branch line 152B and the outflow control valve 212 both associated with the arm hydraulic cylinder 6, which are provided in the fifth embodiment shown in FIG. 9.

That omission is based on the meaning given below. In the case of the loader type hydraulic excavator, unlike the backhoe type, a holding pressure is always generated in the rod pushing-side chamber 6A of the arm hydraulic cylinder due to the dead load of the arm 6 from its specific structure. Therefore, the arrangement of providing the arm recovery flow control valve 224 and introducing (recovering) the hydraulic fluid drained from the rod pushing-side chamber 6A to the rod drawing-side chamber 6B is simpler and more effective than providing the outflow control valve.

In addition, based on the above-described features, no recovery flow control valve is provided for the bucket 77 (because, in spite of the loader type, a holding pressure is not always generated in the rod pushing-side chamber 7A for the bucket 77 depending on the posture of the front operating mechanism 14 unlike the arm 75 and the arm 76) so that the flow rate of the drained hydraulic fluid is all absorbed by the directional flow control valves 10*g*, 10*h*. Thus, the branch line 152C and the outflow control valve 213 both associated with the bucket hydraulic cylinder 7, which are provided in the fifth embodiment, are omitted. As a result, it is possible to omit the low-pressure drain line 101 which is provided in the fifth embodiment and has one side (left side as viewed in the drawing) connected to the reservoir line 103 for introducing the return hydraulic fluid to the hydraulic reservoir 2.

Moreover, for the bucket hydraulic cylinder 7, a branch line 153C is additionally branched from the other side of the supply line 100 (at a position D3 where it is also branched from the line 150C). In this branch line 153C, a bucket inflow control valve 208 is disposed which is constituted as, e.g., a solenoid proportional valve with a pressure compensating function and includes a variable throttle 208A for controlling the flow of the hydraulic fluids from the hydraulic pumps 3*a*, 3*b* to the rod drawing-side chamber 7B of the bucket hydraulic cylinder 7 to a desired flow rate. Further, on the side of the bucket inflow control valve 208 nearer to the bucket hydraulic cylinder 7, a check valve 154C is disposed which allows the hydraulic fluid to flow from the hydraulic pumps 3*a*, 3*b* to the rod drawing-side chambers 7B of the bucket hydraulic cylinder, but blocks off the hydraulic fluid from flowing in the reversed direction.

On the other hand, for the bucket opening/closing hydraulic cylinder 8, a circuit arrangement is added to provide a different recovery function (operating in the reversed direction) from those for the boom hydraulic cylinders 5*a*, 5*b* and the arm hydraulic cylinder 6. More specifically, the connecting line 108 connected to the rod pushing-side chamber 8A of the bucket opening/closing hydraulic cylinder 8 and the connecting line 118 connected to the rod drawing-side chamber 8B thereof are connected to each other via a recovery line 226. In the recovery line 226, a bucket opening/closing recovery flow control valve 227 is disposed which is constituted as, e.g., a solenoid proportional valve and includes a variable throttle 227A for controlling the flow of the hydraulic fluid from the rod drawing-side chamber 8B of the bucket opening/closing hydraulic cylinder 8 to the rod pushing-side chamber 8A thereof to a desired throttled flow rate. Further, on the side of the bucket opening/closing recovery flow control valve 227 nearer to the rod pushing-side chamber 8A, a check valve 228 is disposed which allows the hydraulic fluid to flow from the rod drawing-side chamber 8B to the rod pushing-side chambers 8A, but blocks off the hydraulic fluid from flowing in the reversed direction. With such an arrangement, the hydraulic fluid in the rod drawing-side chamber 8B of the bucket opening/closing hydraulic cylinder 8 is introduced to the rod pushing-side chamber 8A.

The inflow control valves 201, 203 and 208 and the check valves 151A, 151C and 154C are disposed together in one control valve unit 190' (though not shown, at the same position as the control valve unit 190 in FIG. 5) which is mounted to the upper surface (back surface) of the boom 75. Then, the supply line 100, the branch lines 150A, 150C and 153C, the inflow control valves 201, 203 and 208, the check valves 151A, 151C and 154C, the recovery flow control valves 221, 224 and 227, and the check valves 222, 225 and 228 are disposed on the front operating mechanism 14.

A controller 31'A provided as a control unit for the hydraulic drive system having the above-described construction receives operation signals outputted from the control levers 32, 33 and the control lever 34 additionally provided as in the second embodiment, and outputs command signals to the directional flow control valves 10*a-h*, the inflow control valves 201, 203 and 208, the bypass flow control valve 204, the boom recovery flow control valve 221, the arm recovery flow control valve 224, and the bucket opening/closing recovery flow control valve 227.

Figure 12:
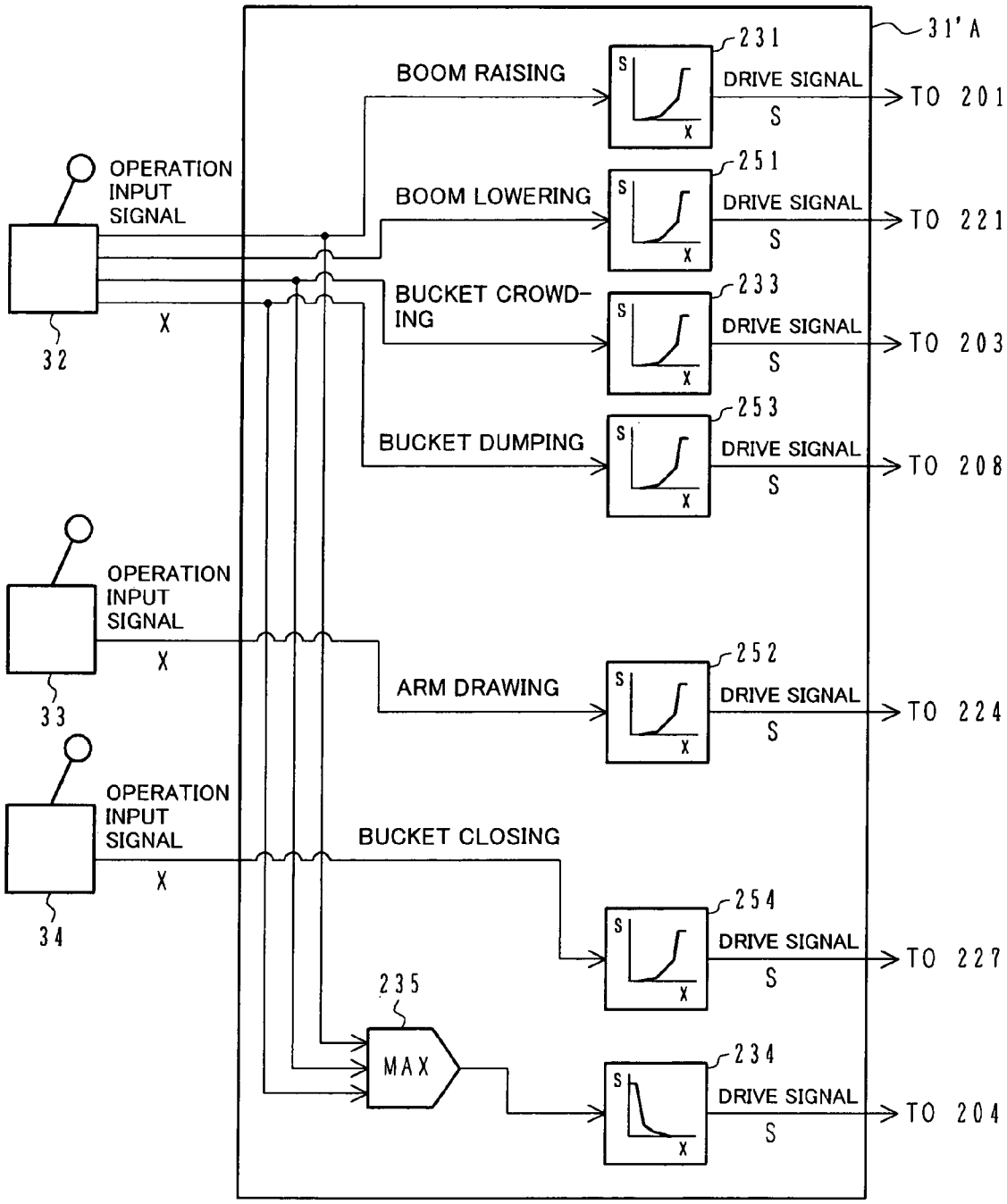
FIG. 12 is a functional block diagram showing among detailed functions of a controller shown in FIG. 11, control functions for inflow control valves, outflow control valves, a bypass flow control valve, and a boom recovery flow control valve.

FIG. 12 is a functional block diagram showing, among detailed functions of the controller 31'A, control functions for the inflow control valves 201, 203 and 208, the bypass flow control valve 204, the boom recovery flow control valve 221, the arm recovery flow control valve 224, and the bucket opening/closing recovery flow control valve 227, which constitute a principal part of this embodiment, other than general control functions of controlling the directional flow control valves 10*a* to 10*f* in response to the operation signals from the control levers 32, 33 and 34. As shown in FIG. 12, the controller 31'A does not include the drive signal processing unit 232 for the arm inflow control valve 202, the drive signal processing unit 242 for the arm outflow control valve 212, and the drive signal processing unit 243 for the bucket outflow control valve 213, which are provided in the controller 31' in the fifth embodiment. In contrast, a drive signal processing unit 253 for the bucket inflow control valve 208, a drive signal processing unit 252 for the arm recovery flow control valve 224, and a drive signal processing unit 254 for the bucket opening/-closing recovery flow control valve 227 are newly provided in the controller 31'A.

The bucket-inflow drive signal processing unit 253 receives a bucket-dumping operation input signal X from the control lever 32, and computes a control signal S for the bucket inflow control valve 208 (i.e., a drive signal applied to a solenoid sector 208B thereof) based on the illustrated table, followed by outputting the computed control signal. At this time, a maximum one of the boom-raising operation input signal X, the bucket-crowding operation input signal X, and the bucket-dumping operation input signal X from the control levers 32, 33 is selected by the maximum value selector 235 and then inputted to the bypass drive signal processing unit 234. The bypass drive signal processing unit 234 computes a control signal S for the bypass flow control valve 204 (i.e., a drive signal applied to a solenoid sector 204B thereof) based on the illustrated table and outputs the computed control signal.

On the other hand, the arm-recovery drive signal processing unit 252 receives an arm-drawing operation input signal X from the control lever 33, and computes a control signal S for the arm recovery flow control valve 224 (i.e., a drive signal applied to a solenoid sector 224B thereof) based on the illustrated table, followed by outputting the computed control signal. Also, the bucket opening/closing recovery drive signal processing unit 254 receives a bucket-closing operation input signal X from the control lever 34, and computes a control signal S for the bucket opening/-closing recovery flow control valve 227 (i.e., a drive signal applied to a solenoid sector 227B thereof) based on the illustrated table, followed by outputting the computed control signal.

The operation of this embodiment thus constructed will be described below, taking as an example the operations of boom lowering and arm drawing.

The loader type hydraulic excavator to which this embodiment is applied operates in a typical case as follows. From a condition where the front operating mechanism 14 is positioned close to the machine body 13 in a folded state, the boom-raising, arm-pushing and bucket-crowding operations are performed to scoop earth and sand in front of the front operating mechanism into the bucket 77. Then, the bucket 77 is elevated to a high level immediately after the scooping, and the bucket opening portion 77B is opened relative to the bucket base portion 77A so that the earth and sand in the bucket 77 is released onto, e.g., a large-sized dump truck. Thereafter, the front operating mechanism 14 is returned to the initial folded state positioned close to the machine body 13 through substantially simultaneous operations of not only bucket closing and bucket dumping, but also boom lowering and arm drawing.

The features of this embodiment are typically usefully employed, in particular, in the operations of boom lowering and arm drawing after releasing the scooped earth. These operations of boom lowering and arm drawing will be described below.

When the operator operates the control lever 32 in the direction corresponding to the boom lowering with intent to lower the boom, for example, after releasing the scooped earth, the produced operation input signal X is applied as a boom lowering command to the boom directional flow control valves 10*c*, 10*d*, thus causing their spools to shift in the corresponding directions. As a result, the hydraulic fluids from the hydraulic pumps 1*a*, 1*b* are supplied to the rod drawing-side chambers 5*a*B, 5*b*B of the boom hydraulic cylinders 5*a*, 5*b* via the main line 115.

At that time, as in the above first embodiment, the return hydraulic fluids corresponding to a part (e.g., about ½) of the outflow rate from the rod pushing-side chambers 5*a*A, 5*b*A of the boom hydraulic cylinders are returned to the reservoir 2 from the rod pushing-side chambers 5*a*A, 5*b*A thereof via the main line 105 and the meter-out throttles (not shown) of the directional flow control valves 10*c*, 10*d*. Simultaneously, the boom-recovery drive signal processing unit 251 computes the drive signal S for the boom recovery flow control valve 221 in accordance with the boom-lowering operation signal X from the control lever 32 and outputs the computed drive signal S to the solenoid sector 221B of the boom recovery flow control valve 221. As a result, the boom recovery flow control valve 221 is driven to the open side. On this occasion, because holding pressures are applied to the rod pushing-side chambers 5*a*A, 5*b*A of the boom hydraulic cylinders 5*a*, 5*b* due to the dead load of the boom 75, the remaining part of the hydraulic fluids from the rod pushing-side chambers 5*a*A, 5*b*A is introduced (recovered) to the rod drawing-side chambers 5*a*B, 5*b*B through the check valve 222 and the boom recovery flow control valve 221 upon opening of the boom recovery flow control valve 221.

Also, when the operator-operates the control lever 32 in the direction corresponding to the arm drawing with intent to draw the arm, for example, after releasing the scooped earth, the produced operation input signal X is applied as an arm drawing command to the arm directional flow control valves 10*b*, 10*e*, thus causing their spools to shift in the corresponding directions. As a result, the hydraulic fluids from the hydraulic pumps 1*a*, 1*b* are supplied to the rod drawing-side chamber 6B of the arm hydraulic cylinder 6 via the main line 116.

At that time, as in the above case, the return hydraulic fluid corresponding to a part (e.g., about ½) of the outflow rate from the rod pushing-side chamber 6A of the arm hydraulic cylinder is returned to the reservoir 2 from the rod pushing-side chamber 6A via the main line 106 and the meter-out throttles (not shown) of the directional flow control valves 10*b*, 10*e*. Simultaneously, the arm-drawing drive signal processing unit 252 computes the drive signal S for the arm recovery flow control valve 224 in accordance with the arm-drawing operation signal X from the control lever 33 and outputs the computed drive signal S to the solenoid sector 227B of the arm recovery flow control valve 224. As a result, the arm recovery flow control valve 224 is driven to the open side. On this occasion, because a holding pressure is applied to the rod pushing-side chamber 6A of the arm hydraulic cylinder 6 due to the dead load of the arm 76, the remaining part of the hydraulic fluid from the rod pushing-side chamber 6A is introduced (recovered) to the rod drawing-side chamber 6B through the check valve 225 and the arm recovery flow control valve 224 upon opening of the arm recovery flow control valve 224.

With this embodiment thus constructed, as with the above fifth embodiment, when forming hydraulic fluid supply routes not passing the directional flow control valves 10*a-h* to supply the hydraulic fluid at a large flow rate in a loader type hydraulic excavator of an super-large class, the branch line 150A leading to the rod pushing-side chambers 5*a*A, 5*b*A of the boom hydraulic cylinders is first branched from the supply line 100 serving as the common high-pressure line which is connected the delivery sides of the hydraulic pumps 3*a*, 3*b* and extended to the side of the front operating mechanism 14. Then, the remaining part of the supply line 100 downstream of the position at which the branch line 150A is branched is constituted as the branch line 150C leading to the rod pushing-side chamber 7A of the bucket hydraulic cylinder. Further, the boom inflow control valve 201 and the bucket inflow control valve 203 are disposed respectively in the branch lines 150A, 150C to control the flows of the hydraulic fluids from the supply line 100 to the hydraulic cylinders 5, 7.

When supplying the hydraulic fluids to the respective rod pushing-side chambers 5*a*A, 5*b*A and 7A of the hydraulic cylinders 5, 7—to perform the boom-raising and bucket-crowding operations, in addition to the ordinary supply of the hydraulic fluids to the respective rod pushing-side chambers 5*a*A, 5*b*A and 7A of the hydraulic cylinders 5, 7 through the directional flow control valves 10*a-h*, the hydraulic fluids from the hydraulic pumps 3*a*, 3*b* are joined with the hydraulic fluids, which are supplied through the directional flow control valves 10*a-h*, through the inflow control valves 201, 203 without passing the directional flow control valves 10*a-h*. The joined hydraulic fluids are then supplied to the respective rod pushing-side chambers 5*a*A, 5*b*A and 7A of the hydraulic cylinders 5, 7. The return hydraulic fluids in this case are drained to the reservoir only via routes through the directional flow control valves 10*a-h*.

Thus, in this embodiment, the hydraulic circuit is simplified as follows. Regarding the inflow control valves, as in the fifth embodiment described above, in consideration of the volume differences between the rod pushing-side chambers 5*a*A, 5*b*A and the rod drawing-side chambers 5*a*B, 5*b*B of the boom hydraulic cylinders 5*a*, 5*b*, only the inflow control valve 201 in the branch line 150A associated with the rod pushing side (bottom side) is additionally provided to achieve the supply of the hydraulic fluid at a large flow rate, while the inflow control valves on the rod drawing side are omitted. For the bucket hydraulic cylinder 7, unlike the fifth embodiment, the inflow control valve 208 for supplying the hydraulic fluid to the rod drawing-side chamber 7B of the bucket hydraulic cylinder 7 is additionally provided. However, because the inflow control valve associated with the rod pushing side of the arm hydraulic cylinder 6 is omitted in consideration of the structure specific to the loader type hydraulic excavator as described above, the total number of the inflow control valves is the same. On the other hand, as described above, this embodiment realizes the structure including no outflow control valves. As a result, the total number of the inflow and outflow control valves is greatly reduced from five (i.e., the flow control valves 201, 202, 203, 212 and 213) in the fifth embodiment to three (i.e., the flow control valves 201, 203 and 208). Correspondingly, the pressure loss caused by the flow control valves can be reduced. Also, since piping required for installation of the flow control valves is omitted and hence an accompanying pressure loss is eliminated, the pressure loss of the overall hydraulic drive system can be further reduced. In addition, with a reduction in the number of the flow control valves, it is possible to further simplify layouts including routing of various pipes and arrangements of various units.

A seventh embodiment of the present invention will be described with reference to FIG. 13. This embodiment represents the case in which the present invention is applied to a loader type super-large-sized hydraulic excavator of a class having a dead load of 800 tons, for example, which is even larger than that described in the above sixth embodiment. Identical components to those in the above second and sixth embodiments are denoted by the same symbols, and a description of those components is omitted here as appropriate.

Figure 13:
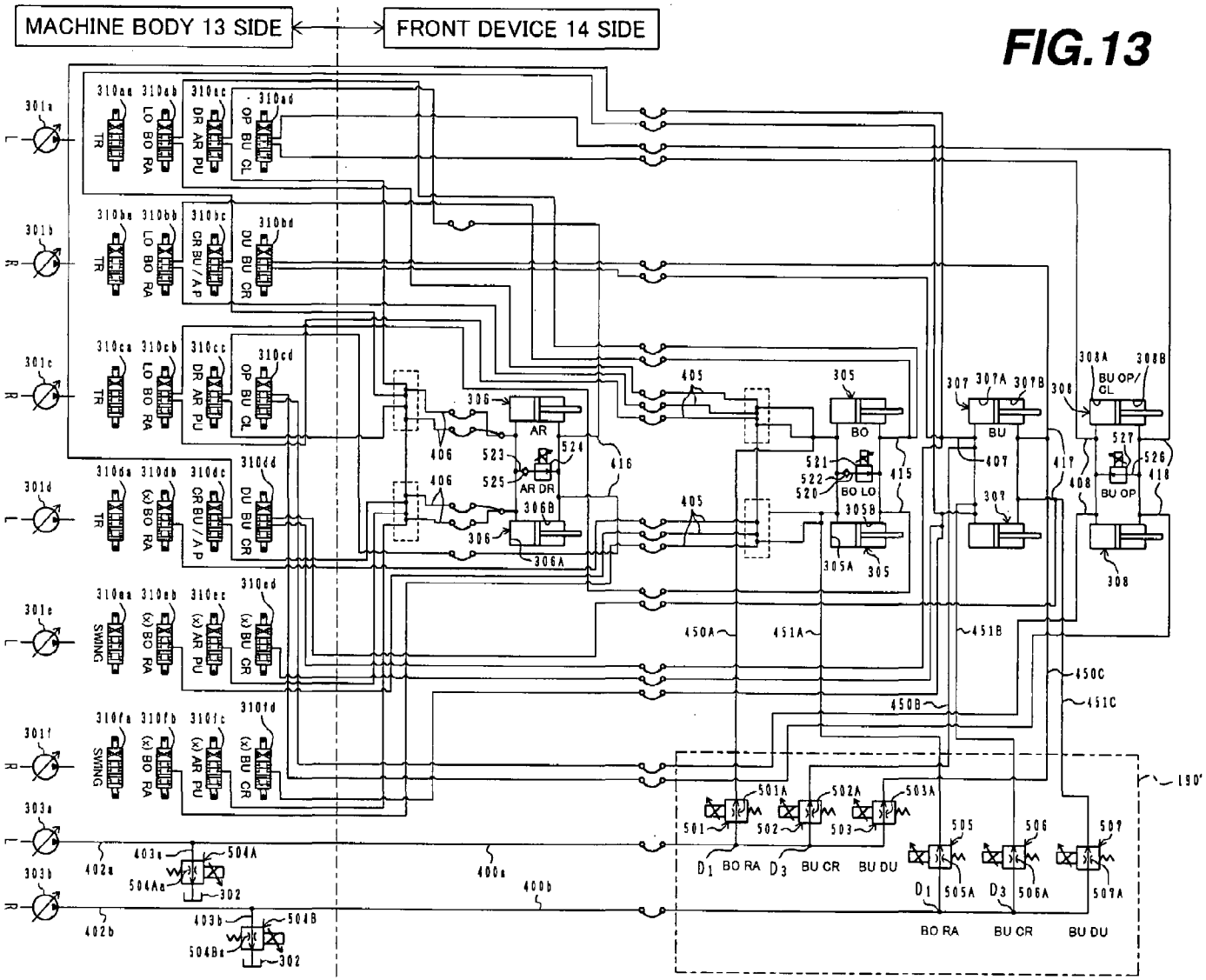
FIG. 13 is a hydraulic circuit diagram showing the overall construction of a hydraulic drive system according to a seventh embodiment of the present invention.

FIG. 13 is a hydraulic circuit diagram showing the overall construction of a hydraulic drive system according to this embodiment.

Referring to FIG. 13, the hydraulic drive system of this embodiment comprises eight hydraulic pumps 301*a*, 301*b*, 301*c*, 301*d*, 301*e*, 301*f*, 303*a* and 303*b* driven by a not-shown first engine (prime mover) or second engine, boom hydraulic cylinders 305, 305, arm hydraulic cylinders 306, 306, bucket hydraulic cylinders 307, 307, bucket opening/closing hydraulic cylinders 308, 308, left and right travel hydraulic motors (not shown), and a swing hydraulic motor (not shown) which are supplied with hydraulic fluids delivered from the hydraulic pumps 301*a-f*, 303*a* and 303*b*, and a hydraulic reservoir 302.

Of the hydraulic pumps 301*a-f*, 303*a* and 303*b*, for example, the hydraulic pumps 301*a*, 301*d*, 301*e* and 303*a* are driven by the first engine (not shown) disposed on the left side of a machine body 13, and the hydraulic pumps 301*b*, 301*c*, 301*f* and 303*b* are driven by the second engine (not shown) disposed on the right side of the machine body 13 (allocation of the hydraulic pumps with respect to the engines is not limited to the above-described one, and may be set as appropriate in consideration of horsepower distribution, etc.).

The hydraulic pump 301*a* is connected to the left or right travel hydraulic motor, the boom hydraulic cylinders 305, 305, the arm hydraulic cylinder 306, 306, and the bucket opening/closing hydraulic cylinders 308, 308 through a first travel directional flow control valve 310*aa*, a first boom directional flow control valve 310*ab*, a first arm directional flow control valve 310*ac*, and a first bucket opening/closing directional flow control valve 310*ad*, respectively.

The hydraulic pump 301*b* is connected to the left or right travel hydraulic motor, the boom hydraulic cylinders 305, 305, rod pushing-side chambers 307A, 307A of the bucket hydraulic cylinders 307, 307, rod pushing-side chambers 306A, 306A of the arm hydraulic cylinders 306, 306, and the bucket hydraulic cylinders 307, 307 through a second travel directional flow control valve 310*ba*, a second boom directional flow control valve 310*bb*, a first bucket-crowding/arm-pushing directional flow control valve 310*bc*, and a first bucket directional flow control valve 310*bd*, respectively.

The hydraulic pump 301*c* is connected to the left or right travel hydraulic motor, the boom hydraulic cylinders 305, 305, the arm hydraulic cylinder 306, 306, and the bucket opening/closing hydraulic cylinders 308, 308 through a third travel directional flow control valve 310*ca*, a third boom directional flow control valve 310*cb*, a second arm directional flow control valve 310*cc*, and a second bucket opening/closing directional flow control valve 310*cd*, respectively.

The hydraulic pump 301*d* is connected to the left or right travel hydraulic motor, rod pushing-side chambers 305A, 305A of the boom hydraulic cylinders 305, 305, the rod pushing-side chambers 307A, 307A of the bucket hydraulic cylinders 307, 307, the rod pushing-side chambers 306A, 306A of the arm hydraulic cylinders 306, 306, and the bucket hydraulic cylinders 307, 307 through a fourth travel directional flow control valve 310*da*, a first boom-raising directional flow control valve 310*db*, a second bucket-crowding/arm-pushing directional flow control valve 310*dc*, and a second bucket directional flow control valve 310*dd*, respectively.

The hydraulic pump 301*e* is connected to the swing hydraulic motor, the rod pushing-side chambers 305A, 305A of the boom hydraulic cylinders 305, 305, the rod pushing-side chambers 306A, 306A of the arm hydraulic cylinders 306, 306, and the rod pushing-side chambers 307A, 307A of the bucket hydraulic cylinders 307, 307 through a first swing directional flow control valve 310*ea*, a second boom-raising directional flow control valve 310*eb*, a first arm-pushing directional flow control valve 310*ec*, and a first bucket-crowding directional flow control valve 310*ed*, respectively.

The hydraulic pump 301*f* is connected to the swing hydraulic motor, the rod pushing-side chambers 305A, 305A of the boom hydraulic cylinders 305, 305, the rod pushing-side chambers 306A, 306A of the arm hydraulic cylinders 306, 306, and the rod pushing-side chambers 307A, 307A of the bucket hydraulic cylinders 307, 307 through a second swing directional flow control valve 310*fa*, a third boom-raising directional flow control valve 310*fb*, a second arm-pushing directional flow control valve 310*fc*, and a second bucket-crowding directional flow control valve 310*fd*, respectively.

Those directional flow control valves 310*aa-fd* are grouped into sets each comprising four valves to constitute a valve block per corresponding pump. More specifically, the directional flow control valves 310*aa*, 310*ab*, 310*ac* and 310*ad* associated with the hydraulic pump 301*a*, the directional flow control valves 310*ba*, 310*bb*, 310*bc* and 310*bd* associated with the hydraulic pump 301*b*, the directional flow control valves 310*ca*, 310*cb*, 310*cc* and 310*cd* associated with the hydraulic pump 301*c*, the directional flow control valves 310*da*, 310*db*, 310*dc* and 310*dd* associated with the hydraulic pump 301*d*, the directional flow control valves 310*ea*, 310*eb*, 310*ec* and 310*ed* associated with the hydraulic pump 301*e*, and the directional flow control valves 310*fa*, 310*fb*, 310*fc* and 310*fd* associated with the hydraulic pump 301*f* constitute valve blocks in one-to-one relation (six sets in total).

The rod pushing-side chambers 305A, 305A of the boom hydraulic cylinders 305, 305 are connected to the first to third boom directional flow control valves 310*ab*, 310*bb*, 310*cb* and the first to third boom-raising directional flow control valves 310*db*, 310*eb*, 310*fb* via respective main lines 405. Also, rod drawing-side chambers 305B, 305B of the boom hydraulic cylinders 305, 305 are connected to the first, second and third boom directional flow control valves 310*ab*, 310*bb* and 310*cb* via respective main lines 415.

The rod pushing-side chambers 306A, 306A of the arm hydraulic cylinders 306, 306 are connected to the first and second arm-pushing directional flow control valves 310*ec*, 310*fc* and the first and second bucket-crowding/arm-pushing directional flow control valves 310*bc*, 310*dc* via respective main lines 406. Also, rod drawing-side chambers 306B, 306B of the arm hydraulic cylinders 306, 306 are connected to the first and second arm directional flow control valves 310*ac*, 310*cc* via respective main lines 416.

The rod pushing-side chambers 307A, 307A of the bucket hydraulic cylinders 307, 307 are connected to the first and second bucket directional flow control valves 310*bd*, 310*dd*, the first and second bucket-crowding directional flow control valves 310*ed*, 310*fd*, and the first and second bucket-crowding/arm-pushing directional flow control valves 310*bc*, 310*dc* via respective main lines 407. Rod drawing-side chambers 307B, 307B of the bucket hydraulic cylinders 307, 307 are connected to the first and second bucket directional flow control valves 310*bd*, 310*dd* via respective main lines 417.

Rod pushing-side chambers 308A, 308A of the bucket opening/closing hydraulic cylinders 308, 308 are connected to the first and second bucket opening/closing directional flow control valves 310*ad*, 310*cd* via main lines 408. Rod drawing-side chambers 308B, 308B of the bucket opening/closing hydraulic cylinders 308, 308 are connected to the first and second bucket opening/closing directional flow control valves 310*ad*, 310*cd* via main lines 418.

The hydraulic pump 303*a* is connected to the main lines 405, 407 and 417 via a delivery line 402*a* to which the hydraulic fluid delivered from the hydraulic pump 303*a* is introduced, then via a supply line 400*a* connected at one side (left side as viewed in the drawing) thereof to the delivery line 402*a*, and then via branch lines 450A, 450B and 450C branched from the other side of the supply line 400*a*.

In the branch lines 450A, 450B and 450C, there are disposed respectively a boom inflow control valve 501 and bucket inflow control valves 502, 503 which are each constituted as, e.g., a solenoid proportional valve with a pressure compensating function and include respectively variable throttles 501A, 502A and 503A for controlling flows of the hydraulic fluid supplied from the hydraulic pump 303*a* to the rod pushing-side chamber 305A of each boom hydraulic cylinder, the rod pushing-side chamber 307A of each bucket hydraulic cylinder, and the rod drawing-side chamber 307B of each bucket hydraulic cylinders to desired throttled rates. On the sides of the inflow control valve 501, 502 and 503 nearer to the hydraulic cylinders 305, 306 and 307, though not shown, check valves are disposed respectively which allow the hydraulic fluid to flow from the hydraulic pump 303*a* to the rod pushing-side chamber 305A of each boom hydraulic cylinder and the rod pushing-side chamber 307A and the rod drawing-side chamber 307B of each bucket hydraulic cylinder, but block off the hydraulic fluid flowing in the reversed direction.

In this respect, a reservoir line 403*a* is branched from the supply line 400*a* (or the delivery line 402*a* as required). In this reservoir line 403*a*, a bypass flow control valve 504A is disposed which is constituted as, e.g., a solenoid proportional valve with a pressure compensating function and supplies the hydraulic fluid delivered from the hydraulic pump 303*a* to the supply line 400*a* through a variable throttle 504Aa at a desired flow rate while returning the remaining hydraulic fluid to the hydraulic reservoir 302 via the reservoir line 403*a*. Additionally, though not shown, a relief valve is disposed between the delivery line 402*a* and the reservoir line 403*a* to specify a maximum pressure in the supply line 400*a* serving as a high-pressure line.

Likewise, the hydraulic pump 303*b* is connected to the main lines 405, 407 and 417 via a delivery line 402*b* to which the hydraulic fluid delivered from the hydraulic pump 303*b* is introduced, then via a supply line 400*b* connected at one side (left side as viewed in the drawing) thereof to the delivery line 402*b*, and then via branch lines 451A, 451B and 451C branched from the other side of the supply line 400*b*.

In the branch lines 451A, 451B and 451C, there are disposed respectively a boom inflow control valve 505 and bucket inflow control valves 506, 507 which are each constituted as, e.g., a solenoid proportional valve with a pressure compensating function and include respectively variable throttles 505A, 506A and 507A for controlling flows of the hydraulic fluid supplied from the hydraulic pump 303*b* to the rod pushing-side chamber 305A of each boom hydraulic cylinder, the rod pushing-side chamber 307A of each bucket hydraulic cylinder, and the rod drawing-side chamber 307B of each bucket hydraulic cylinders to desired throttled rates. On the sides of the inflow control valve 505, 506 and 507 nearer to the hydraulic cylinders 305, 306 and 307, though not shown, check valves are disposed respectively which allow the hydraulic fluid to flow from the hydraulic pump 303*b* to the rod pushing-side chamber 305A of each boom hydraulic cylinder and the rod pushing-side chamber 307A and the rod drawing-side chamber 307B of each bucket hydraulic cylinder, but block off the hydraulic fluid flowing in the reversed direction.

In this respect, a reservoir line 403*b* is branched from the supply line 400*b* (or the delivery line 402*b* as required). In this reservoir line 403*b*, a bypass flow control valve 504B is disposed which is constituted as, e.g., a solenoid proportional valve with a pressure compensating function and supplies the hydraulic fluid delivered from the hydraulic pump 303*b* to the supply line 400*b* through a variable throttle 504Ba at a desired flow rate while returning the remaining hydraulic fluid to the hydraulic reservoir 302 via the reservoir line 403*b*. Additionally, though not shown, a relief valve is disposed between the delivery line 402*b* and the reservoir line 403*b* to specify a maximum pressure in the supply line 400*b* serving as a high-pressure line.

The hydraulic pumps 301*a-f*, 303*a* and 303*b*, the directional flow control valves 310*aa-fd*, the delivery lines 402*a*, 402*b*, the reservoir lines 403*a*, 403*b*, the bypass flow control valves 504A, 504B, the relief valves, etc. are disposed in the machine body 13 of the hydraulic excavator. The hydraulic cylinders 405, 406, 407 and 408, the supply lines 400*a*, 400*b*, the branch lines 450A-C, 451A-C, etc. are disposed on a front operating mechanism 14 of the hydraulic excavator.

As one of features of this embodiment, first, the connecting line 405 connected to the rod pushing-side chambers 305A, 305A of the boom hydraulic cylinders 305, 305 and the connecting line 415 connected to the rod drawing-side chambers 305B, 305B thereof are connected to each other via a recovery line 520. In the recovery line 520, a boom recovery flow control valve 521 is disposed which is constituted as, e.g., a solenoid proportional valve and includes a variable throttle for controlling the flows of the hydraulic fluids from the rod pushing-side chambers 305A, 305A of the boom hydraulic cylinders 305, 305 to the rod drawing-side chambers 305B, 305B thereof to a desired throttled flow rate. Further, on the side of the boom recovery flow control valve 521 nearer to the rod drawing-side chambers 305B, 305B, a check valve 522 is disposed which allows the hydraulic fluids to flow from the rod pushing-side chambers 305A, 305A to the rod drawing-side chambers 305B, 305B, but blocks off the hydraulic fluids from flowing in the reversed direction. With such an arrangement, the hydraulic fluids in the rod pushing-side chambers 305A, 305A of the boom hydraulic cylinders 305, 305 are introduced to the rod drawing-side chambers 305B, 305B.

Also, the connecting line 406 connected to the rod pushing-side chambers 306A, 306A of the arm hydraulic cylinders 306, 306 and the connecting line 416 connected to the rod drawing-side chambers 306B, 306B thereof are connected to each other via a recovery line 523. In the recovery line 523, an arm recovery flow control valve 524 is disposed which is constituted as, e.g., a solenoid proportional valve and includes a variable throttle for controlling the flows of the hydraulic fluids from the rod pushing-side chambers 306A, 306A of the arm hydraulic cylinders 306, 306 to the rod drawing-side chambers 306B, 306B thereof to a desired throttled flow rate. Further, on the side of the arm recovery flow control valve 524 nearer to the rod drawing-side chambers 306B, 306B, a check valve 525 is disposed which allows the hydraulic fluids to flow from the rod pushing-side chambers 306A, 306A to the rod drawing-side chambers 306B, 306B, but blocks off the hydraulic fluids from flowing in the reversed direction. With such an arrangement, the hydraulic fluids in the rod pushing-side chambers 306A, 306A of the arm hydraulic cylinders 306, 306 are introduced to the rod drawing-side chambers 306B, 306B.

On the other hand, for the bucket opening/closing hydraulic cylinders 308, 308, a circuit arrangement is added to provide a different recovery function (operating in the reversed direction) from those for the boom hydraulic cylinders 305, 305 and the arm hydraulic cylinders 306, 306. More specifically, the connecting line 408 connected to the rod pushing-side chambers 308A, 308A of the bucket opening/closing hydraulic cylinders 308, 308 and the connecting line 418 connected to the rod drawing-side chambers 308B, 308B thereof are connected to each other via a recovery line 526. In the recovery line 526, a bucket-opening/closing recovery flow control valve 527 is disposed which is constituted as, e.g., a solenoid proportional valve and includes a variable throttle for controlling the flows of the hydraulic fluids from the rod drawing-side chambers 308B of the bucket opening/closing hydraulic cylinders 308, 308 to the rod pushing-side chambers 308A thereof to a desired throttled flow rate. Further, on the side of the bucket-opening/closing recovery flow control valve 527 nearer to the rod pushing-side chambers 308B, a check valve may be disposed which allows the hydraulic fluids to flow from the rod drawing-side chambers 308B to the rod pushing-side chambers 308A, but blocks off the hydraulic fluids from flowing in the reversed direction. With such an arrangement, the hydraulic fluid in the rod drawing-side chamber 308B of each bucket opening/closing hydraulic cylinder 308 is introduced to the rod pushing-side chamber 308A.

The other constructions and control procedures than described above, including the structure of the hydraulic excavator (except for outer diameter dimensions, sizes, etc.) to which this embodiment is applied, are substantially the same as those in the sixth embodiment and hence a description thereof is omitted here.

The operation of this embodiment thus constructed will be described below, taking as an example the operations of boom lowering and arm drawing.

In the loader type hydraulic excavator to which this embodiment is applied, as in the sixth embodiment, when the operator operates a control lever (not shown) in the direction corresponding to the boom lowering with intent to lower the boom, for example, after releasing the scooped earth, the produced operation input signal X is applied as a boom lowering command to the first to third boom directional flow control valves 310*ab*, 310*bb* and 310*cb*, thus causing their spools to shift in the corresponding directions. As a result, the hydraulic fluids from the hydraulic pumps 301*a-c* are supplied to the rod drawing-side chambers 305B, 305B of the boom hydraulic cylinders 305, 305 via the main lines 415.

At that time, as in the above first and second embodiments, the return hydraulic fluids corresponding to a part (e.g., about ½) of the outflow rate from the rod pushing-side chambers 305A, 305A of the boom hydraulic cylinders are returned to the reservoir 302 from the rod pushing-side chambers 305A, 305A via the main lines 405 and respective meter-out throttles (not shown) of the first to third boom directional flow control valves 310*ab*, 310*bb* and 310*cb* and the first to third boom-raising directional flow control valves 310*db*, 310*eb* and 310*fb*. Simultaneously, a not-shown controller computes a drive signal S for the boom recovery flow control valve 521 in accordance with the boom-lowering operation signal X and outputs the computed drive signal S to a solenoid sector of the boom recovery flow control valve 521. As a result, the boom recovery flow control valve 521 is driven to the open side. On this occasion, because holding pressures are applied to the rod pushing-side chambers 305A, 305A of the boom hydraulic cylinders 305, 305 due to the dead load of the boom, the remaining part of the hydraulic fluids from the rod pushing-side chambers 305A, 305A is introduced (recovered) to the rod drawing-side chambers 305B, 305B through the check valve 522 and the boom recovery flow control valve 521 upon opening of the boom recovery flow control valve 521.

Also, when the operator operates a not-shown control lever in the direction corresponding to the arm drawing with intent to draw the arm, for example, after releasing the scooped earth, the produced operation input signal X is applied as an arm drawing command to the first and second arm directional flow control valves 310*ac*, 310*cc*, thus causing their spools to shift in the corresponding directions. As a result, the hydraulic fluids from the hydraulic pumps 301*a*, 301*c* are supplied to the rod drawing-side chambers 306B, 306B of the arm hydraulic cylinders 306, 306 via the main lines 416.

At that time, as in the above case, the return hydraulic fluids corresponding to a part (e.g., about ½) of the outflow rate from the rod pushing-side chambers 306A, 306A of the arm hydraulic cylinders are returned to the reservoir 302 from the rod pushing-side chambers 306A via the main lines 406 and respective meter-out throttles (not shown) of the first and second arm directional flow control valves 310*ac*, 310*cc*, the first and second arm-pushing directional flow control valves 310*ec*, 310*fc*, and the first and second bucket-crowding/arm-pushing directional flow control valves 310*bc*, 310*dc*. Simultaneously, a not-shown controller computes a drive signal S for the arm recovery flow control valve 524 in accordance with the arm-drawing operation signal X from the control lever and outputs the computed drive signal S to a solenoid sector of the arm recovery flow control valve 524. As a result, the arm recovery flow control valve 524 is driven to the open side. On this occasion, because a holding pressure is applied to the rod pushing-side chamber 306A of each arm hydraulic cylinder 306 due to the dead load of the arm, the remaining part of the hydraulic fluid drained from the rod pushing-side chamber 306A is introduced (recovered) to the rod drawing-side chamber 306B through the check valve 525 and the arm recovery flow control valve 524 upon opening of the arm recovery flow control valve 524.

With this embodiment thus constructed, as with the above sixth embodiment, the number of the flow control valves is reduced, thus resulting in the advantages of a reduction in the pressure loss of the overall hydraulic drive system and simplified layouts therein.

Also, a total flow rate of the return hydraulic fluids from the rod pushing-side chambers 305A, 305A of the boom hydraulic cylinders 305, 305 during the boom-lowering operation is accommodated as a flow rate ordinarily drained to the reservoir 302 through the meter-out throttles of the directional flow control valves 310*ab*, 310*bb*, 310*cb*, 310*db*, 310*eb* and 310*fb* and a flow rate recovered to the rod drawing-side chambers 305B, 305B through the boom recovery flow control valve 521. Further, a total flow rate of the return hydraulic fluids from the rod pushing-side chambers 306A, 306A of the arm hydraulic cylinders 306, 306 during the arm-drawing operation is accommodated as a flow rate ordinarily drained to the reservoir 302 through the meter-out throttles of the directional flow control valves 310*ac*, 310*bc*, 310*cc*, 310*dc*, 310*ec* and 310*fc* and a flow rate recovered to the rod drawing-side chambers 306B through the arm recovery flow control valve 524. With such an arrangement, regarding the boom hydraulic cylinders 305, 305 and the arm hydraulic cylinders 306, 306, parts of the return hydraulic fluids (extra flows to be drained) from the rod drawing-side chambers 305B, 305B and the rod drawing-side chambers 306B, 306B are each effectively utilized as a recovery flow. It is therefore possible to, as with the sixth embodiment, omit an outflow control valve having a large capacity and an associated outflow line adapted for a large flow rate, which are each otherwise provided in association with the boom hydraulic cylinders 305, 305 and the arm hydraulic cylinders 306, 306, and hence to sufficiently increase the energy efficiency.

Figure 14:
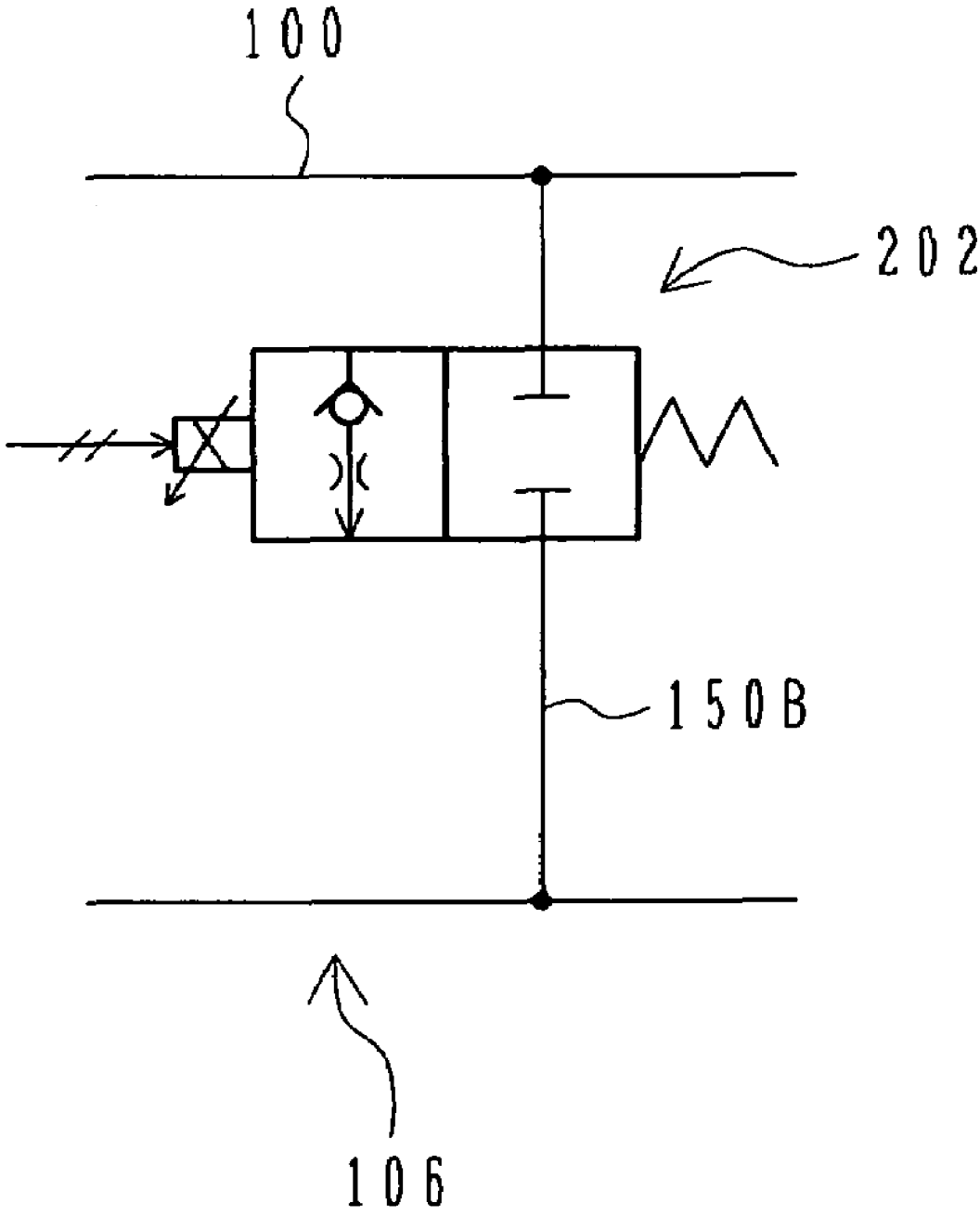
FIG. 14 shows extracted one of the flow control valves shown in FIG. 1.

The flow control valves 201, 202, 203, 208, 501, 502, 503, 505, 506 and 507 described in the above first to seventh embodiments may be each constituted as a seat valve having a relatively small pressure loss. An example of the construction of such a seat valve will be described below with reference to FIGS. 14 and 15. FIG. 14 shows the flow control valve 202 as one example extracted from the flow control valves shown in FIG. 1, and FIG. 15 shows the structure of the seat valve corresponding to the diagram shown in FIG. 14.

Figure 15:
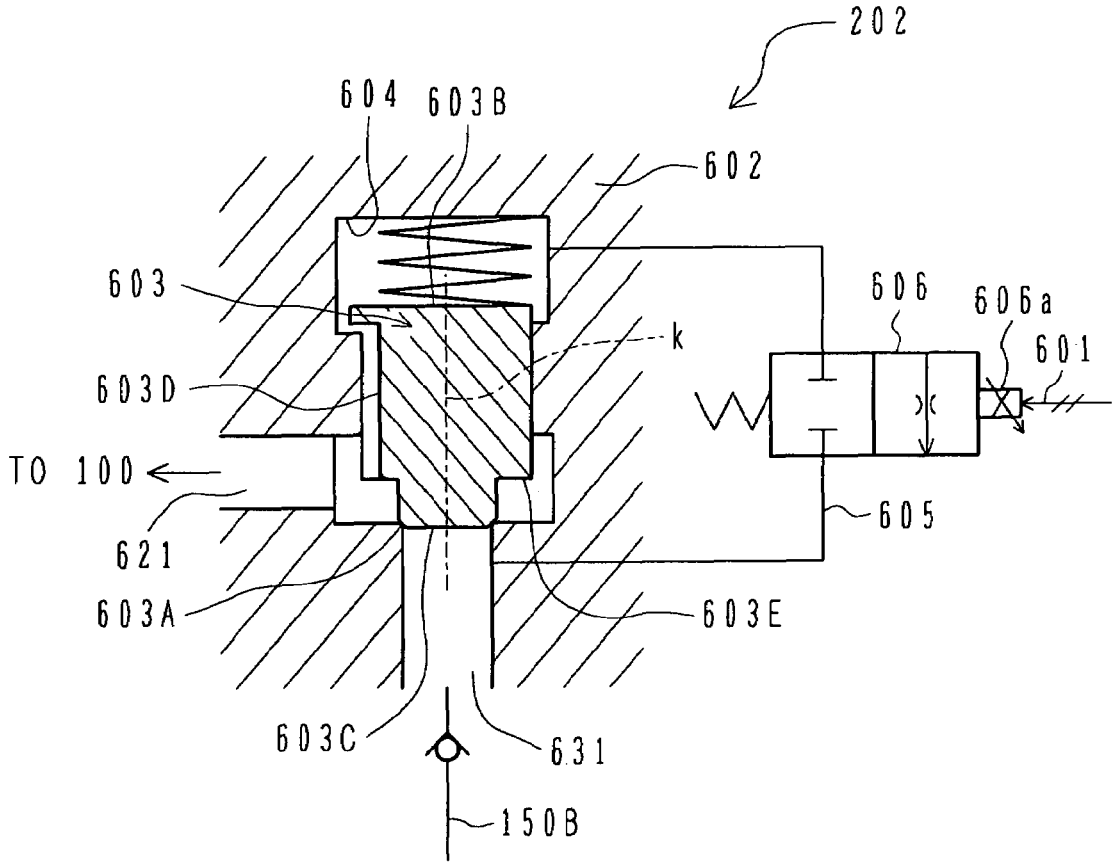
FIG. 15 is an explanatory view showing the case in which the flow control valve is constituted as a seat valve.

More specifically, in FIG. 15, a main valve (seat valve) 603 constituted by a poppet fitted into a casing 602 has a seat portion 603A for establishing and cutting off communication between an inlet line 621 communicating with the supply line 100 and an outlet line 631 connected to the branch line 150B through the check valve, an end face 603C subjected to a pressure in the outlet line 631, an end face 603B positioned on the opposite side to the end face 603C and subjected to a pressure in a back pressure chamber 604 formed between the casing 602 and the outlet line 603B, and a throttle slit 603D for communicating the inlet line 621 and the back pressure chamber 604 with each other. Further, a pilot line 605 for communicating the back pressure chamber 604 and the outlet line 631 with each other is formed in the casing 602. Midway the pilot line 605, a control valve (variable throttle) 606 for controlling a control pressure is disposed which is constituted as, e.g., a proportional solenoid valve for adjusting a flow rate in the pilot line 605 in accordance with a command signal 601 from the controller.

In the arrangement described above, the pressure in the inlet line 621 is introduced to the back pressure chamber 604 through the throttle slit 603D, and under the action of this introduced pressure, the main valve 603 is pressed downward as viewed in the drawing so that the communication between the inlet line 621 and the outlet line 631 is cut off by the main valve abutting against the seat portion 603A. In that condition, when the desired command signal 601 is applied to a solenoid driving sector 606*a* of the control valve 606 to open the control valve 606, the fluid in the inlet line 621 is caused to flow out to the outlet line 631 through the throttle slit 603D, the back pressure chamber 604, the control valve 606, and the pilot line 605. Such an outflow lowers the pressure in the back pressure chamber 604 with the throttling effects of both the throttle slit 603D and the control valve 606, whereby forces acting upon the end face 603A and an end face 603E become larger than forces acting upon the end face 603B. As a result, the main valve 603 is moved upward as viewed in the drawing, thus allowing the fluid in the inlet line 621 to flow out to the outlet line 631. In this respect, if the main valve 603 is moved upward through an excessive stroke, the throttle opening of the throttle slit 603D is increased and the pressure in the back pressure chamber 604 rises, whereby the main valve 603 is moved downward as viewed in the drawing.

In such a way, the main valve 603 is stopped at a position where the throttle opening of the throttle slit 603D is in balance with the throttle opening of the control valve 606. Accordingly, the flow rate of the fluid from the inlet line 621 to the outlet line 631 can be controlled as desired in accordance with the command signal 601.

It is needless to say that the flow control valves (i.e., the flow control valves not required to have the function of a check valve) 204, 211, 212 and 213 other than the above-mentioned ones or the recovery flow control valves 221, 224, 227, 521, 524 and 527 can also be each constituted as a similar seat valve.

In particular, preferably, each flow control valve is arranged such that an axis k (see FIG. 15) of the main valve 603 lies substantially in the horizontal direction. In FIGS. 2 and 5 representing the first embodiment and the second embodiment, respectively, the direction of the axis k is shown, by way of example, in the valve unit 190 in which the flow control valves 201 to 203, the outflow control valves 211 to 213, etc. are disposed (this is similarly applied to the valve unit 190'). That arrangement results in the following advantage. In FIGS. 2 and 5, with the direction of the axis k being substantially horizontal as shown, when the front operating mechanism 14 is operated to rotate in the plane direction of the drawing sheets, acceleration generated by the rotation of the front operating mechanism is directed perpendicularly to the direction in which the main valve 603 is moved to open and close, so that the valve opening and closing operations are not adversely affected by the generated acceleration. It is hence possible to ensure the smooth and reliable opening and closing operations of the main valve 603.

While, in the above description, the command signal is applied to the solenoid driving sector 606A of the control valve 606, which is a solenoid proportional valve, to shift the control valve 606 for producing a pilot pressure as the control pressure directly in the pilot line 605, the present invention is not limited to such an arrangement. For example, when the main valve 603 has a large size and a relatively high pilot pressure is required to drive the main valve 603, a hydraulic pilot selector valve for producing a secondary pilot pressure may be additionally provided. In this case, the selector valve is shifted under a primary pilot pressure produced by the control valve 606 to produce the secondary pilot pressure higher than the primary pilot pressure based on an original pilot pressure from a hydraulic source, and the thus-produced secondary pilot pressure is introduced, as the control pressure, to the main valve 603, thereby shifting the main valve 603.

Furthermore, while the first to seventh embodiments represent the case in which the present invention is applied to a hydraulic excavator, the present invention is also widely applicable to other various construction machines each having a swing body, a travel body, and a front operating mechanism.

INDUSTRIAL APPLICABILITY

According to the present invention, the number of flow control valves and the length of piping required for connection of the flow control valves can be further cut, and a total pressure loss can be further reduced. Thus, it is also possible to simplify layouts of hydraulic piping between hydraulic sources and actuators.

The invention claimed is:

1. A hydraulic drive system for a construction machine comprising a travel body, a swing body swingably mounted onto said travel body, and a multi-articulated front operating mechanism coupled to said swing body in a vertically angularly movable manner and made up of a boom and a bucket, wherein said hydraulic drive system comprises:

a first hydraulic pump and a second hydraulic pump driven by prime movers;

a plurality of hydraulic cylinders including a boom hydraulic cylinder, an arm hydraulic cylinder, and a bucket hydraulic cylinder supplied with hydraulic fluids delivered from said first hydraulic pump and said second hydraulic pump to drive said boom, said arm, and said bucket, respectively:

a plurality of directional flow control valves for controlling respective flows of the hydraulic fluid supplied from said first hydraulic pump to said plurality of hydraulic cylinders;

a common high-pressure line having one side connected to the delivery side of said second hydraulic pump and the other side extended to the side of said front operating mechanism;

a boom branch line branched from said common high-pressure line and connected on the side opposite to the branched side to a rod pushing-side chamber of said boom hydraulic cylinder;

a boom inflow control valve disposed near a branch position at which said boom branch line is branched from said common high-pressure line, and controlling a flow of a hydraulic fluid supplied from said common high-pressure line to the rod pushing-side chamber of said boom hydraulic cylinder;

an arm branch line branched from said common high-pressure line at a position downstream of the branch position of said boom branch line and connected on the side opposite to the branched side to a rod pushing-side chamber of said arm hydraulic cylinder;

an arm inflow control valve disposed near a branch position at which said arm branch line is branched from said common high-pressure line, and controlling a flow of a hydraulic fluid supplied from said common high-pressure line to the rod pushing-side chamber of said arm hydraulic cylinder;

a bucket branch line branched from said common high-pressure line at a position downstream of the branch position of said boom branch line and connected on the side opposite to the branched side to a rod pushing-side chamber of said bucket hydraulic cylinder; and a bucket inflow control valve disposed near the branch position (D2) at which said bucket branch line is branched from said common high-pressure line, and controlling a flow of a hydraulic fluid supplied from said common high-pressure line to the rod pushing-side chamber of said bucket hydraulic cylinder, said hydraulic system being configured such that when said boom hydraulic cylinder, said arm hydraulic cylinder and said bucket hydraulic cylinder are operated to extend, the hydraulic fluid from said first hydraulic pump is supplied to said rod pushing-side chambers of said boom, arm and bucket hydraulic cylinders through said plurality of directional flow control valves, respectively, and the hydraulic fluid from said second hydraulic pump is supplied to said rod pushing-side chambers of said boom, arm and bucket hydraulic cylinders through said common high-pressure line, said boom branch line, said arm branch line and said bucket branch line and further said boom inflow control valve, said arm inflow control valve and said bucket inflow control valve, respectively, and being joined with the hydraulic fluid from said first hydraulic pump, while the fluids discharged from the rod drawing-side chambers of said boom, arm and bucket hydraulic cylinders are returned to said reservoir only through said plurality of directional flow control valves, respectively, wherein:

said inflow control valves are all disposed together in one control valve unit.

2. A hydraulic drive system for a construction machine according to claim 1, wherein:

said one control valve unit is disposed on said boom.

3. A hydraulic drive system for a construction machine comprising a travel body, a swing body swingably mounted onto said travel body, and a multi-articulated front operating mechanism coupled to said swing body in a vertically angularly movable manner and made up of a boom and a bucket, wherein said hydraulic drive system comprises:

a first hydraulic pump and a second hydraulic pump driven by prime movers;

a plurality of hydraulic cylinders including a boom hydraulic cylinder, an arm hydraulic cylinder, and a bucket hydraulic cylinder supplied with hydraulic fluids delivered from said first hydraulic pump and said second hydraulic pump to drive said boom, said arm, and said bucket, respectively;

a plurality of directional flow control valves for controlling respective flows of the hydraulic fluid supplied from said first hydraulic pump to said plurality of hydraulic cylinders;

a common high-pressure line having one side connected to the delivery side of said second hydraulic pump and the other side extended to the side of said front operating mechanism;

a boom branch line branched from said common high-pressure line and connected on the side opposite to the branched side to a rod pushing-side chamber of said boom hydraulic cylinder;

a boom inflow control valve disposed near a branch position at which said boom branch line is branched from said common high-pressure line, and controlling a flow of a hydraulic fluid supplied from said common high-pressure line to the rod pushing-side chamber of said boom hydraulic cylinder;

an arm branch line branched from said common high-pressure line at a position downstream of the branch position of said boom branch line and connected on the side opposite to the branched side to a rod pushing-side chamber of said arm hydraulic cylinder;

an arm inflow control valve disposed near a branch position at which said arm branch line is branched from said common high-pressure line, and controlling a flow of a hydraulic fluid supplied from said common high-pressure line to the rod pushing-side chamber of said arm hydraulic cylinder;

a bucket branch line branched from said common high-pressure line at a position downstream of the branch position of said boom branch line and connected on the side opposite to the branched side to a rod pushing-side chamber of said bucket hydraulic cylinder; and a bucket inflow control valve disposed near the branch position (D2) at which said bucket branch line is branched from said common high-pressure line, and controlling a flow of a hydraulic fluid supplied from said common high-pressure line to the rod pushing-side chamber of said bucket hydraulic cylinder, said hydraulic system being configured such that when said boom hydraulic cylinder, said arm hydraulic cylinder and said bucket hydraulic cylinder are operated to extend, the hydraulic fluid from said first hydraulic pump is supplied to said rod pushing-side chambers of said boom, arm and bucket hydraulic cylinders through said plurality of directional flow control valves, respectively, and the hydraulic fluid from said second hydraulic pump is supplied to said rod pushing-side chambers of said boom, arm and bucket hydraulic cylinders through said common high-pressure line, said boom branch line, said arm branch line and said bucket branch line and further said boom inflow control valve, said arm inflow control valve and said bucket inflow control valve, respectively, and being joined with the hydraulic fluid from said first hydraulic pump, while the fluids discharged from the rod drawing-side chambers of said boom, arm and bucket hydraulic cylinders are returned to said reservoir only through said plurality of directional flow control valves, respectively, wherein said hydraulic drive system further comprises at least one of three sets comprising:

a boom return fluid joining line branched from said boom branch line at a position nearer to said boom hydraulic cylinder than said boom inflow control valve and connected on the side opposite to the branched side to a hydraulic reservoir, and a boom outflow control valve disposed in said boom return fluid joining line near a branch position at which said boom return fluid joining line is branched from said boom branch line and controlling a flow of a hydraulic fluid drained from said boom hydraulic cylinder to said hydraulic reservoir;

an arm return fluid joining line branched from said arm branch line at a position nearer to said arm hydraulic cylinder than said arm inflow control valve and connected on the side opposite to the branched side to said hydraulic reservoir, and an arm outflow control valve disposed in said arm return fluid joining line near a branch position at which said arm return fluid joining line is branched from said arm branch line and controlling a flow of a hydraulic fluid drained from said arm hydraulic cylinder to said hydraulic reservoir; and a bucket return fluid joining line branched from said bucket branch line at a position nearer to said bucket hydraulic cylinder than said bucket inflow control valve and connected on the side opposite to the branched side to said hydraulic reservoir, and a bucket outflow control valve disposed in said bucket return fluid joining line near a branch position at which said bucket return fluid joining line is branched from said bucket branch line and controlling a flow of a hydraulic fluid drained from said bucket hydraulic cylinder to said hydraulic reservoir.

4. A hydraulic drive system for a construction machine according to claim 3, wherein:

said inflow control valves and said outflow control valves are all disposed together in one control valve unit.

5. A hydraulic drive system for a construction machine, wherein said hydraulic drive system comprises:

a first hydraulic pump and a second hydraulic pump driven by prime movers;

a plurality of hydraulic cylinders driven by hydraulic fluids delivered from said first hydraulic pump and said second hydraulic pump;

a plurality of directional flow control valves for controlling respective flows of the hydraulic fluid supplied from said first hydraulic pump to said plurality of hydraulic cylinders;

at least one inflow control valve for controlling a flow of the hydraulic fluid delivered from said second hydraulic pump and supplied to at least one rod pushing-side chamber among said plurality of hydraulic cylinders without passing said directional flow control valves;

a bypass flow control valve for returning the hydraulic fluid delivered from said second hydraulic pump to a reservoir;

a recovery flow control valve for introducing the hydraulic fluid in at least one rod pushing-side chamber among said plurality of hydraulic cylinders to a rod drawing-side chamber thereof;

said hydraulic system being configured such that when said plurality of hydraulic cylinders are operated to extend, the hydraulic fluid from said first hydraulic pump is supplied to said rod pushing-side chambers of said plurality of hydraulic cylinders through said plurality of directional flow control valves, respectively, and the hydraulic fluid from said second hydraulic pump is supplied to said rod pushing-side chambers of said plurality of hydraulic cylinders through said plurality of inflow control valves respectively, and being joined with the hydraulic fluid from said first hydraulic pump, while the fluids discharged from the rod drawing-side chambers of said plurality of hydraulic cylinders are returned to said reservoir only through said plurality of directional flow control valves, respectively, and when said plurality of hydraulic cylinders are operated to contract, the hydraulic fluid from said first hydraulic pump is supplied to said rod drawing-side chambers of said plurality of hydraulic cylinders through said plurality of directional flow control valves, respectively, and part of the hydraulic fluid from said at least one rod pushing-side chamber amond said plurality of hydraulic cylinders is supplied to the rod drawing-side chamber of the corresponding hydraulic cylinder, while the remaining part of the fluid discharged from the rod pushing-side chamber of the corresponding hyraulic cylinder and the fluids discharged from the rold pushing-side chambers of the other hydraulic cylinders are returned to said reservoir only through said plurality of directional flow control valves, respectively.

6. A hydraulic drive system for a construction machine according to claim 5, wherein check valves are disposed respectively in branch lines for supplying the hydraulic fluid to the rod pushing-side chambers of said hydraulic cylinders.

7. A hydraulic drive system for a construction machine according to claim 5, wherein:

at least one of said inflow control valves, said outflow control valves, and said bypass flow control valves is constituted as a seat valve.

8. A hydraulic drive system for a construction machine according to claim 7, wherein:

said seat valve is arranged such that an axis (k) thereof lies substantially in the horizontal direction.

9. A hydraulic drive system for a construction machine comprising a travel body, a swing body swingably mounted onto said travel body, and a multi-articulated front operating mechanism coupled to said swing body in a vertically angularly movable manner and made up of a boom, an arm and a bucket, wherein said hydraulic drive system comprises:

a first hydraulic pump and a second hydraulic pump driven by prime movers;

a plurality of hydraulic cylinders including a boom hydraulic cylinder, an arm hydraulic cylinder and a bucket hydraulic cylinder supplied with hydraulic fluids delivered from said first hydraulic pump and said second hydraulic pump to drive said boom, said arm, and said bucket, respectively;

a plurality of directional flow control valves for controlling respective flows of the hydraulic fluid supplied from said first hydraulic pump to said plurality of hydraulic cylinders;

at least one inflow control valve for controlling a flow of the hydraulic fluid delivered from said second hydraulic pump and supplied to a rod pushing-side chamber of at least said boom hydraulic cylinder among said plurality of hydraulic cylinders without passing said directional flow control valves;

a bypass flow control valve for returning the hydraulic fluid delivered from said second hydraulic pump to a reservoir;

at least one recovery flow control valve for introducing the hydraulic fluid in the rod pushing-side chamber of at least said boom hydraulic cylinder among said plurality of hydraulic cylinders to a rod drawing-side chamber thereof; and said hydraulic system being configured such that when said boom hydraulic cylinder is operated to extend, the hydraulic fluid from said first hydraulic pump is supplied to said rod pushing-side chamber of said boom hydraulic cylinder through the directional flow control valve for the boom hydraulic cylinder, and the hydraulic fluid from said second hydraulic pump is supplied to said rod pushing-side chamber of said boom hydraulic cylinder through said inflow control valve, and being joined with the hydraulic fluid from said first hydraulic pump, while the fluid discharged from the rod drawing-side chamber of said boom hydraulic cylinder is returned to said reservoir only throught the directional flow control valve for the boom hydraulic cylinder, and when said boom hydraulic cylinder is operatad to contract, the hydraulic fluid from said first hydraulic pump is supplied to said rod drawing-side chamber of said boom hydraulic cylinder through the directional flow control valve for the boom hydraulic cylinder, and part of the hydraulic fluid from said rod pushing-side chamber of the boom hydraulic cylinder is supplied to the rod drawing-side chamber of the boom hydraulic cylinder through said recovery flow control valve, while the remaining part of the fluid discharged from the rod pushing-side chamber of the boom hydraulic cylinder is returned to said reservoir only through the directional flow control valve for the boom hydraulic cylinder.

10. A hydraulic drive system for a construction machine according to claim 9, wherein:

said inflow control valves are all disposed together in one control valve unit.

11. A hydraulic drive system for a construction machine comprising a travel body, a swing body swingably mounted onto said travel body, and a multi-articulated front operating mechanism made up of a boom rotatably coupled to said swingbody,an arm rotatably coupled to said boom, and a bucket rotatably coupled to said arm to be open forward in a ground contact state, wherein said hydraulic drive system comprises:

at least one first hydraulic pump and at least one second hydraulic pump driven by a plurality of prime movers;

a plurality of hydraulic cylinders including a boom hydraulic cylinder, an arm hydraulic cylinder and a bucket hydraulic cylinder supplied with hydraulic fluids delivered from said first hydraulic pump and said second hydraulic pump to drive said boom, said arm and said bucket, respectively, and an opening/closing hydraulic cylinder supplied with the hydraulic fluids to open and close said bucket;

a plurality of directional flow control valves for controlling respective flows of the hydraulic fluid supplied from said first hydraulic pump to said plurality of hydraulic cylinders;

a boom-raising inflow control valve, a bucket-crowding inflow control valve and a bucket-dumping inflow control valve for controlling respective flows of the hydraulic fluid delivered from said second hydraulic pump and supplied to rod pushing-side chamber of said boom hydraulic cylinder, a rod pushing-side chamber of said bucket hydraulic clyinder, and a rod drawing-side chamber of said bucket hydraulic cylinder without passing said directional flow control valves;

a bypass flow control valve for returning the hydraulic fluid delivered from said second hydraulic pump to a reservoir;

at least two recovery flow control valve for introducing the hydraulic fluids in the rod pushing-side chambers of at least said boom hydraulic cylinder and said arm hydraulic cylinder among said plurality of hydraulic cylinders to rod drawing-side chambers thereof; and said hydraulic system being configured such that when said boom hydraulic cylinder, said arm hydraulic cylinder and said bucket hydraulic cylinder are operated to extend as far as the boom and bucket hydraulic cylinders are concerned, the hydraulic fluid from said first hydraulic pump is supplied to said rod pushing-side chambers thereof through the directional flow control valves for the boom and bucket hydraulic cylinders, respectively, and the hydraulic fluid from said second hydraulic pump is supplied to said rod pushing-side chambers thereof through said boom-raising and bucket-crowding inflow control valves, respectively, and being joined with the hydraulic fluid from said first hydraulic pump, and with respect to the arm hydraulic cylinder, the hydraulic fluid from said first hydraulic pump is supplied to said rod pushing-side chamber thereof through the directional flow control valve for the arm hydraulic cylinder, while the fluids discharged from the rod drawing-side chambers of said boom arm and bucket hydraulic cylinders are returned to said reservoir only through the directional flow control valves for the boom, arm and bucket hydraulic cylinders, and when said boom hydraulic cylinder, said arm hydraulic cylinder and said bucket hydraulic cylinder are operated to contract, and with respect to said boom and arm hydraulic cylinders, the hydraulic fluid from said first hydraulic pump is supplied to said rod drawing-side chambers thereof through the directional flow control valves for the boom and arm hydraulic cylinders, respectively, and part of the hydraulic fluids from said rod pushing-side chambers thereof are supplied to the rod drawing-side chambers thereof through said recovery flow control valves and with respect to said bucket hydraulic cylinder, the hydraulic fluid from said first hydraulic pump is supplied to said rod drawing-side chamber thereof through the directional flow control valve for the bucket hydraulic cylinder, and the hydraulic fluid from said second hydraulic pump is supplied to the rod drawing-side chamber thereof through said bucket-dumping inflow control valve, and being joined with the hydraulic fluid from the first hydraulic pump, while the remaining part of the fluid discharged from the rod pushing-side chambers of the boom and arm hydraulic cylinders and all fluid discharged from the rod pushing-side chamber of the bucket hydraulic cylinder are returned to said reservoir only through the directional flow control valves for the boom, arm and bucket hydraulic cylinders.

12. A hydraulic drive system for a construction machine comprising a travel body, a swing body swingably mounted onto said travel body, and a multi-articulated front operating mechanism made up of a boom rotatably coupled to said swing body, an arm rotatably coupled to said boom, and a bucket rotatably coupled to said arm to be open rearward in a ground contact state, wherein said hydraulic drive system comprises:

at least one first hydraulic pump and at least one second hydraulic pump driven by a plurality of prime movers;

a plurality of hydraulic cylinders including a boom hydraulic cylinder, an arm hydraulic cylinder and a bucket hydraulic cylinder supplied with hydraulic fluids delivered from said first hydraulic pump and said second hydraulic pump to drive said boom, said arm and said bucket, respectively;

a plurality of directional flow control valves for controlling respective flows of the hydraulic fluid supplied from said first hydraulic pump to said plurality of hydraulic cylinders;

a plurality of inflow control valve for controlling respective flows of the hydraulic fluid delivered from said second hydraulic pump and supplied to rod pushing-side chambers of said boom hydraulic cylinders, said arm hydraulic cylinder and said bucket hydraulic cylinder without passing said directional flow control valves;

a bypass flow control valve for returning the hydraulic fluid delivered from said second hydraulic pump to a reservoir;

at least one recovery flow control valve for introducing the hydraulic fluid in the rod pushing-side chamber of at least said boom hydraulic cylinder among said plurality of hydraulic cylinders to a rod drawing-side chamber thereof; and said hydraulic system being configured such that when said boom hydraulic cylinder, said arm hydraulic cylinder and said bucket hydraulic cylinder are operated to extend, the hydraulic fluid from said first hydraulic pump is supplied to said rod pushing-side chambers of said boom, arm and bucket hydraulic cylinders through the directional flow control valves for the boom, arm and bucket hydraulic cylinders, respectively, and the hydraulic fluid from said second hydraulic pump is supplied to said rod pushing-side chambers thereof through said inflow control valves, respectively, and being joined with the hydraulic fluid from said first hydraulic pump, while the fluids discharged from the rod drawing-side chambers of said boom, arm and bucket hydraulic cylinders are returned to said reservoir only through the directional flow control valves for the boom, arm and bucket hydraulic cylinders, and when said boom hydraulic cylinder among said plurality of hydraulic cylinders is operated to contract the hydraulic fluid from said first hydraulic pump is supplied to said rod drawing-side clamber thereof through the directional flow control valve for the boom hydraulic cylinder, and part of the hydraulic fluid from said rod pushing-side chamber thereof is supplied to the rod drawing-side chamber thereof through said recovery flow control valve, while the remaining part of the fluid discharged from the rod pushing-side chamber thereof is returned to said reservoir only through the directional flow control valve for the boom hydraulic cylinders.

13. A hydraulic drive system for a construction machine comprising a travel body, a swing body swingably mounted onto said travel body, and a multi-articulated front operating mechanism made up of a boom rotatably coupled to said swing body, an arm rotatably coupled to said boom, and a bucket rotatably coupled to said arm to be open forward in a ground contact state, wherein said hydraulic drive system comprises:

six first hydraulic pumps and two second hydraulic pumps driven by a plurality of prime movers;

a boom hydraulic cylinder, an arm hydraulic cylinder and a bucket hydraulic cylinder supplied with hydraulic fluids delivered from said first hydraulic pump and said second hydraulic pump to drive said boom, said arm and said bucket, respectively, and an opening/closing hydraulic cylinder supplied with the hydraulic fluids to open and close said bucket;

a plurality of boom directional flow control valves, a plurality of arm directional flow control valves, a plurality of bucket directional flow control valves, and a plurality of opening/closing directional flow control valves for controlling respective flows of the hydraulic fluids supplied from said six first hydraulic pumps to said boom hydraulic cylinder, said arm hydraulic cylinder, said bucket hydraulic cylinder, and said opening/closing hydraulic cylinder;

a boom-raising inflow control valve, a bucket-crowding inflow control valve and a bucket-dumping inflow control valve for controlling respective flows of the hydraulic fluids delivered from said two second hydraulic pumps and supplied to a rod pushing-side chamber of said boom hydraulic cylinder, a rod pushing-side chamber of said bucket hydraulic cylinder, and a rod drawing-side chamber of said bucket hydraulic cylinder without passing said plurality of boom directional flow control valves and said plurality of bucket directional flow control valves;

a bypass flow control valve for returning the hydraulic fluids delivered from said two second hydraulic pumps to a reservoir;

a boom recovery flow control valve and an arm recovery flow control valve for introducing the hydraulic fluids in the rod pushing-side chambers of said boom hydraulic cylinder and said arm hydraulic cylinder to rod drawing-side chambers thereof;

an opening/closing recovery flow control valve for introducing the hydraulic fluid in a rod drawing-side chamber of said opening/closing hydraulic cylinder to a rod pushing-side chamber thereof; and said hydraulic system being configured such that when said boom hydraulic cylinder, said arm hydraulic cylinder, said bucket hydraulic cylinder and said opening/closing hydraulic cylinder are operated to extend, and with respect to the boom and bucket hydraulic cylinders, the hydraulic fluids from said first hydraulic pumps are supplied to said rod pushing-side chambers thereof through the directional flow control valves for the boom and bucket hydraulic cylinders, respectively, and the hydraulic fluids from said second hydraulic pumps are supplied to said rod pushing-sides chambers thereof through said boom-raising and bucket-crowding inflow control valves, respectively, with being joined with the hydraulic fluids from said first hydraulic pumps, and with respect to the arm hydraulic cylinder, the hydraulic fluids from said first hydraulic pumps are supplied to said rod pushing-side chamber thereof through the directional flow control valves for the arm hydraulic cylinder, and with respect to the opening/closing hydraulic cylinder, the hydraulic fluids from said first hydraulic pumps are supplied to said rod pushing-side chamber thereof through the directional flow control valves for the opening/closing hydraulic cylinder, and part of the fluid discharged from said rod drawing-side chamber thereof is supplied to said rod pushing-side chamber thereof through said opening/closing recovery flow control valve, while all fluids discharged from the rod drawing-side chambers of said boom, arm and bucket hydraulic cylinders and the remaining part of the fluid discharged from the rod pushing-side chamber of the opening/closing, hydraulic cylinder are returned to said reservoir only through the directional flow control valves for the boom, arm, bucket and opening/closing hydraulic cylinders, and when said boom hydraulic cylinder, said arm hydraulic cylinder, said bucket hydraulic cylinder and said opening/closing hydraulic cylinder are operated to contract, and with respect to said boom and arm hydraulic cylinders, the hydraulic fluids from said first hydraulic pumps are supplied to said rod drawing-side chambers thereof through the directional flow control valves for the boom and arm hydraulic cylinders, respectively, and part of the hydraulic fluids from said rod pushing-side chambers thereof are supplied to the rod drawing-side chambers thereof through said boom and arm recovery flow control valves, and with respect to said bucket hydraulic cylinder, the hydraulic fluids from said first hydraulic pumps are supplied to said rod drawing-side chamber thereof through the directional flow control valves for the bucket hydraulic cylinder, and the hydraulic fluids from said second hydraulic pumps are supplied to the rod drawing-side chamber thereof through said bucket-dumping inflow control valve, and being joined with the hydraulic fluids from the first hydraulic pumps, and with respect to the opening/closing hydraulic cylinder, the hydraulic fluids from said first hydraulic pumps are supplied to said rod drawing-side chamber thereof through the directional flow control valves for the opening/closing hydraulic cylinder, while the remaining part of the fluids discharged from the rod pushing-side chambers of the boom and arm hydraulic cylinders and all fluids discharged from the rod pushing-side chambers of the bucket and opening/closing hydraulic cylinders are returned to said reservoir only through the directional flow control valves for the boom, arm, bucket and opening/closing hydraulic cylinders.

14. A hydraulic drive system for a construction machine comprising a travel body, a swing body swingably mounted onto said travel body, and a multi-articulated front operating mechanism made up of a boom rotatably coupled to said swing body, an arm rotatably coupled to said boom, and a bucket rotatably coupled to said arm, wherein said hydraulic drive system comprises:

a boom hydraulic cylinder, an arm hydraulic cylinder, and a bucket hydraulic cylinder for driving said boom, said arm, and said bucket, respectively;

at least one hydraulic pump mounted on said swing body;

a common high-pressure line having one side connected to the delivery side of said at least one hydraulic pump and the other side extended to the side of said front operating mechanism;

a boom branch line branched from said common high-pressure line and connected on the side opposite to the branched side to a rod pushing-side chamber of said boom hydraulic cylinder;

a boom inflow control valve disposed near a branch position at which said boom branch line is branched from said common high-pressure line, and controlling a flow of a hydraulic fluid supplied from said common high-pressure line to the rod pushing-side chamber of said boom hydraulic cylinder;

an arm branch line branched from said common high-pressure line at a position downstream of the branch position of said boom branch line and connected on the side opposite to the branched side to a rod pushing-side chamber of said arm hydraulic cylinder;

an arm inflow control valve disposed near a branch position at which said arm branch line is branched from said common high-pressure line, and controlling a flow of a hydraulic fluid supplied from said common high-pressure line to the rod pushing-side chamber of said arm hydraulic cylinder;

a bucket branch line branched from said common high-pressure line at a position downstream of the branch position of said boom branch line and connected on the side opposite to the branched side to a rod pushing-side chamber of said bucket hydraulic cylinder; and a bucket inflow control valve disposed near the branch position at which said bucket branch line is branched from said common high-pressure line, and controlling a flow of a hydraulic fluid supplied from said common high-pressure line to the rod pushing-side chamber of said bucket hydraulic cylinder; and wherein:

said inflow control valves are all disposed together in one control valve unit.

15. A hydraulic drive system for a construction machine according to claim 14, wherein:

said one control valve unit is disposed on said boom.

16. A hydraulic drive system for a construction machine comprising a travel body, a swing body swingably mounted onto said travel body, and a multi-articulated front operating mechanism made up of a boom rotatably coupled to said swing body, an arm rotatably coupled to said boom, and a bucket rotatably coupled to said arm, wherein said hydraulic drive system comprises:

a boom hydraulic cylinder, an arm hydraulic cylinder, and a bucket hydraulic cylinder for driving said boom, said arm, and said bucket, respectively;

at least one hydraulic pump mounted on said swing body;

a common high-pressure line having one side connected to the delivery side of said at least one hydraulic pump and the other side extended to the side of said front operating mechanism;

a boom branch line branched from said common high-pressure line and connected on the side opposite to the branched side to a rod pushing-side chamber of said boom hydraulic cylinder;

a boom inflow control valve disposed near a branch position at which said boom branch line is branched from said common high-pressure line, and controlling a flow of a hydraulic fluid supplied from said common high-pressure line to the rod pushing-side chamber of said boom hydraulic cylinder;

an arm branch line branched from said common high-pressure line at a position downstream of the branch position of said boom branch line and connected on the side opposite to the branched side to a rod pushing-side chamber of said arm hydraulic cylinder;

an arm inflow control valve disposed near a branch position at which said arm branch line is branched from said common high-pressure line, and controlling a flow of a hydraulic fluid supplied from said common high-pressure line to the rod pushing-side chamber of said arm hydraulic cylinder;

a bucket branch line branched from said common high-pressure line at a position downstream of the branch position of said boom branch line and connected on the side opposite to the branched side to a rod pushing-side chamber of said bucket hydraulic cylinder; and a bucket inflow control valve disposed near the branch position at which said bucket branch line is branched from said common high-pressure line, and controlling a flow of a hydraulic fluid supplied from said common high-pressure line to the rod pushing-side chamber of said bucket hydraulic cylinder;

wherein said hydraulic drive system further comprises at least one of three sets comprising:

a boom return fluid joining line branched from said boom branch line at a position nearer to said boom hydraulic cylinder than said boom inflow control valve and connected on the side opposite to the branched side to a hydraulic reservoir, and a boom outflow control valve disposed in said boom return fluid joining line near a branch position at which said boom return fluid joining line is branched from said boom branch line and controlling a flow of a hydraulic fluid drained from said boom hydraulic cylinder to said hydraulic reservoir;

an arm return fluid joining line branched from said arm branch line at a position nearer to said arm hydraulic cylinder than said arm inflow control valve and connected on the side opposite to the branched side to said hydraulic reservoir, and an arm outflow control valve disposed in said arm return fluid joining line near a branch position at which said arm return fluid joining line is branched from said arm branch line and controlling a flow of a hydraulic fluid drained from said arm hydraulic cylinder to said hydraulic reservoir; and a bucket return fluid joining line branched from said bucket branch line at a position nearer to said bucket hydraulic cylinder than said bucket inflow control valve and connected on the side opposite to the branched side to said hydraulic reservoir, and a bucket outflow control valve disposed in said bucket return fluid joining line near a branch position at which said bucket return fluid joining line is branched from said bucket branch line and controlling a flow of a hydraulic fluid drained from said bucket hydraulic cylinder to said hydraulic reservoir; and wherein:

said inflow control valves and said outflow control valves are all disposed together in one control valve unit.

17. A hydraulic drive system for a construction machine according to claim 16, wherein:

said one control valve unit is disposed on said boom.

18. A hydraulic drive system for a construction machine comprising a travel body, a swing body swingably mounted onto said travel body, and a multi-articulated front operating mechanism made up of a boom rotatably coupled to said swing body, an arm rotatably coupled to said boom, and a bucket rotatably coupled to said arm to be open forward in a ground contact state, wherein said hydraulic drive system comprises:

six first hydraulic pumps and two second hydraulic pumps driven by a plurality of prime movers;

a boom hydraulic cylinder, an arm hydraulic cylinder and a bucket hydraulic cylinder supplied with hydraulic fluids delivered from said first hydraulic pump and said second hydraulic pump to drive said boom, said arm and said bucket, respectively, and an opening/closing hydraulic cylinder supplied with the hydraulic fluids to open and close said bucket;

a plurality of boom directional flow control valves, a plurality of arm directional flow control valves, a plurality of bucket directional flow control valves, and a plurality of opening/closing directional flow control valves for controlling respective flows of the hydraulic fluids supplied from said six first hydraulic pumps to said boom hydraulic cylinder, said arm hydraulic cylinder, said bucket hydraulic cylinder, and said opening/closing hydraulic cylinder; a boom-raising inflow control valve, a bucket-crowding inflow control valve and a bucket-dumping inflow control valve for controlling respective flows of the hydraulic fluids delivered from said two second hydraulic pumps and supplied to a rod pushing-side chamber of said boom hydraulic cylinder, a rod pushing-side chamber of said bucket hydraulic cylinder, and a rod drawing-side chamber of said bucket hydraulic cylinder without passing said plurality of boom directional flow control valves and said plurality of bucket directional flow control valves;

a bypass flow control valve for returning the hydraulic fluids delivered from said two second hydraulic pumps to a reservoir;

a boom recovery flow control valve and an arm recovery flow control valve for introducing the hydraulic fluids in the rod pushing-side chambers of said boom hydraulic cylinder and said arm hydraulic cylinder to rod drawing-side chambers thereof; and an opening/closing recovery flow control valve for introducing the hydraulic fluid in a rod drawing-side chamber of said opening/closing hydraulic cylinder to a rod pushing-side chamber thereof.

19. A hydraulic drive system for a construction machine according to claim 18, wherein:

said inflow control valves are all disposed together in one control valve unit.

20. A hydraulic drive system for a construction machine according to claim 19, wherein:

said one control valve unit is disposed on said boom.

21. A hydraulic drive system for a construction machine comprising a travel body, a swing body swingably mounted onto said travel body, and a multi-articulated front operating mechanism coupled to said swing body in a vertically angularly movable manner and made up of a boom, an arm and a bucket, wherein said hydraulic drive system comprises:

a first hydraulic pump and a second hydraulic pump driven by prime movers;

a plurality of hydraulic cylinders including a boom hydraulic cylinder, an arm hydraulic cylinder and a bucket hydraulic cylinder supplied with hydraulic fluids delivered from said first hydraulic pump and said second hydraulic pump to drive said boom, said arm, and said bucket, respectively;

a plurality of directional flow control valves for controlling respective flows of the hydraulic fluid supplied from said first hydraulic pump to said plurality of hydraulic cylinders;

at least one inflow control valve for controlling a flow of the hydraulic fluid delivered from said second hydraulic pump and supplied to a rod pushing-side chamber of at least said boom hydraulic cylinder among said plurality of hydraulic cylinders without passing said directional flow control valves;

a bypass flow control valve for returning the hydraulic fluid delivered from said second hydraulic pump; and at least one recovery flow control valve for introducing the hydraulic fluid in the rod pushing-side chamber of at least said boom hydraulic cylinder among said plurality of hydraulic cylinders to a rod drawing-side chamber thereof; and wherein:

said inflow control valves are all disposed together in one control valve unit.

22. A hydraulic drive system for a construction machine according to claim 21, wherein:

said one control valve unit is disposed on said boom.

23. A hydraulic drive system for a construction machine comprising a travel body, a swing body swingably mounted onto said travel body, and a multi-articulated front operating mechanism made up of a boom rotatably coupled to said swing body, an arm rotatably coupled to said boom, and a bucket rotatably coupled to said arm to be open forward in a ground contact state, wherein said hydraulic drive system comprises:

at least one first hydraulic pump and at least one second hydraulic pump driven by a plurality of prime movers;

a plurality of hydraulic cylinders including a boom hydraulic cylinder, an arm hydraulic cylinder and a bucket hydraulic cylinder supplied with hydraulic fluids delivered from said first hydraulic pump and said second hydraulic pump to drive said boom, said arm and said bucket, respectively, and an opening/closing hydraulic cylinder supplied with the hydraulic fluids to open and close said bucket;

a plurality of directional flow control valves for controlling respective flows of the hydraulic fluid supplied from said first hydraulic pump to said plurality of hydraulic cylinders;

at least two inflow control valve for controlling respective flows of the hydraulic fluid delivered from said second hydraulic pump and supplied to rod pushing-side chambers of at least said boom hydraulic cylinder and said bucket hydraulic cylinder among said plurality of hydraulic cylinders without passing said directional flow control valves;

a bypass flow control valve for returning the hydraulic fluid delivered from said second hydraulic pump to a reservoir; and at least two recovery flow control valve for introducing the hydraulic fluids in the rod pushing-side chambers of at least said boom hydraulic cylinder and said arm hydraulic cylinder among said plurality of hydraulic cylinders to rod drawing-side chambers thereof; and wherein:

said inflow control valves are all disposed together in one control valve unit.

24. A hydraulic drive system for a construction machine according to claim 23, wherein:

said one control valve unit is disposed on said boom.

25. A hydraulic drive system for a construction machine comprising a travel body, a swing body swingably mounted onto said travel body, and a multi-articulated front operating mechanism made up of a boom rotatably coupled to said swing body, an arm rotatably coupled to said boom, and a bucket rotatably coupled to said arm to be open rearward in a ground contact state, wherein said hydraulic drive system comprises:

at least one first hydraulic pump and at least one second hydraulic pump driven by a plurality of prime movers;

a plurality of hydraulic cylinders including a boom hydraulic cylinder, an arm hydraulic cylinder and a bucket hydraulic cylinder supplied with hydraulic fluids delivered from said first hydraulic pump and said second hydraulic pump to drive said boom, said arm and said bucket, respectively;

a plurality of directional flow control valves for controlling respective flows of the hydraulic fluid supplied from said first hydraulic pump to said plurality of hydraulic cylinders;

a plurality of inflow control valve for controlling respective flows of the hydraulic fluid delivered from said second hydraulic pump and supplied to rod pushing-side chambers of said boom hydraulic cylinders, said arm hydraulic cylinder and said bucket hydraulic cylinder without passing said directional flow control valves;

a bypass flow control valve for returning the hydraulic fluid delivered from said second hydraulic pump to a reservoir; and at least one recovery flow control valve for introducing the hydraulic fluid in the rod pushing-side chamber of at least said boom hydraulic cylinder among said plurality of hydraulic cylinders to a rod drawing-side chamber thereof; and wherein:

said inflow control valves are all disposed together in one control valve unit.

26. A hydraulic drive system for a construction machine according to claim 25, wherein:

said one control valve unit is disposed on said boom.

* * * * *

UNITED STATES PATENT AND TRADEMARK OFFICE

CERTIFICATE OF CORRECTION

PATENT NO. : 7,500,360 B2
APPLICATION NO. : 10/499307
DATED : March 10, 2009
INVENTOR(S) : T. Udagawa et al.

It is certified that error appears in the above-identified patent and that said Letters Patent is hereby corrected as shown below:

ON THE TITLE PAGE

Please correct Item (73) Assignee to read as follows:

Item (73) Hitachi ~~Constuction~~ Construction Machinery Co., Ltd., Tokyo (JP)

Signed and Sealed this

Twelfth Day of May, 2009

JOHN DOLL
*Acting Director of the United States Patent and Trademark Office*